US011132983B2

(12) United States Patent
Heckenlively

(10) Patent No.: US 11,132,983 B2
(45) Date of Patent: Sep. 28, 2021

(54) MUSIC YIELDER WITH CONFORMANCE TO REQUISITES

(71) Applicant: Steven Heckenlively, Camarillo, CA (US)

(72) Inventor: Steven Heckenlively, Camarillo, CA (US)

( * ) Notice: Subject to any disclaimer, the term of this patent is extended or adjusted under 35 U.S.C. 154(b) by 0 days.

(21) Appl. No.: 14/463,907

(22) Filed: Aug. 20, 2014

(65) Prior Publication Data

US 2016/0055837 A1 Feb. 25, 2016

(51) Int. Cl.
*G10H 1/00* (2006.01)

(52) U.S. Cl.
CPC ..... *G10H 1/0025* (2013.01); *G10H 2210/111* (2013.01); *G10H 2210/145* (2013.01); *G10H 2220/121* (2013.01); *G10H 2220/126* (2013.01); *G10H 2240/046* (2013.01); *G10H 2240/131* (2013.01)

(58) Field of Classification Search
CPC ..... G10H 1/0025; G10H 1/0008; G10H 2210/066; G10H 2210/145; G10H 2210/111; G10H 2220/121; G10H 2220/126; G10H 2240/046; G10H 2240/131
USPC ..... 84/609
See application file for complete search history.

(56) References Cited

U.S. PATENT DOCUMENTS 4,160,399 A 7/1979 Deutsch
4,960,031 A 10/1990 Farrand
5,095,799 A 3/1992 Wallace et al.
5,274,779 A 12/1993 Stewart et al.
5,281,754 A * 1/1994 Farrett ..... G10H 1/0025 84/609
5,350,880 A 9/1994 Sato
5,405,153 A 4/1995 Hauck
5,418,322 A 5/1995 Minamitaka
5,418,323 A 5/1995 Kohonen
(Continued)

FOREIGN PATENT DOCUMENTS

EP 1395976 B1 11/2004
JP 2002311951 A 10/2002
(Continued)

OTHER PUBLICATIONS

Koelsch, Stefan, "Toward a neural basis of music perception—a review and updated model", fpsyg-02-00110.pdf, Jun. 9, 2011, pp. 3-5.

(Continued)

*Primary Examiner* — Jeffrey Donels

(57) ABSTRACT

There is disclosed a music yielding system including a controller, a music yielding device, a music analyzing device, and a musical data transferring device. The music yielding device may yield one or more sets of musical notes conforming to one or more attributes. The controller may cause one or more criteria to be set determining conformance of one or more of the sets of musical notes to one or more of the attributes. The music analyzing device may calculate and transmit one or more correlations within one or more of the sets of musical notes. The musical data transferring device may transfer one or more of the sets of musical notes between one or more origins and one or more destinations.

30 Claims, 57 Drawing Sheets

(c) 2016 S. Heckenlively

(56) References Cited

U.S. PATENT DOCUMENTS 5,451,709 A * 9/1995 Minamitaka ..... G10H 1/0025 84/609
5,496,962 A 3/1996 Meier et al.
5,693,902 A 12/1997 Hufford et al.
5,736,663 A 4/1998 Aoki et al.
5,739,451 A 4/1998 Winksy et al.
5,753,843 A 5/1998 Fay
5,773,742 A 6/1998 Zventoff et al.
5,827,988 A 10/1998 Wachi
5,866,833 A 2/1999 Wakuda et al.
5,877,445 A 3/1999 Hufford et al.
5,883,325 A 3/1999 Peirce
5,936,181 A * 8/1999 Abrams ..... G10H 1/20 84/603
5,957,696 A 9/1999 Kageyama
5,986,200 A 11/1999 Curtin
5,990,407 A 11/1999 Jannon
6,150,947 A 11/2000 Shima
6,162,982 A 12/2000 Aoki
6,175,070 B1 1/2001 Naples et al.
6,255,577 B1 7/2001 Imai
6,307,139 B1 10/2001 Iwamura
6,316,710 B1 11/2001 Lindemann
6,320,111 B1 11/2001 Kizaki
6,392,134 B2 5/2002 Aoki
6,403,870 B2 6/2002 Aoki
6,407,323 B1 6/2002 Karapetian
6,424,944 B1 7/2002 Hikawa
6,476,306 B2 11/2002 Huopaniemi et al.
6,501,011 B2 12/2002 Wesley
6,506,969 B1 1/2003 Baron
6,518,491 B2 2/2003 Kurakake et al.
6,534,701 B2 3/2003 Isozaki
6,545,209 B1 4/2003 Flannery et al.
6,555,737 B2 4/2003 Miyaki et al.
6,639,141 B2 10/2003 Kay
6,639,142 B2 10/2003 Takahashi
6,664,459 B2 12/2003 Lee et al.
6,740,802 B1 5/2004 Browne, Jr.
6,747,201 B2 6/2004 Birmingham et al.
6,831,219 B1 12/2004 Bonham
6,835,884 B2 12/2004 Iwamoto et al.
6,884,933 B2 4/2005 Akahori et al.
6,894,214 B2 5/2005 Juszkiewicz
6,897,367 B2 5/2005 Leach
6,921,855 B2 7/2005 Tanaka
6,924,426 B2 8/2005 Clynes
6,927,331 B2 8/2005 Haase
6,933,432 B2 8/2005 Shteyn et al.
6,945,784 B2 9/2005 Paquette et al.
6,967,275 B2 11/2005 Ozick
6,979,767 B2 12/2005 Georges et al.
6,984,781 B2 1/2006 Mazzoni
6,993,532 B1 1/2006 Platt et al.
7,026,535 B2 4/2006 Eruera
7,027,983 B2 4/2006 Puterbaugh et al.
7,034,217 B2 4/2006 Pachet
7,038,120 B2 5/2006 Jung et al.
7,038,123 B2 5/2006 Ludwig
7,053,291 B1 5/2006 Villa
7,078,607 B2 7/2006 Alferness
7,081,580 B2 7/2006 Brinkman et al.
7,094,962 B2 8/2006 Kayama
7,164,076 B2 1/2007 McHale et al.
7,189,911 B2 3/2007 Isozaki
7,191,023 B2 3/2007 Williams
7,202,407 B2 4/2007 Kawashima et al.
7,227,072 B1 6/2007 Weare
7,230,177 B2 6/2007 Kawashima
7,273,978 B2 9/2007 Uhle
7,282,632 B2 10/2007 van Pinxteren et al.
7,297,858 B2 11/2007 Paepcke
7,312,390 B2 12/2007 Yanagawa et al.
7,321,094 B2 1/2008 Sakurada
7,326,848 B2 2/2008 Weare et al.
7,375,274 B2 5/2008 Hiratsuka
7,385,133 B2 6/2008 Shibukawa
7,420,115 B2 9/2008 Kawamoto et al.
7,421,434 B2 9/2008 Fujiwara
7,425,673 B2 9/2008 Fujisaka et al.
RE40,543 E 10/2008 Aoki et al.
7,488,886 B2 2/2009 Kemp
7,491,878 B2 2/2009 Orr
7,504,573 B2 3/2009 Hiramatsu et al.
7,507,897 B2 3/2009 Ho
7,507,898 B2 3/2009 Horii et al.
7,518,052 B2 4/2009 Kourbatov
7,528,317 B2 5/2009 Samuel
7,531,737 B2 5/2009 Ide et al.
7,544,879 B2 6/2009 Takami
7,544,881 B2 6/2009 Makino et al.
7,557,288 B2 7/2009 Akazawa et al.
7,589,273 B2 9/2009 Uehara
7,592,532 B2 9/2009 Coleman
7,612,279 B1 11/2009 Schnepel et al.
7,643,640 B2 1/2010 Jorgensen et al.
7,655,855 B2 2/2010 Georges et al.
7,663,049 B2 2/2010 Puryear
7,680,788 B2 3/2010 Woo
7,683,251 B2 3/2010 Weir
7,705,229 B2 4/2010 Bancroft et al.
7,709,723 B2 5/2010 Pachet et al.
7,718,883 B2 5/2010 Cookerly
7,718,885 B2 5/2010 Lindemann
7,728,213 B2 6/2010 Stone et al.
7,737,354 B2 6/2010 Basu et al.
7,741,554 B2 6/2010 Sasaki et al.
7,772,478 B2 8/2010 Whitman et al.
7,774,078 B2 8/2010 Booth et al.
7,807,916 B2 10/2010 Georges
7,820,902 B2 10/2010 Furukawa et al.
7,825,320 B2 11/2010 Yatsui
7,829,777 B2 11/2010 Kyuma et al.
7,834,260 B2 11/2010 Hardesty et al.
7,842,874 B2 11/2010 Jehan
7,851,688 B2 12/2010 Compton
7,863,511 B2 1/2011 McNally
7,888,578 B2 2/2011 Guo et al.
7,928,310 B2 4/2011 Georges et al.
7,935,877 B2 5/2011 Lemons
7,964,783 B2 6/2011 Rosario et al.
7,968,783 B2 6/2011 Oshiyama et al.
7,985,912 B2 7/2011 Copperwhite et al.
7,985,913 B2 7/2011 Machell
7,990,374 B2 8/2011 Itkowitz et al.
7,994,411 B2 8/2011 Osada
3,022,287 A1 9/2011 Yamashita et al.
8,026,436 B2 9/2011 Hufford
8,026,437 B2 9/2011 Tanaka et al.
8,076,565 B1 12/2011 Bennett
8,080,722 B2 12/2011 Applewhite et al.
8,084,677 B2 12/2011 Wilder
8,090,242 B2 1/2012 Ryu
8,097,801 B2 1/2012 Gannon
8,119,896 B1 2/2012 Smith
8,212,135 B1 7/2012 Sharifi et al.
8,242,344 B2 8/2012 Moffatt
8,253,006 B2 8/2012 Kim
8,269,091 B2 9/2012 Streich et al.
8,278,545 B2 10/2012 Hamanaka
8,280,539 B2 10/2012 Jehan
8,280,920 B2 10/2012 Mercer et al.
8,283,547 B2 10/2012 Villa et al.
8,283,548 B2 10/2012 Oertl et al.
8,290,769 B2 10/2012 Taub et al.
8,294,016 B2 10/2012 Franzblau
8,338,686 B2 12/2012 Mann et al.
8,357,847 B2 1/2013 Huet et al.
8,378,964 B2 2/2013 Ullrich et al.
8,461,442 B2 6/2013 Osada
8,481,838 B1 7/2013 Smith
8,481,839 B2 7/2013 Shaffer et al.
8,492,633 B2 7/2013 Whitman et al.
8,492,635 B2 7/2013 Nakanishi

(56) References Cited

U.S. PATENT DOCUMENTS

| | | | |
|---|---|---|---|
| 8,494,849 | B2 | 7/2013 | Collotta et al. |
| 8,509,692 | B2 | 8/2013 | Ryle et al. |
| 8,527,876 | B2 | 9/2013 | Wood et al. |
| 8,592,670 | B2 | 11/2013 | Gehring et al. |
| 8,618,402 | B2 | 12/2013 | Rutledge et al. |
| 8,626,497 | B2 | 1/2014 | Lin |
| 8,634,759 | B2 | 1/2014 | Bates et al. |
| 8,656,043 | B1 | 2/2014 | Wieder |
| 8,674,206 | B2 | 3/2014 | Georges |
| 8,718,823 | B2 | 5/2014 | Tsujino et al. |
| 8,729,377 | B2 | 5/2014 | Nakagawa et al. |
| 8,742,243 | B2 | 6/2014 | Wang et al. |
| 8,779,269 | B2 | 7/2014 | Yamazaki |
| 8,847,054 | B2 | 9/2014 | Aiylam |
| 8,859,873 | B2 | 10/2014 | Ghozali |
| 8,859,876 | B2 | 10/2014 | Ludwig |
| 8,865,994 | B2 | 10/2014 | Okano et al. |
| 8,874,243 | B2 | 10/2014 | Bennett et al. |
| 8,878,042 | B2 | 11/2014 | Van Wagoner et al. |
| 8,878,043 | B2 | 11/2014 | Cheever et al. |
| 8,886,685 | B2 | 11/2014 | Mercer et al. |
| 8,895,830 | B1 | 11/2014 | Sharifi et al. |
| 8,907,195 | B1 | 12/2014 | Erol |
| 8,912,419 | B2 | 12/2014 | Fong et al. |
| 8,927,846 | B2 | 1/2015 | Matusiak |
| 8,957,296 | B2 | 2/2015 | Helms et al. |
| 8,987,572 | B2 | 3/2015 | Shimizu et al. |
| 8,987,574 | B2 | 3/2015 | Matusiak |
| 8,993,866 | B2 | 3/2015 | Jobs et al. |
| 9,024,169 | B2 | 5/2015 | Sumi et al. |
| 9,040,800 | B2 | 5/2015 | Shirakawa |
| 2005/0076772 | A1* | 4/2005 | Gartland-Jones .... G10H 1/0025 84/615 |
| 2006/0117935 | A1 | 6/2006 | Sitrick |
| 2006/0180005 | A1* | 8/2006 | Wolfram ..... G10H 1/0025 84/609 |
| 2006/0230909 | A1 | 10/2006 | Song et al. |
| 2006/0230910 | A1 | 10/2006 | Song et al. |
| 2008/0190270 | A1 | 8/2008 | Kang |
| 2010/0043625 | A1 | 2/2010 | Van Geenen et al. |
| 2011/0167988 | A1 | 7/2011 | Berkovitz |
| 2013/0103796 | A1 | 4/2013 | Fisher et al. |
| 2013/0332581 | A1 | 12/2013 | Chen et al. |
| 2014/0047971 | A1 | 2/2014 | Akazawa et al. |

FOREIGN PATENT DOCUMENTS

| | | | |
|---|---|---|---|
| JP | 2003015649 | A | 1/2003 |
| JP | 2004170470 | A | 6/2004 |
| JP | 3719156 | B2 | 11/2005 |
| WO | 02101716 | A1 | 12/2002 |
| WO | 2010038916 | A1 | 4/2010 |

OTHER PUBLICATIONS

PCT/US2015/41531 dated Oct. 16, 2015 ISA/210 International Search Report.

Randel, The Harvard Dictionary of Music, 4th Edition, 4 scanned pages, each in separate .pdf files.

Kipfer, Roget's International Thesaurus, 7th Edition, 16 scanned page, all in 1 .pdf file.

* cited by examiner (c) 2014 S. Heckenlively (c) 2014 S. Heckenlively (c) 2014 S. Heckenlively (c) 2014 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2014 S. Heckenlively (c) 2014 S. Heckenlively (c) 2014 S. Heckenlively (c) 2016 S. Heckenlively (c) 2016 S. Heckenlively (c) 2016 S. Heckenlively (c) 2016 S. Heckenlively (c) 2014 S. Heckenlively (c) 2014 S. Heckenlively (c) 2014 S. Heckenlively (c) 2014 S. Heckenlively

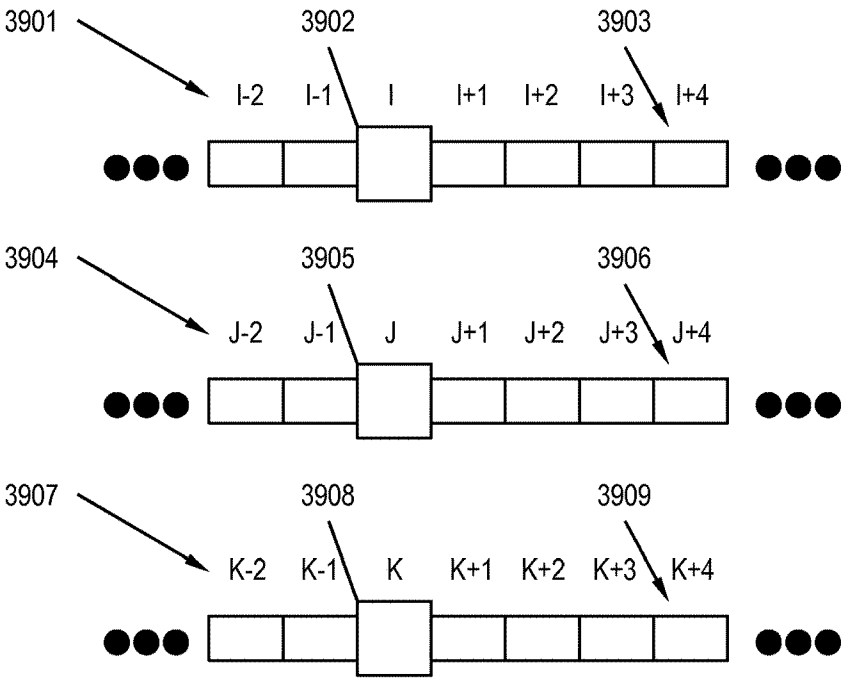
FIG. 39
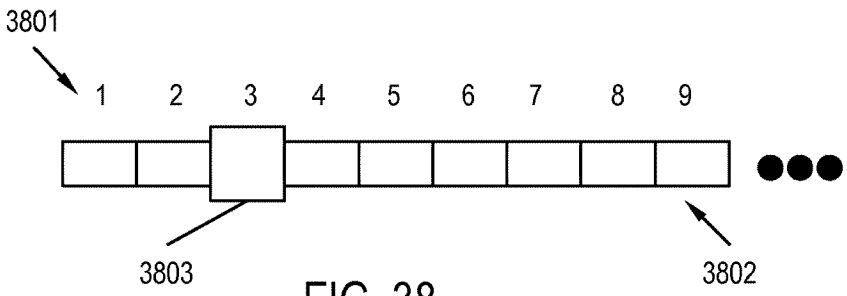
FIG. 38
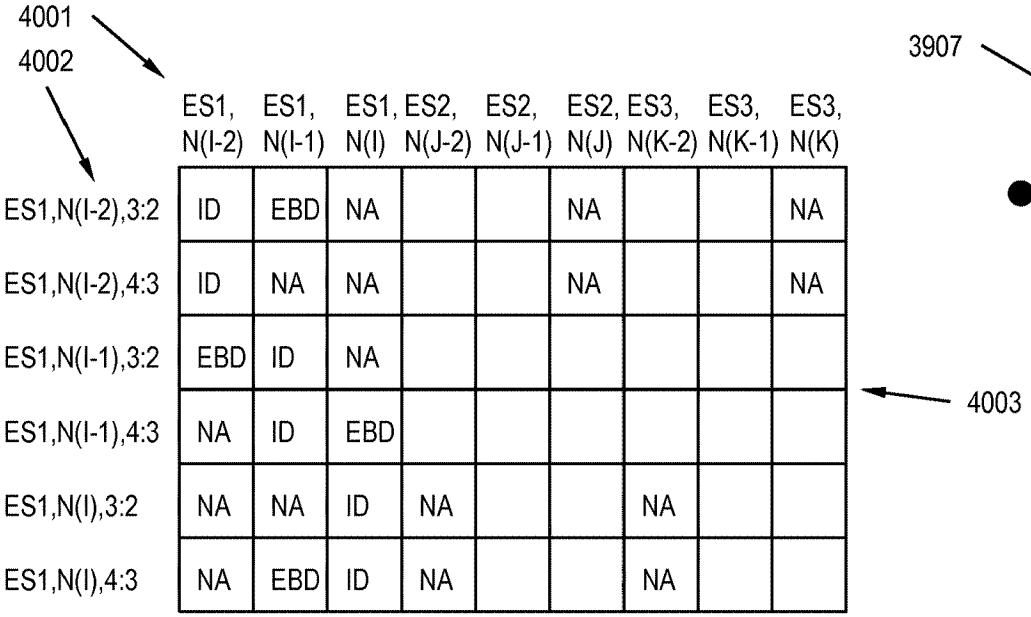
4001
4002
4003
ES1, N(I-2)
ES1, N(I-1)
ES1, N(I)
ES2, N(J-2)
ES2, N(J-1)
ES2, N(J)
ES3, N(K-2)
ES3, N(K-1)
ES3, N(K)
ES1,N(I-2),3:2
ES1,N(I-2),4:3
ES1,N(I-1),3:2
ES1,N(I-1),4:3
ES1,N(I),3:2
ES1,N(I),4:3
ID
EBD
NA
NA
NA
NA
NA
NA
NA
NA
NA
NA
NA
NA
EBD
ID
NA
NA
NA
NA
NA
NA
NA
NA
NA
NA
NA
NA (c) 2014 S. Heckenlively (c) 2016 S. Heckenlively (c) 2014 S. Heckenlively (c) 2014 S. Heckenlively (c) 2014 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2014 S. Heckenlively (c) 2014 S. Heckenlively (c) 2016 S. Heckenlively (c) 2014 S. Heckenlively (c) 2016 S. Heckenlively (c) 2016 S. Heckenlively (c) 2016 S. Heckenlively (c) 2016 S. Heckenlively (c) 2016 S. Heckenlively (c) 2016 S. Heckenlively (c) 2014 S. Heckenlively

MUSIC YIELDER WITH CONFORMANCE TO REQUISITES

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

This disclosure references 10 computer program listing appendices. All 10 appendices are incorporated herein by reference. All 10 appendices are included within one file. The name of the file is appendices_5.txt, the date of creation of the file is Sep. 2, 2016, and the size of the file in bytes is 62,055.

Appendix 01 is exemplary C-language first conformance evaluating functions and second conformance evaluating functions determining conformance to first attributes and first associations.

Appendix 02 is program design language for exemplary generation of individual first set of notes.

Appendix 03 is program design language for an example of the VST/AU host loading the exemplary computing device.

Appendix 04 is exemplary C++ class derivation code fragments.

Appendix 05 is program design language for creation and use of exemplary display screen components.

Appendix 06 is program design language for an exemplary workflow using the exemplary computing device.

Appendix 07 is program design language for exemplary assignment of color to display elements.

Appendix 08 is program design language for exemplary interval music analyzing device grid updates during host playback.

Appendix 09 is program design language for exemplary updating of a link-traversal table.

Appendix 10 is program design language for exemplary updating of an interval checklist.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND OF THE INVENTION (1) Field

This disclosure relates to music.

(2) Description of the Related Art

One aspect of music is the communication of artistic intent. Writing or selecting music includes expressing subjective elements of humanity, within a medium founded on objective physical science, as realized in musical instruments or the human voice. The creative leap from subjective to objective, in a way which communicates to others or self, is prefaced with myriad possible combinations of musical notes.

The number of combinations of notes an instrument may provide grows exponentially with the number of notes per combination. Mathematically, the number of combinations is the range of a set of notes R of the instrument (or voice) raised to the power N, the number of notes in the combination. An 88 key piano may provide over 464 billion 6-note combinations, i.e. 88 raised to the 6th power. A concert flute with a range of 42 notes may provide over 130 million 5-note combinations.

Humans hear music with an endowment known as echoic memory, which contributes to perception of qualitative musical correlates, e.g. musical intervals. Intervals are commonly known to have subjective qualities independent of their position within the range of an instrument. The interval 3:2 describes the relative ratio between two note-frequencies, not the absolute location of the notes in the range. Intervals provide a measure of subjective expression, while incurring reduced combinatorics.

Other musical correlates also exist. One aspect of a sequence of notes is a topology based on the recurrence of notes. Another aspect of a sequence of notes is a pattern of direction from one note's frequency to the next note's frequency, either up, down, or same. Like intervals, note topology and note directions may convey subjective qualities, with combinatorics less than those of an instrument's range of a set of notes. These and other correlates may be imposed as attributes of artistic intent, to intermediate the myriad possible combinations of notes.

Having one or more proposed combinations of notes, those combinations may be evaluated against the artistic intent. Whether a combination is near to, or far from, the intent, causality information may be factored into subsequent combinations. Visual representation of musical correlates during audit may enhance causality information.

A musical composition may run the gamut from a single part, with a simple melody, to multiple parts, with complex harmonies. The number of possible correlates in a musical composition grows exponentially with the number of parts, instrumental or vocal. This is because humans may perceive correlates between any combination of the parts. A 7:5 interval may be recognized between two instruments on opposite sides of an orchestra. Again, visual representation of musical correlates may enhance identifying causality.

Given that music predates recorded history, tools for writing or selecting music have advanced in association with advances in technology. Toolsets for music writing, or music selection, are varied, technological, and interconnected. The operating environment of music toolsets includes ubiquitous electronic devices, e.g. personal computers, phones, and tablets; specialized devices and systems; and services.

This application file contains at least one drawing executed with black-and-white symbology for color. All colors are for example purposes only. The key for color symbology is FIG. 69. Within this description, the term "storage medium" does not encompass transitory media such as propagating waveforms and signals.

DESCRIPTION OF THE DRAWINGS

FIG. 38 is a block diagram of one 2-D first attribute in the exemplary computing device.

FIG. 39 is a block diagram of plural 2-D first attributes in the context of the plural controller example of FIG. 30.

FIG. 40 is a block diagram of an example of association of a 2-D first attribute with families of sets assembled with the first attributes of FIG. 39.

Note that throughout this description, elements appearing in figures are assigned four-digit reference numbers, where the two most significant digits are the figure number, and the two least significant digits are element-specific.

In block diagrams, arrow-terminated lines may indicate data paths rather than signals. Each data path may be multiple units in width. For example, each data path may consist of 4, 8, 16, 64, 256, or more parallel connections.

DETAILED DESCRIPTION

Description of Apparatus.

Figure 1:
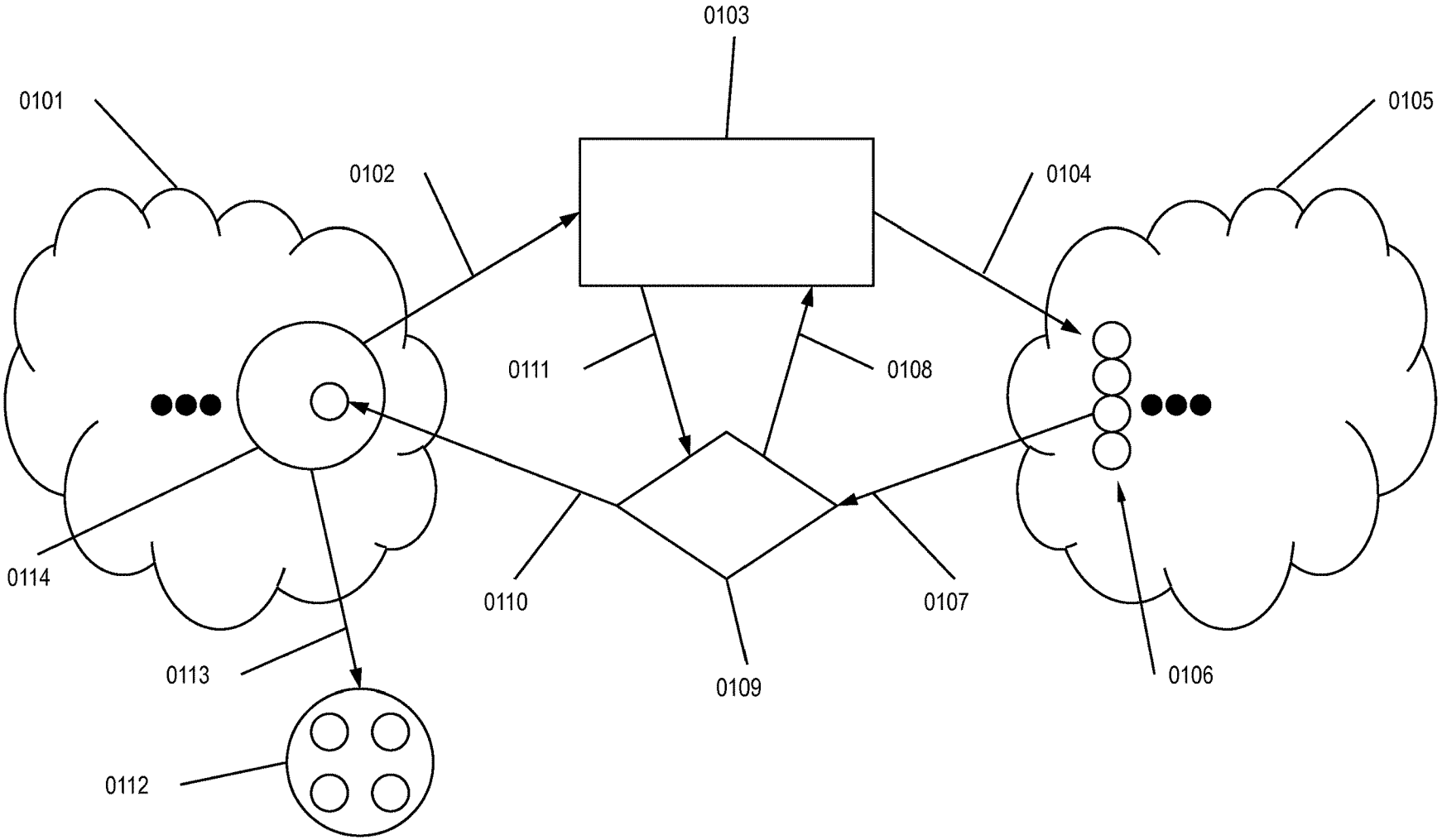
FIG. 01 is a block diagram of a music generation environment.

FIG. 01 is a block diagram of a music yielding environment. A determinant 0109 may provide one or more specifications 0108 to a toolset 0103, which then may perform a yield 0104 of one or more candidate musical parts 0106 from a superset of musical parts 0105. The specifications 0108 may include musical notes input via a musical keyboard, and/or notes in musical staff notation input via an alphanumeric keyboard and/or pointing device, etc. (not shown). The toolset 0103 may include a digital audio workstation, and/or a scorewriter, and/or sample-libraries of musical instruments, etc. (not shown).

The determinant 0109 may make a selection 0107 among the candidate musical parts 0106 and may perform an integration 0110 of the selection 0107 into a working composition 0114, from a superset of compositions 0101. The determinant 0109 then may effect a playback 0102 of the working composition 0114 to the toolset 0103 for an evaluation 0111 by the determinant 0109.

The determinant 0109 may iterate multiple times thru one or more of the above steps to completion 0113 of final composition 0112.

Figure 2:
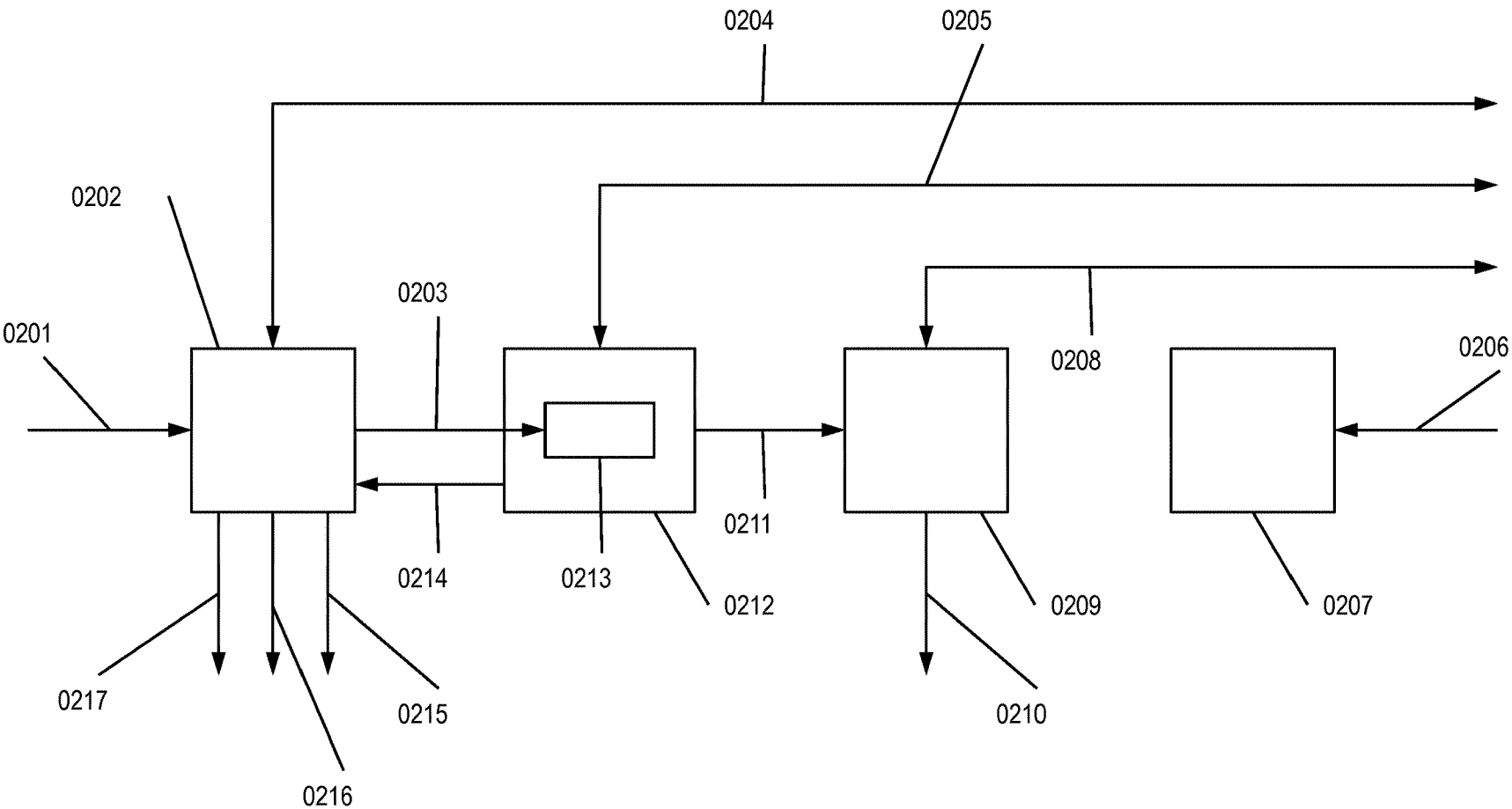
FIG. 02 is a block diagram of a music generating system.

Referring now to FIG. 02, a music yielding system may include a system music yielding device 0212 coupled to a system controller 0202. The system music yielding device 0212 may yield one or more system first sets of notes 0211, which include musical notes, and which conform in one or more predetermined minimum first degrees to one or more first attributes of one or more of the first sets of notes. The system music yielding device 0212 may include one or more system first criteria 0213 determining one or more second degrees of conformance of the system first sets of notes 0211 to the first attributes.

The system music yielding device 0212 may be adapted to set the system first criteria 0213 in response to one or more system first conformance evaluating functions 0203 data received from the system controller 0202.

The system controller 0202 may receive one or more system first input 0201 data indications which may include the first attributes of the system first sets of notes 0211 yielded by the system music yielding device 0212. The system first input 0201 data indications may be received from one or more manual sources and/or one or more automated sources.

The system may include a system musical data transferring device 0207 coupled to the system controller 0202. The system musical data transferring device 0207 may receive system third input 0206 data indications which may include a musical data source and a musical data destination. The musical data source may be e.g. a data file within an environment external to the system. The musical data destination may be the system controller 0202. The system third input 0206 data indications may be received from one or more manual sources and/or one or more automated sources.

The system musical data transferring device 0207 may transfer one or more system musical data items re controller 0204, e.g. one or more additional first attributes, from the data file to the system controller 0202. The system music yielding device 0212 may be coupled to the system musical data transferring device 0207.

The system musical data transferring device 0207 may receive one or more system third input 0206 data indications which may include a musical data source, which may be e.g. a data file within an environment external to the system, and a musical data destination, which may be the system music yielding device 0212. The system musical data transferring device 0207 may transfer one or more system musical data items re music yielding device 0205, e.g. additional predetermined minimum first degrees of conforming, from the data file to the system music yielding device 0212.

The system controller 0202 may cause the system music yielding device 0212 to set the system first criteria 0213 to the system first conformance evaluating functions 0203, which may calculate one or more second attributes of one or more of the system first sets of notes 0211, compare one or more of the second attributes to one or more of the first attributes and return one or more of the second degrees of conformance.

The system controller 0202 may transmit one or more fourth output 0215 data indications which may include one or more counts of the system first sets of notes 0211 conforming in one or more predetermined minimum third degrees to the first attributes. The fourth output 0215 data indications may be transmitted to one or more personal destinations and/or one or more automated destinations.

The system music yielding device 0212 may transmit one or more system effects 0214 of the first attributes upon the system music yielding device 0212. The system controller 0202 may receive the system effects 0214. The system controller 0202 may transmit one or more third output 0216 data indications which may include the system effects 0214. The third output 0216 data indications may be transmitted to one or more personal destinations and/or one or more automated destinations.

The system may include a system music analyzing device 0209 coupled to the system music yielding device 0212. The system music yielding device 0212 may transmit one or more system first sets of notes 0211 to the system music analyzing device 0209. The system music analyzing device 0209 may be coupled to the system musical data transferring device 0207.

The system musical data transferring device 0207 may receive one or more system third input 0206 data indications which may include a musical data source, which may be e.g. a first process within an environment external to the system, and a musical data destination, which may be the system music analyzing device 0209. The system musical data transferring device 0207 may transfer one or more system musical data items re music analyzing device 0208, e.g. second sets of notes which may include musical notes, from the first process to the system music analyzing device 0209.

The system music analyzing device 0209 may calculate one or more correlations within the system first sets of notes 0211 and/or the second sets of notes. The system music analyzing device 0209 may transmit one or more first output 0210 data indications which may include one or more of the correlations.

The first output 0210 data indications may be transmitted to one or more personal destinations and/or one or more automated destinations.

The system musical data transferring device 0207 may receive one or more system third input 0206 data indications which may include a musical data source, which may be e.g. a data file within an environment external to the system, and a musical data destination, which may be the system controller 0202. The system musical data transferring device 0207 may transfer one or more system musical data items re controller 0204, e.g. second sets of notes which may include musical notes, from the data file to the system controller 0202.

The system controller 0202 may transmit one or more system second output 0217 data indications which may include one or more third attributes of the second sets of notes. The system second output 0217 data indications may be transmitted to one or more personal destinations and/or one or more automated destinations.

The system musical data transferring device 0207 may receive one or more system third input 0206 data indications which may include a musical data source, which may be the system music yielding device 0212, and a musical data destination, which may be e.g. a second process within an environment external to the system. The system musical data transferring device 0207 may transfer one or more system musical data items re music yielding device 0205, e.g. one or more system first sets of notes 0211, from the system music yielding device 0212 to the second process.

The system musical data transferring device 0207 may receive one or more system third input 0206 data indications which may include a musical data source, which may be the system controller 0202, and a musical data destination, which may be e.g. a data file within an environment external to the system. The system musical data transferring device 0207 may transfer one or more system musical data items re controller 0204, e.g. one or more system first input 0201 data indications, from the system controller 0202 to the data file.

The system musical data transferring device 0207 may receive one or more system third input 0206 data indications which may include a musical data source, which may be the system music analyzing device 0209, and a musical data destination, which may be e.g. a data file within an environment external to the system. The system musical data transferring device 0207 may transfer one or more system musical data items re music analyzing device 0208, e.g. one or more first output 0210 data indications, from the system music analyzing device 0209 to the data file.

The couplings described above between the system controller 0202, the system music yielding device 0212, the system musical data transferring device 0207 and the system music analyzing device 0209, as well as the personal inputs/outputs and the automated inputs/outputs described above, may be via a network which may be a local area network; via one or more buses such as a USB bus, a PCI bus, a PCI Express bus, or other parallel or serial data bus; via one or more direct wired, optical fiber, or wireless connections; or via a combination of one or more of direct connections, network connections, and bus connections. The network may be or include the Internet, or any other private or public network. To access the Internet, the system may run a browser such as Microsoft Explorer or Mozilla Firefox; a social networking service such as Facebook or Twitter; or an e-mail program such as Microsoft Outlook or Mozilla Thunderbird; or combinations thereof.

Each of the system controller 0202, the system music yielding device 0212, the system musical data transferring device 0207 and the system music analyzing device 0209, as well as the personal inputs/outputs and the automated inputs/outputs described above, may be stationary or mobile.

Each of the system controller 0202, the system music yielding device 0212, the system musical data transferring device 0207, the system music analyzing device 0209, the couplings described above, as well as the personal inputs/outputs and the automated inputs/outputs described above, may include hardware, firmware, and/or software adapted to perform the processes described herein. Hardware and/or firmware may be general purpose or application-specific, in whole or in part. Application-specific hardware and firmware may be for example a field programmable gate array (FPGA), a programmable logic device (PLD), a programmable logic arrays (PLA), or other programmable device. Hardware and/or firmware and/or software may be mass-market, industry-specific, profession-specific, public domain, custom-built, or any mix thereof, in whole or in part. Hardware and/or firmware and/or software may be bought, leased, or a service, at cost/obligation, or free of cost/obligation, in whole or in part.

The processes, functionality and features of the system, as well as the personal inputs/outputs and the automated inputs/outputs described above, may be embodied in whole or in part in software which may be in the form of firmware, an application program, an applet (e.g., a Java applet), a browser plug-in, an application plug-in, a COM object, a dynamic linked library (DLL), a script, one or more subroutines, an operating system component, an operating system service, a network component, or a network service.

The system, as well as the personal inputs/outputs and the automated inputs/outputs described above, may run one or more software programs as described herein and may run an operating system, including, for example, versions of the Linux, Unix, MS-DOS, Microsoft Windows, Solaris, Android, iOS, and Apple Mac OS X operating systems. The operating system may be a real-time operating system, including, for example, Wind River vxWorks, Green Hills Integrity, or real-time variants of Linux.

The system, as well as the personal inputs/outputs and the automated inputs/outputs described above, may run on, or as, a virtual operating system or a virtual machine. The system, as well as the personal inputs/outputs and the automated inputs/outputs described above, may run on, or as, a dedicated or application-specific appliance. The hardware and software and their functions may be distributed such that some functions are performed by a processor and others by other devices.

Processes, functions, and the personal inputs/outputs and the automated inputs/outputs described above, may be stationary, manually relocatable, or automatically relocatable.

Two or more of the system controller 0202, the system music yielding device 0212, the system musical data transferring device 0207, the system music analyzing device 0209, the couplings described above, as well as the personal inputs/outputs and the automated inputs/outputs described above, may be collectively incorporated, partly or wholly, into one device, one firmware and/or one software adapted to perform the processes described herein.

Each of the system controller 0202, the system music yielding device 0212, the system musical data transferring device 0207, the system music analyzing device 0209, the couplings described above, as well as the personal inputs/outputs and the automated inputs/outputs described above, may be included within one or more respective pluralities.

Two or more instances of the system as well as the personal inputs/outputs and the automated inputs/outputs described above, may be included within one or more pluralities, with one or more of the systems coupled via one or more pluralities of the couplings described above.

Figure 3:
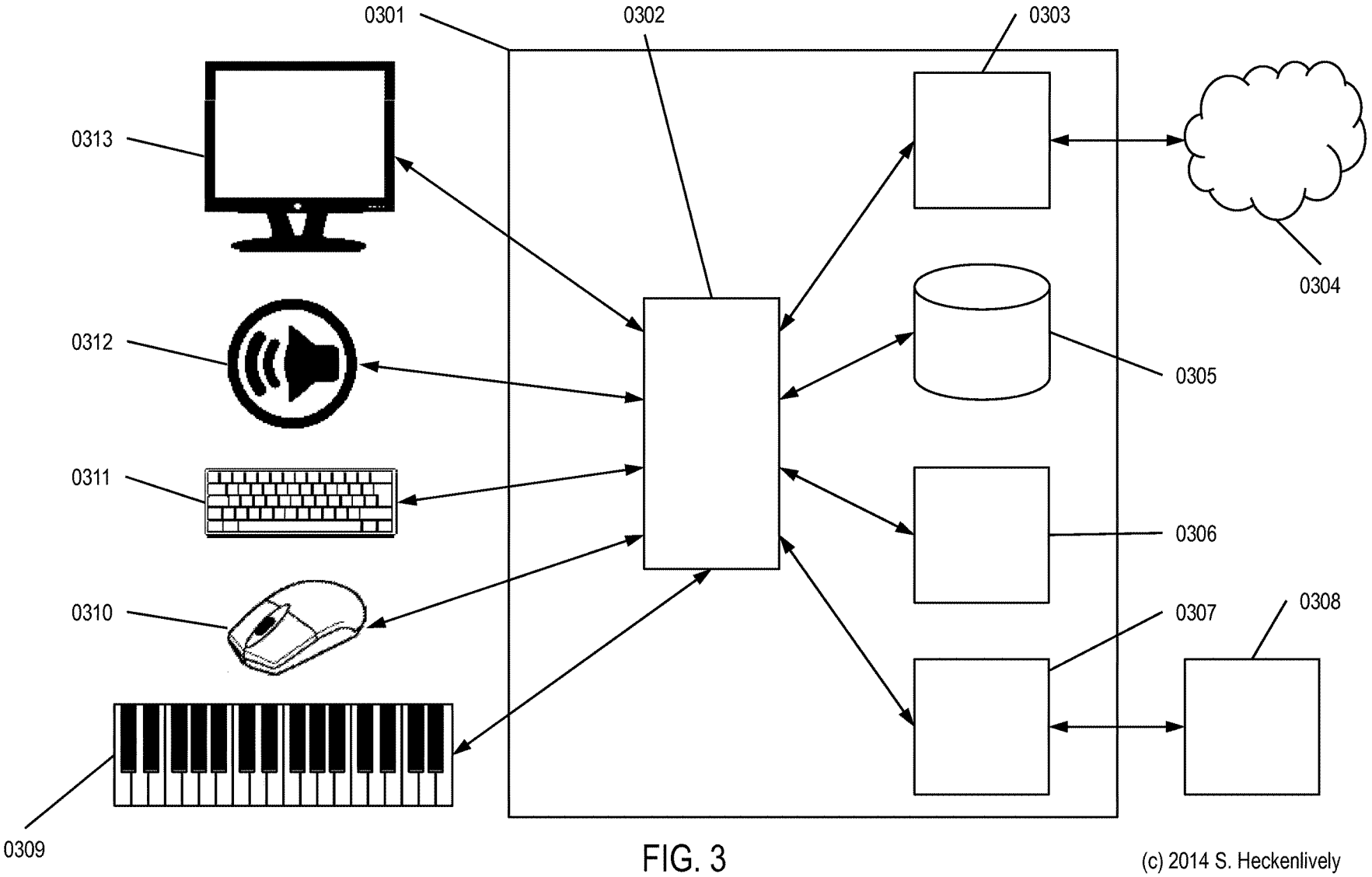
FIG. 03 is a block diagram of an exemplary computing device.

FIG. 03 is a block diagram of an exemplary computing device 0301 which may be suitable for the system controller 0202 and the system music analyzing device 0209 of FIG. 02. As used herein, a computing device refers to any device with a processor, memory and a storage device that may execute instructions, the computing device including, but not limited to, personal computers, server computers, portable computers, laptop computers, computing tablets, telephones, video game systems, set top boxes, personal video recorders, and personal digital assistants (PDAs). The computing device 0301 may include hardware, firmware, and/or software adapted to perform the processes subsequently described herein.

The computing device 0301 may include a processor 0302 coupled to a storage device 0305 and a memory 0306. The storage device 0305 may include or accept a non-transitory machine readable storage medium. As used herein, a storage device is a device that allows for reading from and/or writing to a non-transitory machine readable storage medium. As used herein, the term "non-transitory machine readable storage medium" refers to a physical object capable of storing data. The non-transitory machine readable storage medium may store instructions that, when executed by the computing device 0301, cause the computing device 0301 to perform some or all of the processes described herein.

Storage devices include hard disk drives, DVD drives, flash memory devices, and others. Non-transitory machine readable storage media include, for example, magnetic media such as hard disks, floppy disks and tape; optical media such as compact disks (CD-ROM and CD-RW) and digital versatile disks (DVD and DVD+/−RW); flash memory cards; and other storage media. The storage device may be included within a storage server (not shown) or other computing devices. The storage server may be coupled to the computing device 0301 via one or more networks, which may be or include the internet, or which may be a local area network. The storage server may be coupled to the computing device 0301 via software; or via one or more buses such as a USB bus, a PCI bus, a PCI Express bus, or other parallel or serial data bus; or via one or more direct wired, optical fiber, or wireless connections. The storage server may be coupled to the computing device 0301 via a combination of one or more of software connections, direct connections, network connections, and bus connections.

The computing device 0301 may include or interface with a display 0313; with input devices for example an alphanumeric keyboard 0311, a mouse 0310, and a music keyboard 0309; and with output devices for example an audio 0312.

The computing device 0301 may interface with one or more networks 0304 via a network interface 0303. The network interface 0303 may interface with the networks 0304 via a wired, optical fiber, or wireless connection. The networks 0304 may include or be the Internet or any other private or public network. To access the Internet, the computing device 0301 may run a browser such as Microsoft Explorer or Mozilla Firefox; a social networking service such as Facebook or Twitter; or an e-mail program such as Microsoft Outlook or Mozilla Thunderbird; or combinations thereof. Each of the computing device 0301 thru the display 0313 described above may be stationary or mobile.

The computing device 0301 may include a music yielding device interface 0307, and may interface with one or more music yielding devices 0308 via the music yielding device interface 0307. The music yielding device interface 0307 may include a combination of circuits, firmware, and software to interface with the music yielding devices 0308. The music yielding device interface 0307 may be coupled to the music yielding devices 0308 via software; via a network which may be a local area network; via one or more buses such as a USB bus, a PCI bus, a PCI Express bus, or other parallel or serial data bus; or via one or more direct wired, optical fiber, or wireless connections. The music yielding device interface 0307 may be coupled to the music yielding devices 0308 via a combination of one or more of software connections, direct connections, network connections, and bus connections.

Each of the computing device 0301 thru the display 0313 described above may include hardware, firmware, and/or software adapted to perform the processes described herein. Hardware and/or firmware may be general purpose or application-specific, in whole or in part. Application-specific hardware and firmware may be for example a field programmable gate array (FPGA), a programmable logic device (PLD), a programmable logic arrays (PLA), or other programmable device. Hardware and/or firmware and/or software may be mass-market, industry-specific, profession-specific, public domain, custom-built, or any mix thereof, in whole or in part. Hardware and/or firmware and/or software may be bought, leased, or a service, at cost/obligation, or free of cost/obligation, in whole or in part.

The processes, functionality and features of the computing device 0301 may be embodied in whole or in part in software which may be in the form of firmware, an application program, an applet (e.g., a Java applet), a browser plug-in, an application plug-in, a COM object, a dynamic linked library (DLL), a script, one or more subroutines, an operating system component, an operating system service, a network component, or a network service.

The computing device 0301 may run one or more software programs as described herein and may run an operating system, including, for example, versions of the Linux, Unix, MS-DOS, Microsoft Windows, Solaris, Android, iOS, and Apple Mac OS X operating systems. The operating system may be a real-time operating system, including, for example, Wind River vxWorks, Green Hills Integrity, or real-time variants of Linux.

The computing device 0301 may run on, or as, a virtual operating system or a virtual machine. The computing device 0301 may run on, or as, a dedicated or application-specific appliance. The hardware and software and their functions may be distributed such that some functions are performed by the processor 0302 and others by other devices. Processes and functions described above may be stationary, manually relocatable, or automatically relocatable.

Two or more of the computing device 0301 thru the display 0313 described above may be collectively incorporated, partly or wholly, upon one device, one firmware and/or one software adapted to perform the processes described herein.

Each of the computing device 0301 thru the display 0313 described above may be included within one or more respective pluralities. Two or more instances of the computing device 0301 may be included within one or more pluralities, with one or more of the computing device 0301 coupled via one or more pluralities of the couplings and/or interfaces described above.

Figure 4:
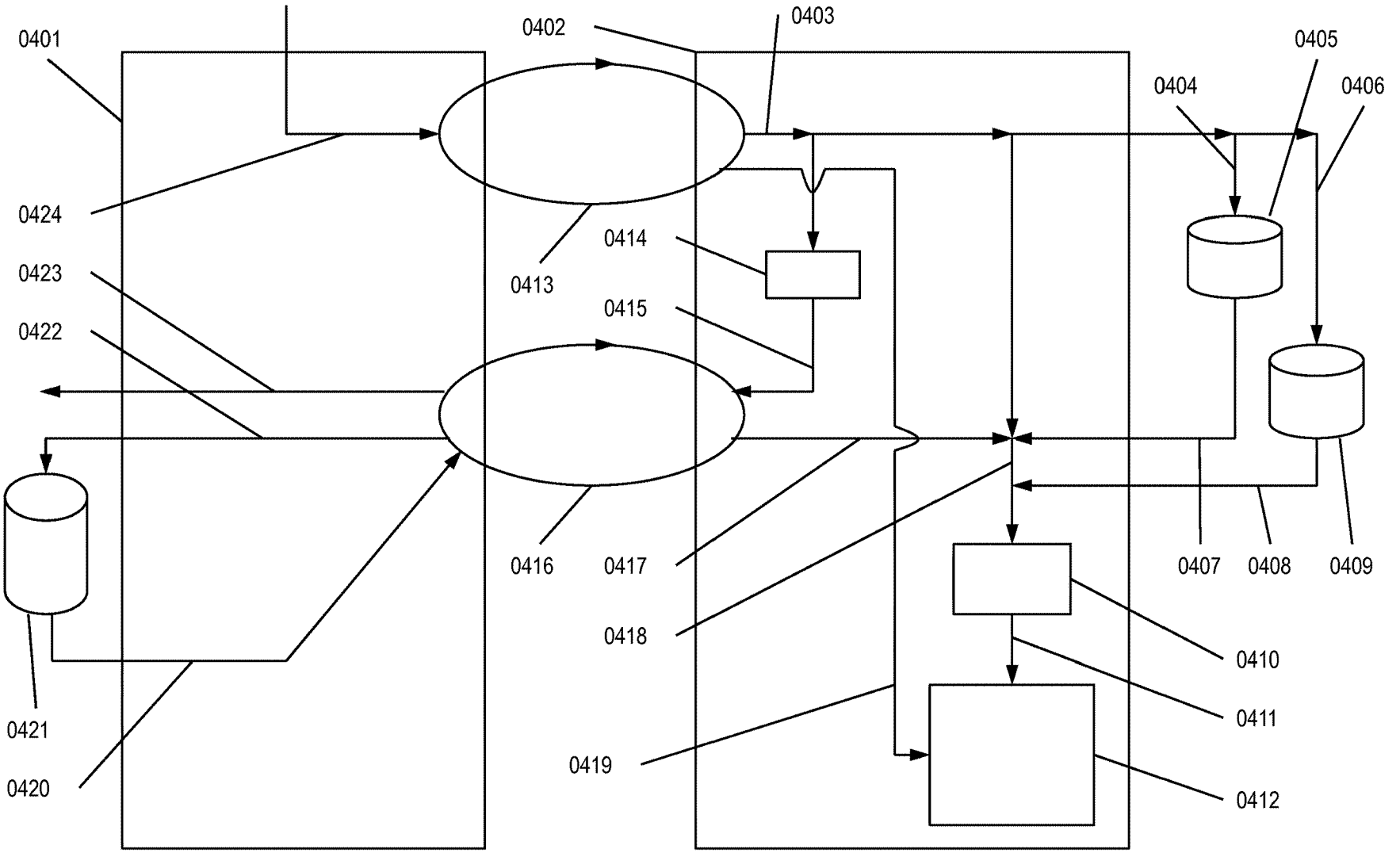
FIG. 04 is a data-flow diagram of an exemplary computing device.

FIG. 04 is a data-flow diagram of an exemplary computing device 0402, which is an implementation of the computing device 0301. In this example, and FIG. 04 thru FIG. 24, a music yielding device is referred to as an engine, and the action of yielding is referred to as generating. FIG. 04 includes the environment of the exemplary computing device 0402. The exemplary computing device 0402 is embodied in whole in software, in the form of an application plug-in. In this example, the application is a VST2/AU Host. A VST2/AU host application 0401 and the exemplary computing device 0402 illustrate the relationship between the VST2/AU Host application and the exemplary computing device 0402 plug-in.

As background, VST2 stands for version 2.4 of the Virtual Studio Technology interface, which was originated by, and is a copyright of, the corporation Steinberg Gmbh. AU stands for Audio Units, which was originated by, and is a copyright of, Apple. AU and VST2 are software interface standards which allow a set of music tools to work together, and are largely similar at a conceptual level. The exemplary computing device 0402 will be described with FIG. 04 thru FIG. 24.

As further background, human perception of music, i.e. continuous audio, is such that any delay or dropout is jarringly noticeable, even more so than slight delays in the response of the display screens. Therefore, per the VST2/AU standards, the VST2/AU host application 0401 and the exemplary computing device 0402 give highest priority to processing audio data.

A lower priority thread 0413 and a higher priority thread 0416 show how the VST2/AU host application 0401 maintains 2 processing threads with the exemplary computing device 0402. The higher priority thread 0416 processes audio data and commands from the VST2/AU host application 0401 to the exemplary computing device 0402. Because of the high priority of audio data, both a receive input indications 0424 and a generate melodies 0403 are performed as part of the lower priority thread 0413.

If a to/from host 0814 of FIG. 08 has been selected, then generated melodies are placed in a host queue 0414, and subsequently sent via a send melodies as MIDI notes 0415 to the VST2/AU host application 0401, as part of the higher priority thread 0416. Generated melodies are audited by telling the VST2/AU host application 0401 to perform a play MIDI notes 0423. The host queue 0414 is included within a LPT to HPT buffer 0517 of FIG. 05.

Because music analyzing device grids are display screens, their updates are performed by a update display screens 0419 as part of the lower priority thread 0413. However, a MIDI notes from host 0417, which is analyzed by grids, is audio data and received as part of the higher priority thread 0416.

A display buffer 0410 serves as intermediate storage between the lower priority thread 0413 and the higher priority thread 0416, providing data to an update music analyzing device grids 0411 on one or more display screens 0412. The display buffer 0410 includes a note space data structure 0701 and a display space data structure 0711 of FIG. 07. The display buffer 0410 is in turn included within a music analyzing device 0505 of FIG. 05.

As background, MIDI provides a standardized file format for saving musical note sequences for playback. MusicXML provides a standardized file format of musical score information for notation. The exemplary computing device 0402 may save generated melodies via a save as MIDI file 0404 to a MIDI file 0405, or via a save as MusicXML file 0406 to a MusicXML file 0409. The VST2/AU host application 0401 has its own project-file storage, into which it may record generated melodies via a record MIDI notes 0422 to a host project file 0421.

Encoding of note-data for first output on the display screens 0412 is performed by a translate notes to display updates 0418, which receives data from one or more of the following:

a generate melodies 0403;

a MIDI notes from host 0417;

a read MIDI file 0407;

a read MusicXML file 0408.

Figure 8:
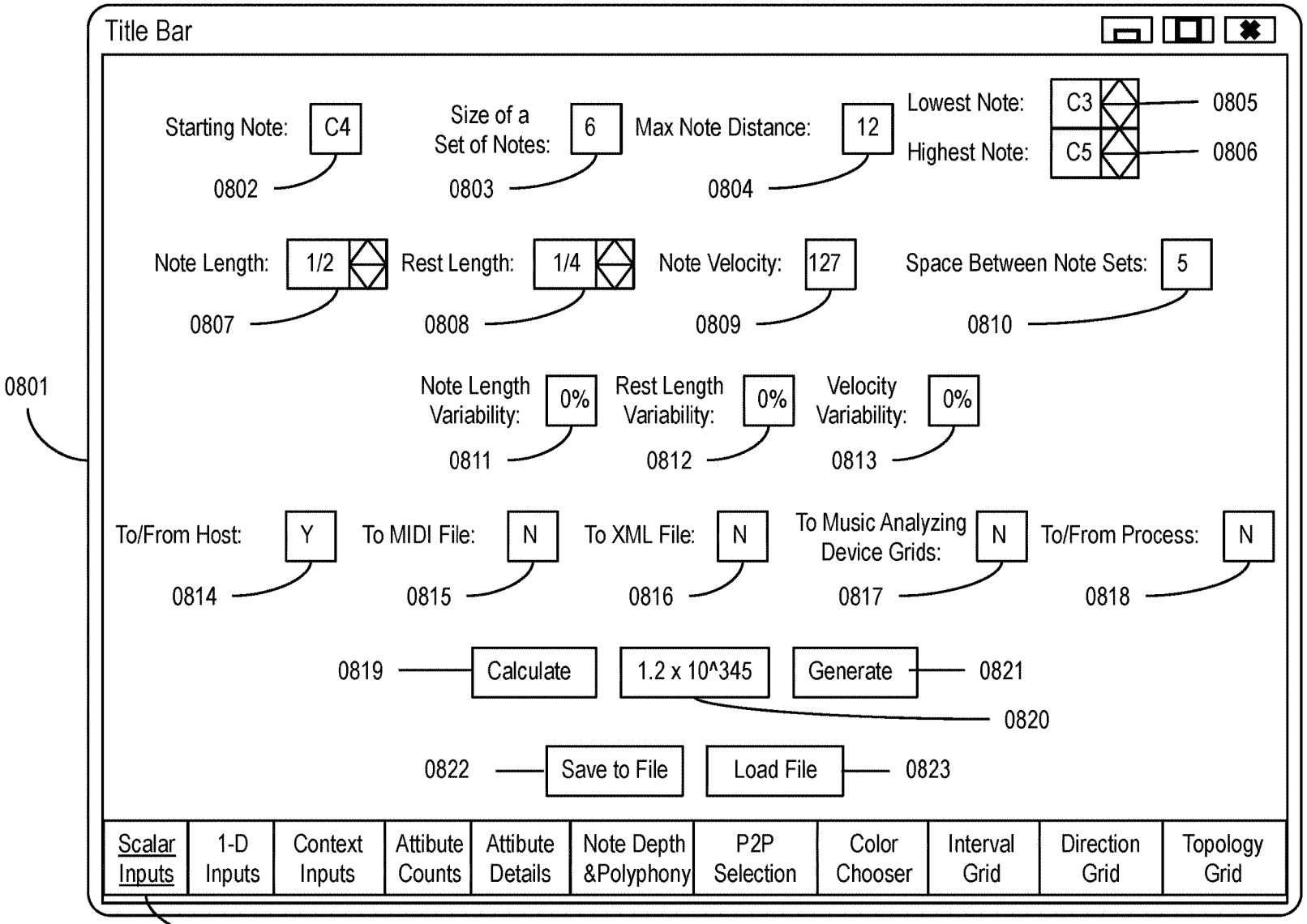
FIG. 08 is an exemplary display screen for input of first attributes and generated first set of notes characteristics, each consisting of a single value.

If the to/from host 0814 of FIG. 08 has been selected, then the translate notes to display updates 0418 receives data via the MIDI notes from host 0417. This occurs e.g. when, subsequent to completion of the generate melodies 0403, the VST2/AU host application 0401 is told to initiate a playback of composition 0420 from the host project file 0421. A to/from process 0818 of FIG. 08 controls data reception from a first process, which is in an environment external to the exemplary computing device 0402, but which is not in a host/plug-in relationship to the VST2/AU host application 0401. In this aspect, the first process is included within a musical data source, and within a third input indication.

If an output to music analyzing device grids 0817 of FIG. 08 has been selected, then the translate notes to display updates 0418 receives data via the generate melodies 0403.

Figure 16:
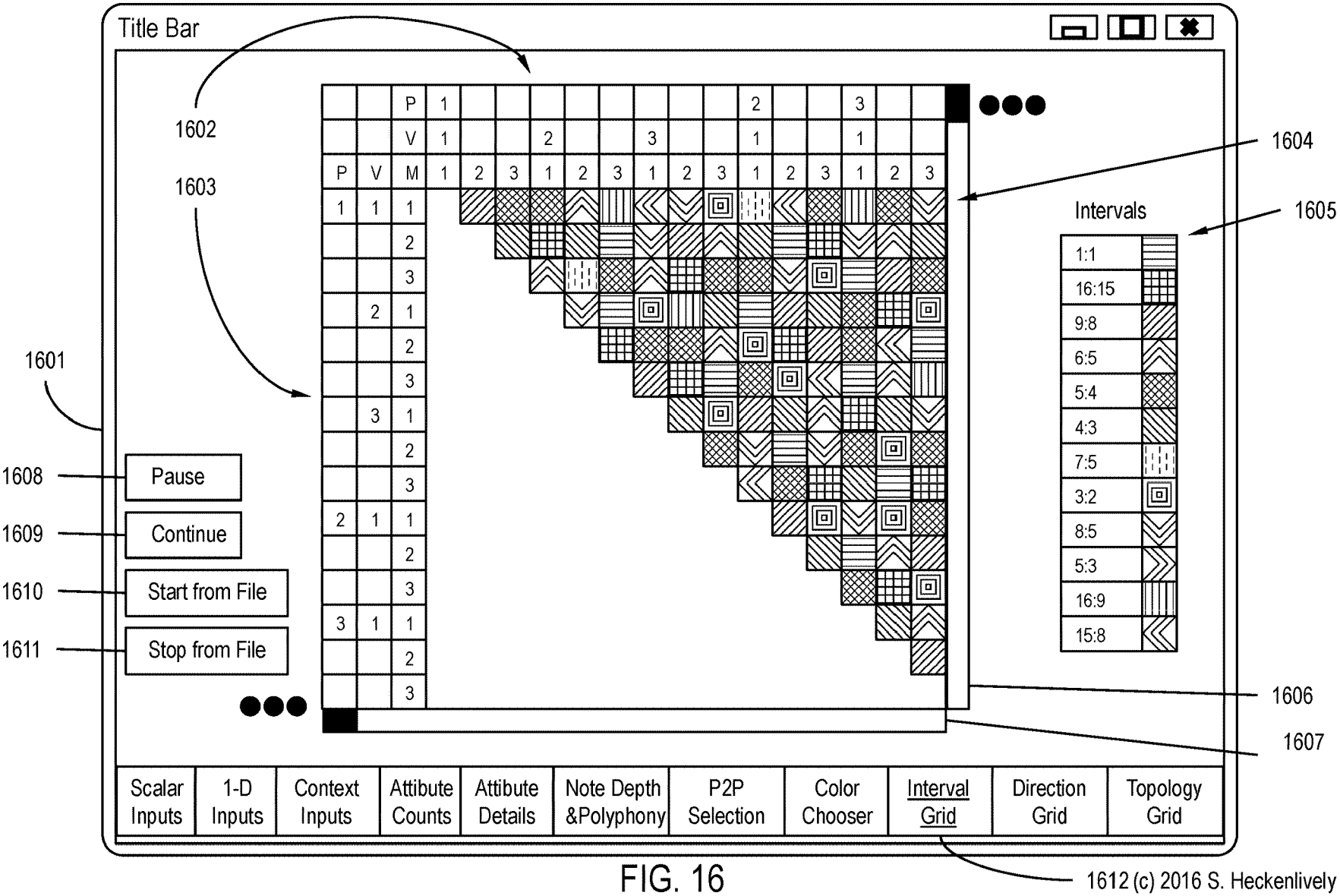
FIG. 16 is an exemplary display screen for analyzing color-coded musical interval.
Figure 17:
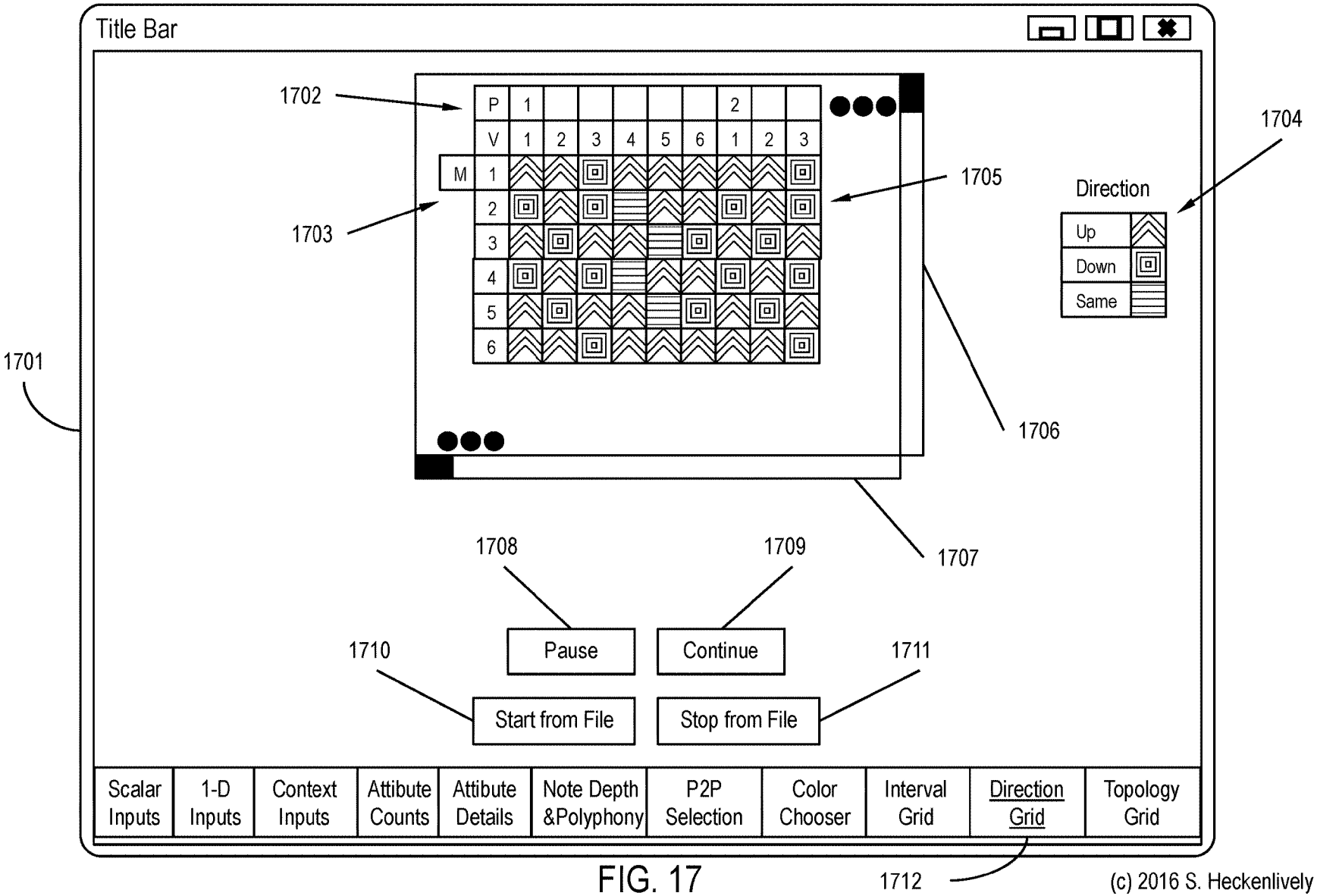
FIG. 17 is an exemplary display screen for analyzing the color-coded direction of musical notes.

If an interval screen start from file 1610 of FIG. 16 has been selected, then the translate notes to display updates 0418 receives data via the read MIDI file 0407 or the read MusicXML file 0408, respectively.

Figure 5:
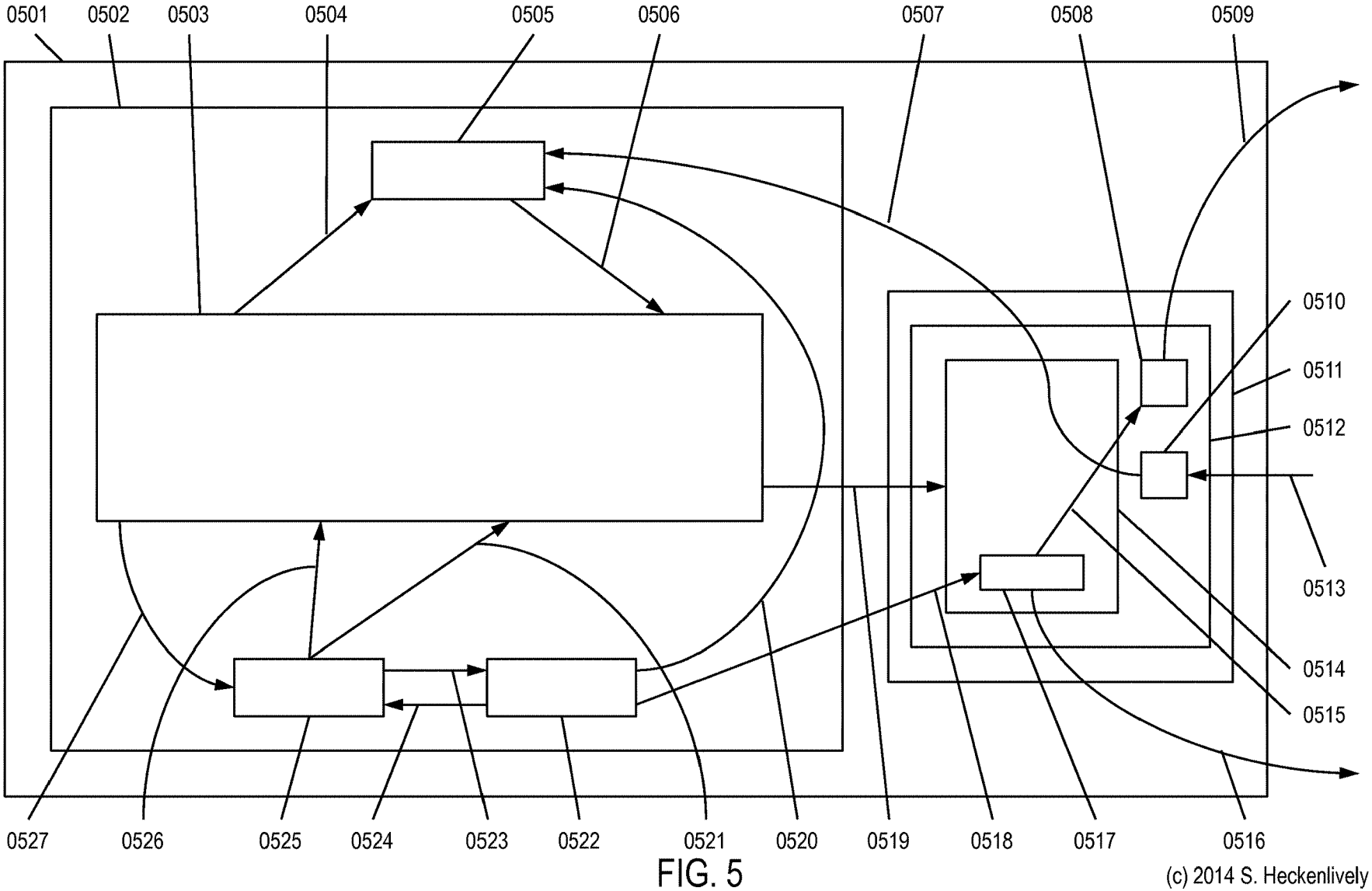
FIG. 05 is a block diagram of the functional elements of the exemplary computing device.

FIG. 05 is a block diagram of the functional elements of the exemplary computing device 0402. The functional elements are described in relation to the data-flows of FIG. 04 above. Off-page lines between FIG. 05 and FIG. 04 are avoided. Instead, FIG. 05 and FIG. 04 are related with the following description.

As background, the VST2/AU standards describe 2 functional partitions for an exemplary plug-in computing device 0501 as an application plug-in, a device editor 0502 and a device effect 0511.

The higher priority thread 0416 executes functionality of the device effect 0511, which receives the MIDI notes from host 0417 as an input note sets from host 0513. In this example, the VST2/AU host application 0401 is included within a first process, which is in turn included within an environment external to a device engine 0522.

In one alternative, the device effect 0511 may receive the read MIDI file 0407, or the read MusicXML file 0408, as input musical data items, specifically second sets of notes, in which case the musical data source may be a data file. A musical data transferring device 0514 may then transfer the second sets of notes to a music analyzing device 0505. In another alternative, the music analyzing device 0505 may be itself a device, and receive sets of notes. These alternatives are not shown, in favor of showing, and describing below, the musical data transferring device 0514 transferring second sets of notes to a data file.

Resuming with FIG. 05, the musical data transferring device 0514 within the device effect 0511 sends one or more first sets of notes to audio 0509 via the send melodies as MIDI notes 0415 to the VST2/AU host application 0401. The VST2/AU host application 0401 may provide a software musical instrument, and may play the notes upon the instrument.

The device effect 0511 is shown containing only an audio processing 0512. Note however that the device effect 0511 also processes other VST2/AU commands from the VST2/AU host application 0401 to the exemplary plug-in computing device 0501, via the higher priority thread 0416.

The lower priority thread 0413 executes updates of a graphical user interface 0503 of the device editor 0502, which receives the update display screens 0419 as an input. The update display screens 0419 includes inputs, via receive input indications 0424, to the graphical user interface 0503. The graphical user interface 0503 transmits one or more first input indications 0527, one or more music analyzing device display parameters 0504, and one or more third input indications 0519. The input-indication sub-elements are not shown, namely first attributes and musical data item/origin/destination, nor the display parameters. The sub-elements are not shown for one or more third output indications 0526, one or more output indications 0506, and one or more second output indications 0521. These indications and display parameters are described in detail below, beginning with FIG. 08.

The device editor 0502 functionally divides between the graphical user interface 0503, the music analyzing device 0505, a device engine 0522, and a device controller 0525. The graphical user interface 0503 provides the first input indications 0527, which includes the first attributes, to the device controller 0525. Given the first attributes, the device controller 0525 provides the second output indications 0521 to the graphical user interface 0503.

Also, given first attributes, the device controller 0525 causes a first criteria to be set 0523 to one or more first conformance evaluating functions, which calculate one or more second attributes of one or more first sets of notes, compare one or more of the second attributes to one or more of the first attributes and return one or more first degrees of conformance, and the device engine 0522 generates one or more first sets of notes to music analyzing device 0520 to the music analyzing device 0505.

Note that in the exemplary plug-in computing device 0501, conformance to first criteria is quantized to a predetermined degree of either true or false. The first conformance evaluating functions are described in more detail in Appendix 01.

The device engine 0522 also generates one or more first sets of notes to musical data transferring device 0518 to an LPT to HPT buffer 0517 within the musical data transferring device 0514. The musical data transferring device 0514 then transfers musical data items, specifically one or more second sets of notes to host 0515, from the LPT to HPT buffer 0517 to a MIDI channel to host 0508, which then transmits one or more first sets of notes to audio 0509 to the host. The musical data transferring device 0514 also transfers one or more second sets of notes to data file 0516 to a data file. In this example, the data file is included within a musical data destination, in an environment external to the device engine 0522.

A MIDI channel for analyzing host 0510 receives one or more note sets from host 0513. The musical data transferring device 0514 then transfers the note sets from host 0513 as one or more host sets to music analyzing device 0507 to the music analyzing device 0505. In this example, the music analyzing device 0505 is a second process included within a musical data destination, in an environment external to the device engine 0522.

The graphical user interface 0503 provides one or more music analyzing device display parameters 0504 to the music analyzing device 0505. The music analyzing device 0505 transmits one or more output indications 0506, specifically calculated correlations, to the graphical user interface 0503. The music analyzing device display parameters 0504 are described in greater detail below, with FIG. 13 thru FIG. 15. The output indications 0506, specifically correlations, are described below with FIG. 16 thru FIG. 21.

The device controller 0525 also receives one or more effects 0524 from the device engine 0522, then transmits the third output indications 0526, which includes the effects 0524, to the graphical user interface 0503.

In another alternative, if a to/from process 0818 of FIG. 08 is selected, the musical data transferring device 0514 writes second sets of notes to a second process, which is in an environment external to the device engine 0522, but which is not in a host/plug-in relationship to the exemplary plug-in computing device 0501. In this aspect, the second process is included within a musical data destination.

Figure 9:
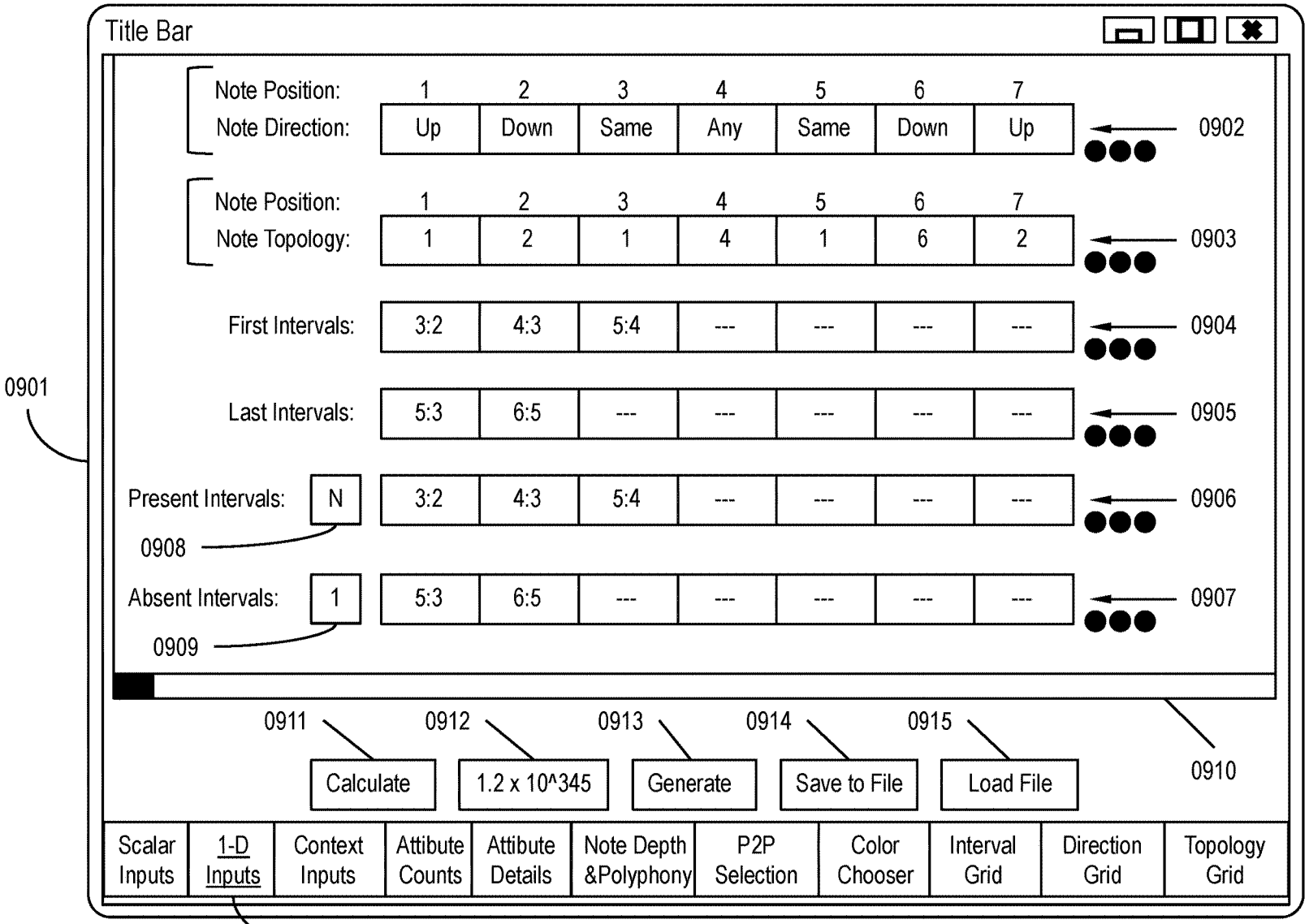
FIG. 09 is an exemplary display screen for first attribute inputs, each consisting of a list of input values.
Figure 10:
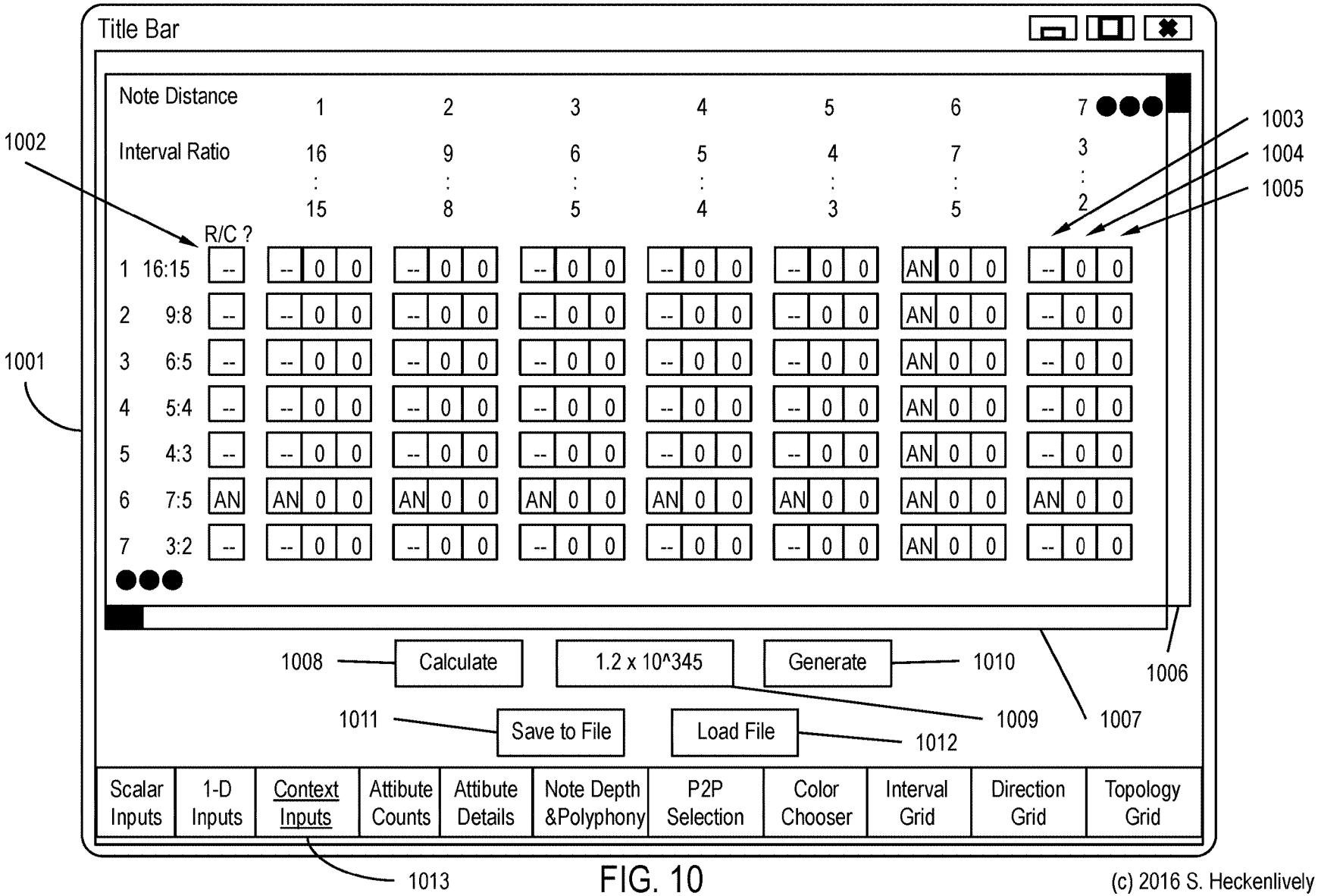
FIG. 10 is an exemplary display screen for first attribute inputs within specific contexts.

The first input indications 0527, specifically first attributes, are described with FIG. 08 thru FIG. 10. The second output indications 0521, specifically a count of first sets of notes, are described with FIG. 08. The third output indications 0526, specifically effects of the first attributes, are described with FIG. 11 thru FIG. 12. The device controller 0525 and device engine 0522 are described in more detail in Appendix 02.

In the exemplary plug-in computing device 0501, MIDI channels are allocated/deallocated as needed in cooperation with the VST2/AU host application 0401 of FIG. 04. Allocation/deallocation arises from, for example, the use of the music analyzing device 0505. Also in the exemplary plug-in computing device 0501, per the VST2/AU interface standards, the VST2/AU host application 0401 is allowed to load, initialize, and execute the exemplary plug-in computing device 0501. Loading of the exemplary plug-in computing device 0501 by the VST2/AU host application 0401 is described in more detail in Appendix 03.

As background, the VST2 and AU APIs are written in C++, with the intent they be used via class derivations. Therefore the exemplary plug-in computing device 0501 is written in C++. Examples of some of the class derivations made by the exemplary plug-in computing device 0501 are shown in Appendix 04.

Figure 6:
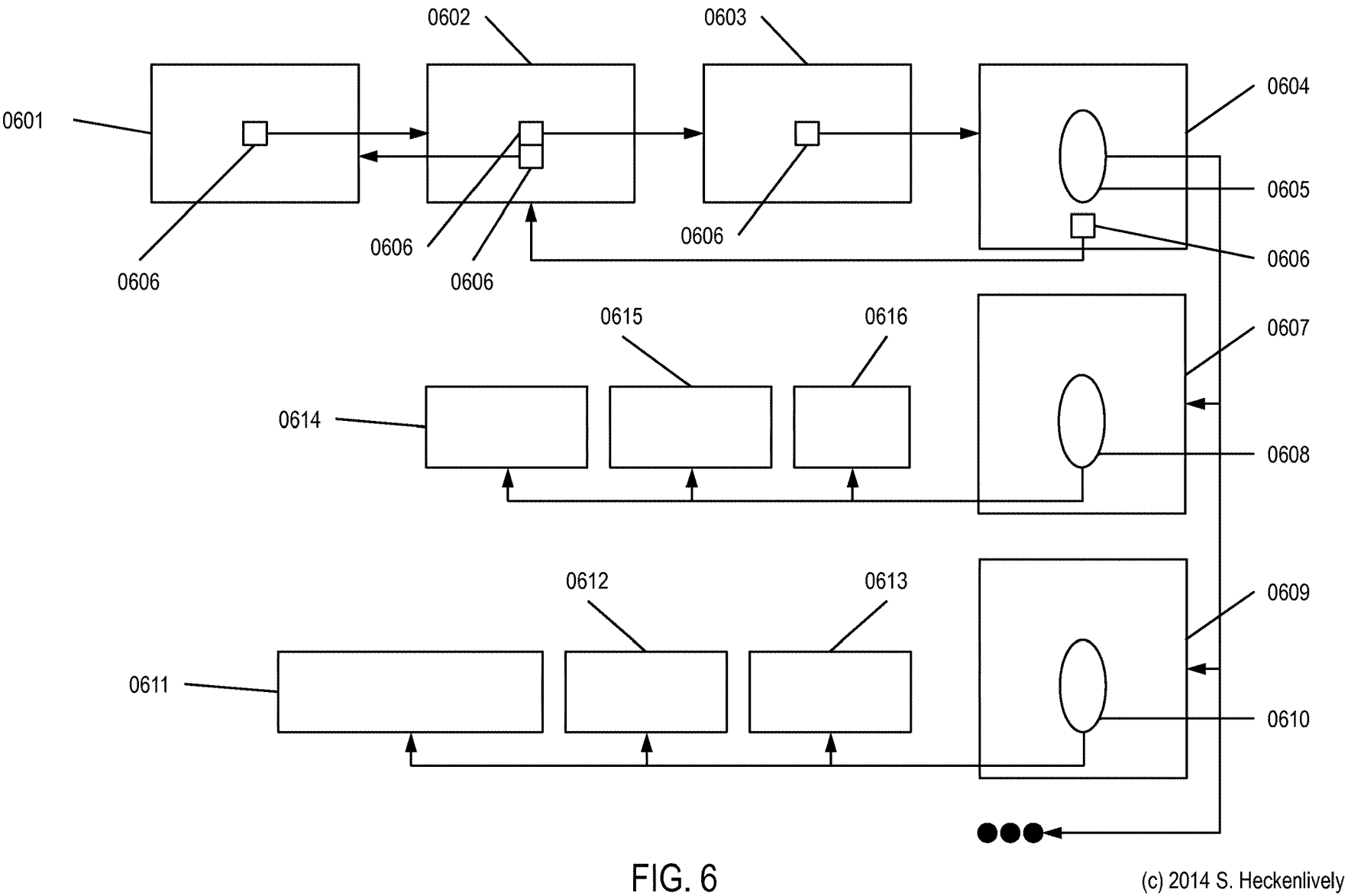
FIG. 06 is a block diagram of C++ objects for 2 exemplary display screens relating to higher-level objects and to lower-level objects.

FIG. 06 is a block diagram of C++ objects for two display screens of the exemplary plug-in computing device 0501, scalar first attribute inputs, and interval music analyzing device grid, relating to higher-level objects and lower-level objects. These screens are described below with FIG. 08 and FIG. 16, respectively. Lines correspond to C++ pointers, either individual or grouped. Individual pointers have a square origin. Grouped pointers have an oval origin. As described above, the exemplary plug-in computing device 0501 includes a plug-in effect 0601 and a plug-in editor 0602.

The plug-in effect 0601 contains an individual pointer 0606 to the plug-in editor 0602. The plug-in editor 0602 contains two individual pointer 0606's, one to an editor frame 0603, and one back to the plug-in effect 0601. The editor frame 0603 contains an individual pointer 0606 to a container of screens 0604.

The container of screens 0604 contains a group of pointers to screens 0605, which point to a scalar first attributes screen 0607, an interval music analyzing device grid screen 0609, and other screens appearing in FIG. 08 thru FIG. 21, as indicated by the ellipsis. The scalar first attributes screen 0607 contains a group of pointers to scalar first attributes components 0608, which point to:

one or more text input boxes 0614,
one or more spin controls 0615, and
one or more buttons 0616.

The interval music analyzing device grid screen 0609 contains a group of pointers to interval music analyzing device grid components 0610, which point to:

one or more graphic objects 0611,
one or more cell information buttons 0612, and
one or more cell information popup screens 0613.

As background, the exemplary plug-in computing device 0501 uses VSTGUI, created by, and a copyright of, Steinberg Gmbh, as its display screen toolkit/API, and to run on both Microsoft and Apple systems. Creation and use of two exemplary display screen components, note depth in time 1302 and composition polyphony 1303, is described in more detail in Appendix 05.

Figure 7:
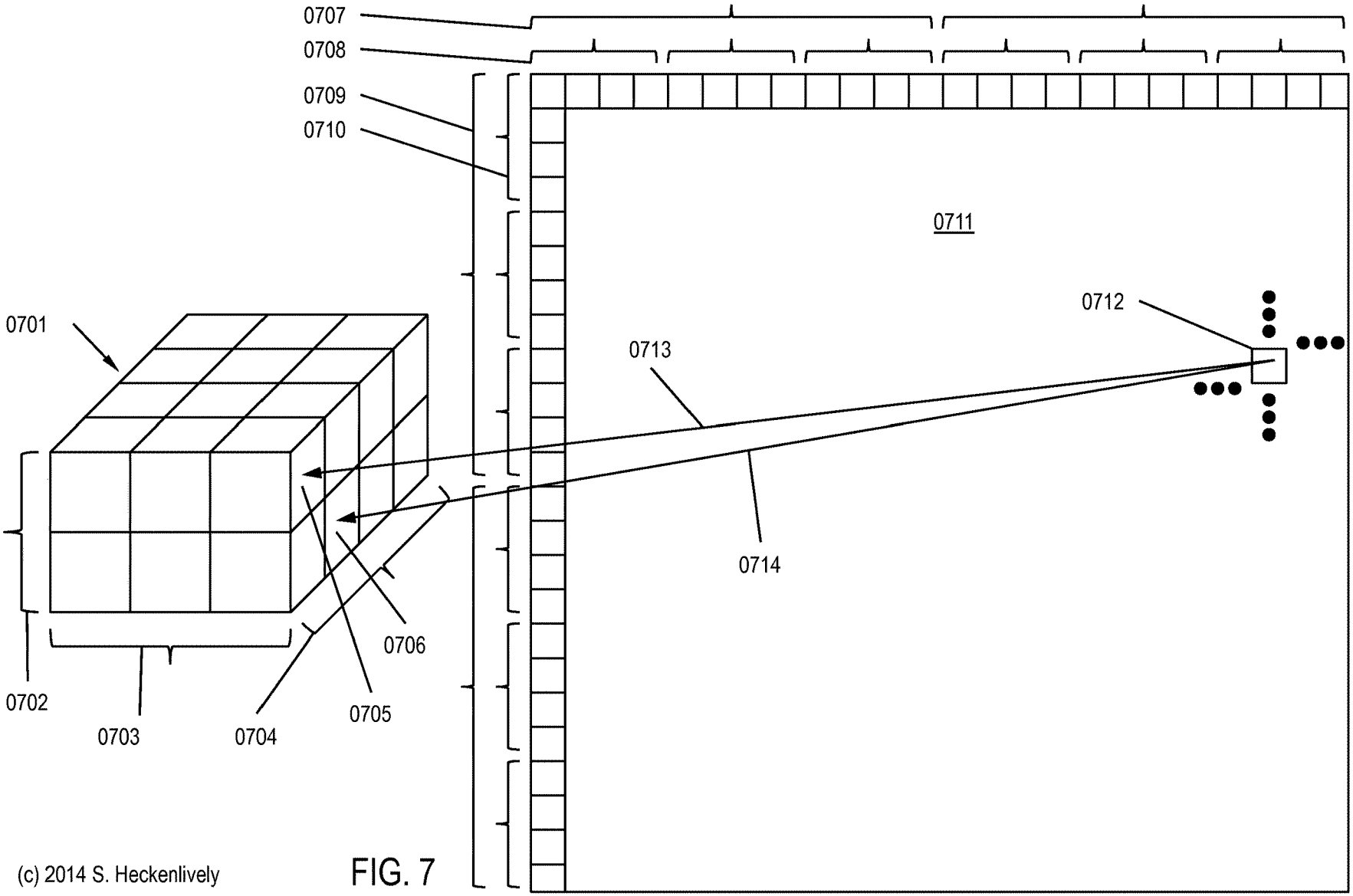
FIG. 07 is a block diagram of the relationship between two exemplary data structures, Note Space and Display Space, with exemplary values.

FIG. 07 is a block diagram of the relationship between a note space data structure 0701 and a display space data structure 0711 of the exemplary plug-in computing device 0501, with exemplary values. These data structures and their relationship apply to the display screens seen in FIG. 16, FIG. 17, and FIG. 18.

When analysis is being performed, note information (not shown) enters the note space data structure 0701. Visual information on the computer display (not shown) comes from the display space data structure 0711. The note space data structure 0701 is a 3-dimensional data structure whose cardinal dimensions are:

a note space part 0702,
a note space voice 0703, and
a note space note depth count 0704.

Figure 13:
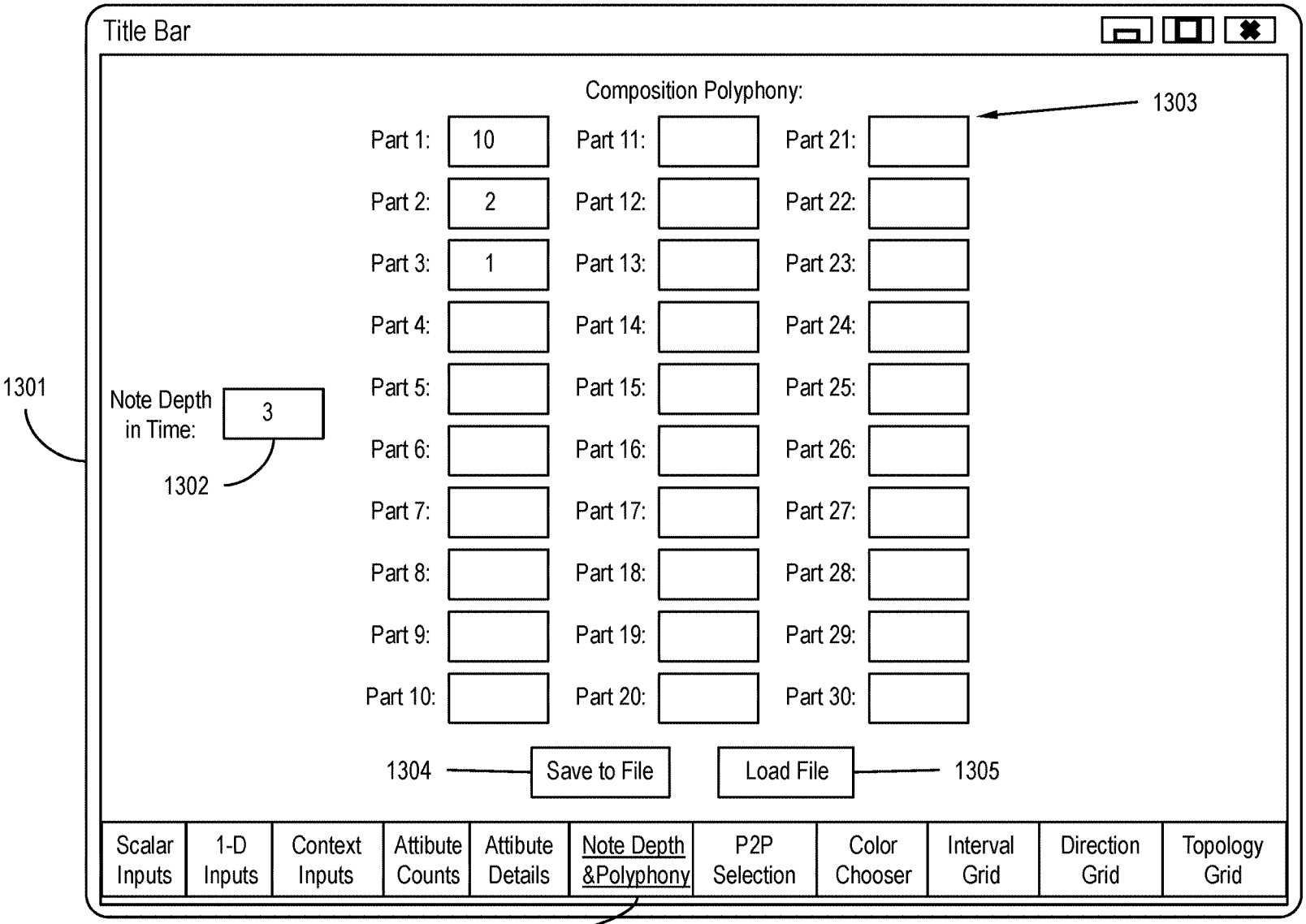
FIG. 13 is an exemplary display screen for inputs describing aspects of the composition to be analyzed.

The size of each dimension is determined by the values entered for a note depth in time 1302 and a composition polyphony 1303 of FIG. 13. In FIG. 07, the exemplary values are:

the composition polyphony 1303, 2 parts, numbered 1 and 2;
the composition polyphony 1303, parts 1 and 2 both having 3-voice polyphony; and
the note depth in time 1302 of 4.

An example note space cell one 0705 is located at coordinates [part 1, voice 3, note depth in time 1]. Another example note space cell two 0706 is located at coordinates [part 2, voice 3, note depth in time 2].

The display space data structure 0711 is a 2 dimensional data structure whose cardinal dimensions are associated with the Cartesian square of the unrolled cells in Note Space. In this example, unrolling means the following. The note space data structure 0701 has 3 dimensions:

a part, of 2 cells in this example,
a voice, of 3 cells in this example, and
a note depth in time, of 4 cells in this example.

The rows and columns of the display space data structure 0711, in this example, have 1 dimension of 24 cells: 2 parts×3 voices×4 note depths in time. The grid of rows and columns in the display space data structure 0711 constitute the Cartesian square. Only the leftmost cells, topmost cells, and a example display space cell 0712, of display space data structure 0711 are shown. However it should be understood that the display space data structure 0711 is fully populated with cells, 24×24=576, in this example. Ellipses indicate full population with cells.

A group of display space vertical part regions 0707 shows the column-regions in the display space data structure 0711 for each of the 2 parts in this example. A group of display space vertical voice regions 0708 shows the column-regions in the display space data structure 0711 for each of the 3 voices of each part in this example. A group of display space horizontal part regions 0709 shows the row-regions in the display space data structure 0711 for each of the 2 parts in this example. A group of display space horizontal voice regions 0710 shows the row-regions in the display space data structure 0711 for each of the 3 voices of each part in this example.

The example display space cell 0712 shows the mapping of one cell of the display space data structure 0711 onto the note space data structure 0701. The example display space cell 0712 is located at row [part 1, voice 3, note depth in time 1] and column [part 2, voice 3, note depth in time 2]. It contains 2 links to cells in the note space data structure 0701. A row link 0713 links the example display space cell 0712 to the example note space cell one 0705, at the corresponding coordinates of [part 1, voice 3, note depth in time 1]. A column link 0714 links the example display space cell 0712 to the example note space cell two 0706, at the corresponding coordinates of [part 2, voice 3, note depth in time 2].

Given the note information in the example note space cell one 0705 and the example note space cell two 0706, visual information on the computer display may be calculated for the example display space cell 0712. The display information is calculated by the music analyzing device 0505, of FIG. 05, for the display screens of FIG. 16 thru FIG. 21.

The note information in the example note space cell one 0705, and the example note space cell two 0706, changes dynamically during analysis. However, the row link 0713 and the column link 0714 in Display Space are established once, then remain unchanged during analysis. Visual information on the computer display is updated, via re-calculation by the music analyzing device 0505 of FIG. 05, per changing note information in Note Space. The visual changes, included within output indications, occur in near-synchrony with time progression of the audio. As used herein, the phrase "near-synchrony" means in synchrony except for processing delays which are very small relative to temporal events in the audio.

FIG. 08 is an exemplary display screen for input of first attributes and generated first set of notes characteristics, each consisting of a single value. A first attribute affects the generation of melodies, while a characteristic affects presentation aspects of the generated melodies. Scalar first attribute inputs are included within first input indications. This figure also contains functional controls which have equivalencies on other figures. Each part of FIG. 08 is noted below as a first attribute, a characteristic, or a control.

Unless stated otherwise, each display component shown in FIG. 08 thru FIG. 21 functions independently of the others. Unless stated otherwise, input and output values shown in FIG. 08 thru FIG. 21 are only for illustrating that respective figure.

A scalar first attributes frame 0801 is the frame for this display screen. It is labeled with a title bar in the upper-left corner, and has standard (Microsoft Windows or Apple) buttons in the upper right corner to minimize, maximize, or exit this display screen. This provides functional control.

A starting note of a set of notes 0802 is the text input, e.g. C4, for the starting note of a set of notes of the generated melodies. This is a first attribute for the generation of melodies. The default value is C4.

A size of a set of notes 0803 is the numeric input of the number of notes, e.g. 5, 6, 7, etc. for the generated melodies. This is a first attribute. The default value is 6.

A maximum distance of a set of notes 0804 is the numeric input of the maximum note distance, e.g. 5 notes, 6 notes, 7 notes, etc. within the generated melodies. This is a first attribute. The default value is 12. Maximum distance of a set of notes is relative to the prior generated note, and refers to the musical scale position of the generated Note[i] relative to Note[i−1]. For example, on the chromatic scale of a piano, the distance of a set of notes between generated notes C4 and G4 is 7.

The first attribute which includes the range of a set of notes is embodied by two elements in FIG. 08, a lowest note 0805 and a highest note 0806. Both are spin-control inputs, e.g. C0-C8, etc., for notes within the generated melodies. The default values are C3 for the lowest note, and C5 for the highest note. These 2 input values may be chosen relative to a specific instrument, e.g. piano.

A note length 0807 is the spin-control input, e.g. ¼, ½, 1, etc. for the length of individual notes within the generated melodies. This is a characteristic of the generated melodies. The default value is ¼.

A rest length 0808 is the spin-control input, e.g. 0, ¼, ½, 1, etc. for the length of individual rests between notes of the generated melodies. This is a characteristic. The default value is 0.

A note velocity 0809 is the numeric input of the MIDI value, e.g 0-255, of the velocity (i.e. audio volume) of individual notes within the generated melodies. This is a characteristic. The default value is 127.

A space between melodies 0810 is the numeric input of the number of seconds, e.g. 3, 4, 5, etc. between generated melodies. This is a characteristic. The default value is 5.

A note length variability 0811 is the pulldown menu input, e.g. 0%-10%, of the degree of randomness in the length of individual notes in the generated melodies. This is a characteristic. The default value is 0%.

A rest length variability 0812 is the pulldown menu input, e.g. 0%-10%, of the degree of randomness in the length of individual rests in the generated melodies. This is a characteristic. The default value is 0%.

A velocity variability 0813 is the pulldown menu input, e.g. 0%-10%, of the degree of randomness in the audio volume of individual note velocities in the generated melodies. This is a characteristic. The default value is 0%.

A to/from host 0814 is the Yes/No toggle-button to route the generated melodies to/from the host. This is a control. The default value is Y.

An output to MIDI file 0815 is the Yes/No toggle-button to route the generated melodies to a MIDI file. This opens a standard OS-level (e.g. Microsoft, Apple) file-save dialog. This is a control. The default value is N.

An output to XML file 0816 is the Yes/No toggle-button to route the generated melodies to an XML file. This opens a standard OS-level (e.g. Microsoft, Apple) file-save dialog. This is a control. The default value is N.

An output to music analyzing device grids 0817 is the Yes/No toggle-button to route the generated melodies to the music analyzing device grids. This is a control. The default value is N.

A to/from process 0818 is the Yes/No toggle-button to route the generated melodies to/from a process included within an environment external to the device engine 0522 of FIG. 05. This opens a process-identification dialog. This is a control. The default value is N.

A scalar screen calculate 0819 is the button to calculate the number of melodies which may be generated. This is a control.

A scalar screen calculated 0820 is the output field to display the calculated count of first sets of notes conforming to the first attributes, which is included within the second output indications 0521 of FIG. 05. The count is calculated by the controller upon activation of the scalar screen calculate 0819, a control, and is transmitted to the scalar screen calculated 0820. Note the functional dependency between the scalar screen calculate 0819 and the scalar screen calculated 0820.

A scalar screen generate 0821 is the button to generate the melodies. This is a control.

A scalar screen save to file 0822 is the button to save all current user inputs to a disk file. This opens a standard OS-level (e.g. Microsoft, Apple) file-save dialog, which allows a third input indication, specifically a data file. This is a control.

A scalar screen load file 0823 is the button to load all user inputs from a disk file. This opens a standard OS-level (e.g. Microsoft, Apple) file-load dialog, which allows a third input indication, specifically a data file. This is a control.

A scalar screen selector 0824 is the button to select the scalar first attribute inputs and Generated Melody Characteristics display screen. Underlining indicates the current screen. This is a control. The default display screen is scalar first attribute inputs.

FIG. 09 is an exemplary display screen for a second type of first attributes, which are 1 dimensional. 1-D first attribute inputs included within first input indications. Each first attribute is a list of input values used in the generation of melodies. Note that each list is shown with an ellipsis on the right side, indicating each extends according to the size of a set of notes 0803 of FIG. 08.

A 1-D first attributes frame 0901 is the frame for this display screen. It is labeled with a title bar in the upper-left corner, and has standard (Microsoft Windows or Apple) buttons in the upper right corner to minimize, maximize, or exit this display screen.

A note directions 0902 is a list of direction pulldown menus, each e.g. Up, Down, Same, Any. Direction is relative to the prior note: Up, Down, Same, or Any. Up, Down, and Same refer to the audio frequency of Note[i] relative to Note[i−1]. Up and Down have the effect, on average, of approximately halving the number of possibilities at each of positions 2 thru N in the generated melodies. The direction called "Same" is a special case, meaning "Repeat Note[i−1]", resulting in reduction in the number of generated melodies. "Any" is not a note direction per se, rather it allows the tailoring this first attribute to specific note positions.

A note topology 0903 is a list of numeric topology inputs, each e.g. Any, 1, 2, 3, etc. Each topology input is a label for Note[i]:

If Note[i] has not previously appeared in this first set of notes, its label is the note's position in the sequence, i.e the sequence value of i.

If Note[i] has previously appeared in this first set of notes, the label is the sequence position of the note's first occurrence.

So for example, "C4 G4 D4# C4 G3 C3" is labelled as "1 2 3 1 5 6". "Any" is not a note label per se, rather it allows the tailoring this first attribute to specific note positions.

Note topology has 2 useful properties. First, it allows a highly selective degree of control on the actual notes of the generated melodies. E.g. the topology "1 2 3 4 5 6" allows all notes, so long as none repeats. The topology "1 1 1 1 1 1" allows any note, so long as it repeats 6 times. Each time a repeat is specified, a reduction (e.g 88-to-1 for the full range of a piano) occurs at that position in the number of generated melodies.

Second, note topology allows the specification of melodies which have a movement, from note to note, consistent with the expressive intent. This movement is a topological path. If a specified path has no cycles, it is a simple line, i.e. linear. But a path may also be specified with complex cycles, i.e. returns to familiar notes, and such a path may be artistically expressive.

Figure 22:
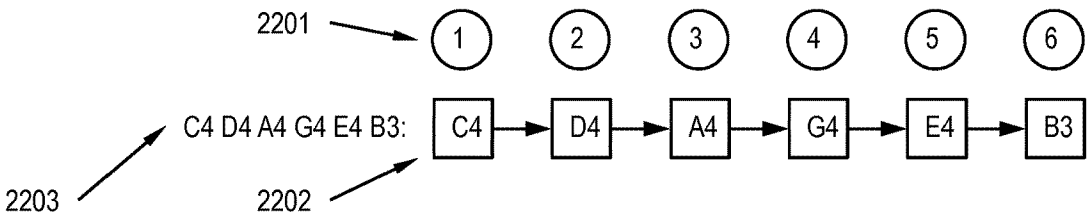
FIG. 22 is a block diagram of an example of a simple, linear, note topology.
Figure 23:
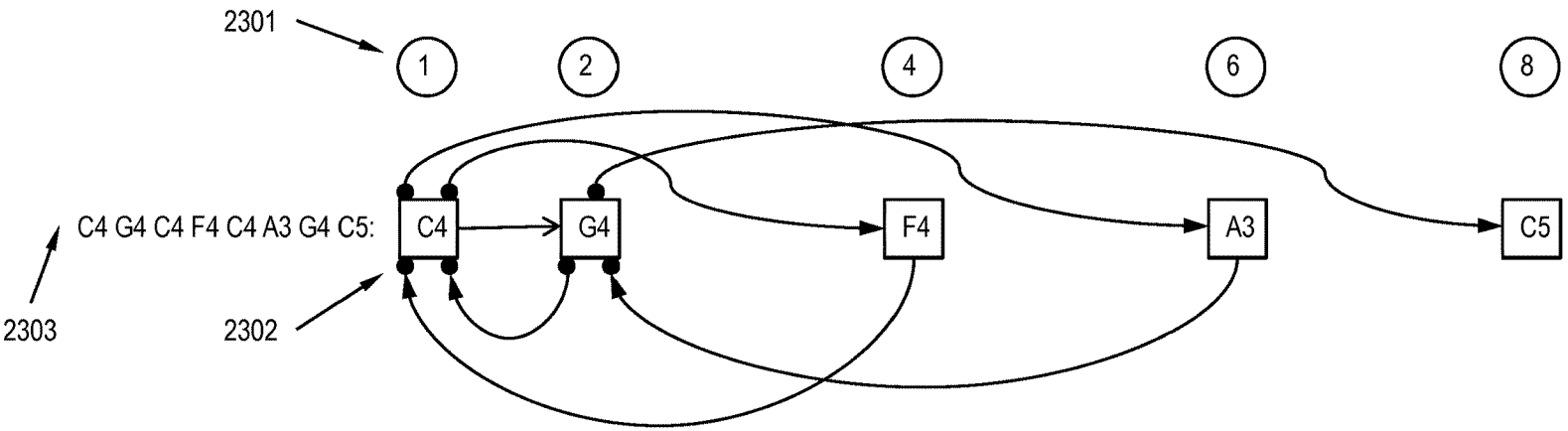
FIG. 23 is a block diagram of an example of a complex, cyclical, note topology.

To illustrate, refer to FIG. 22 and FIG. 23. A group of linear note labels 2201 shows the labeling for the linear topology of "1 2 3 4 5 6". A linear note topology 2202 shows one sequence of qualifying notes, a sequence linear input notes 2203: "C4 D4 A4 G4 E4 B3". A group of cyclical topology labels 2301 show the labeling for a cyclical topology of "1 21 41 6 2 8". A cyclical note topology 2302 shows one sequence of qualifying notes, a sequence of cyclical input notes 2303: "C4 G4 C4 F4 C4 A3 G4 C5".

Returning now to FIG. 09 a list of initial musical intervals 0904 is pulldown menus for acceptable initial intervals, each menu e.g. Any, 2:1, 3:2, 4:3 etc. A list of final musical intervals 0905 is pulldown menus for acceptable final intervals, each menu e.g. Any, 2:1, 3:2, 4:3 etc. A list of present musical intervals 0906 is pulldown menus for intervals which must be present, each e.g. Any, 2:1, 3:2, 4:3 etc. A list of absent musical intervals 0907 is pulldown menus for intervals which must be absent, each e.g. Any, 2:1, 3:2, 4:3 etc. The default value for note directions 0902 thru absent musical intervals 0907 is "--", no first attribute. An order present intervals 0908 is a Yes/No toggle button for ordering of present intervals. The default value is No.

A note depth in time for absent intervals 0909 is a numeric input for the depth of note depth in time applicable for absent intervals, e.g. 1 note, 2 notes, 3 notes, etc. I.e. this is the span of past-time over which the absent musical intervals 0907 are first attributes. The default value of 1 corresponds to a common reference to intervals as being between adjacent notes.

A 1-D horizontal scrollbar 0910 enables the use of first attribute lists which are longer than the 1-D first attributes frame 0901, i.e. lists extending according to the size of a set of notes 0803 of FIG. 08.

Note the following functional equivalencies:

A 1-D screen calculate 0911 is functionally equivalent to the scalar screen calculate 0819.

A 1-D screen calculated 0912 is functionally equivalent to the scalar screen calculated 0820.

A 1-D screen generate 0913 is functionally equivalent to the scalar screen generate 0821.

A 1-D screen save to file 0914 is functionally equivalent to the scalar screen save to file 0822.

A 1-D screen load file 0915 is functionally equivalent to the scalar screen load file 0823.

A 1-D screen selector 0916 is the button to select the 1-D first attribute inputs display screen.

FIG. 10 is an exemplary display screen for a third type of first attributes, which are 2 dimensional. 2-D first attribute inputs are included within first input indications. This type of first attribute provides the ability to specify sets of intervals which must be present or absent. I.e. it provides control according to the perception of multiple intervals, via echoic memory. In this example, interval sets include 3 intervals, the first two intervals adjacent.

This type of first attribute input is structured as a 2 dimensional Cartesian square of intervals. User inputs are provided At each intersection between 2 intervals, e.g. row 11:10 and column 7:6. Ordering is by row, then column, e.g. row 11:10, column 7:6 specifies 11:10 followed by 7:6 in the generated melodies. Entries on the diagonal from upper-left to lower-right refer to a set of consecutive intervals, each having the same value.

Note that ellipses are shown on the right side and bottom, indicating each extends according to the 11 intervals (discounting 1:1) which exist in one octave of 12 notes.

A context first attributes frame 1001 is the frame for this display screen. It is labeled with a title bar in the upper-left corner, and has standard (Microsoft Windows or Apple) buttons in the upper right corner to minimize, maximize, or exit this display screen.

The sets of present musical intervals and the sets of absent musical intervals are included within an interval set presence/absence 1003. This is a pulldown menu for each interval set, each menu offering the following options:

PM: Present, <Interval 3a>.

PC: Present, <Interval 3b>.

PE: Present-Either <Interval 3a> or <Interval 3b>.

PB: Present-Both <Interval 3a> and <Interval 3b>.

AM: Absent, <Interval 3a>.

AC: Absent, <Interval 3b>.

AE: Absent-Either <Interval 3a> or <Interval 3b>.

AN: Absent-Neither <Interval 3a> nor <Interval 3b>.

--: No first attribute. The default value is "--", no first attribute.

For each pulldown menu, <Interval 3a> and <Interval 3b> are replaced with the 2 possible third intervals for the menu's interval set. I.e. if the row interval is formed by Note2:Note1, and the column interval is formed by Note3:Note2, then <Interval 3a> and <Interval 3b> are formed by the 2 possible values of Note3:Note1. For example, if the interval set is row 3:2, column 5:4, then <Interval 3a> is replaced with 6:5 and <Interval 3b> is replaced with 7:4.

To understand why <Interval 3a> and <Interval 3b> are two distinct values, consider the following. The 2 intervals 3:2 and 5:4 are formed by 3 notes N1, N2, and N3. For the interval 3:2, the distance between N1 and N2 is either +7 notes or −7 notes. For the interval 5:4, the distance between N2 and N3 is either +4 notes or −4 notes. Therefore the distance between N1 and N3, i.e. the third interval, may be either +/−3 notes (7−4), or +/−11 notes (7+4). If the distance is 3 notes, the third interval is 6:5. If the distance is 11 notes, the third interval is 7:4.

Within the pulldown menu of interval set presence/absence 1003, the <Interval 3a> is replaced with the nearer interval, e.g. 6:5=3 notes distance. The <Interval 3b> is replaced with the farther interval, e.g. 7:4=11 notes distance. We refer to these as "interval-triplets", e.g. (3:2, 5:4, 6:5) and (3:2, 5:4, 7:4).

An RC presence/absence 1002 is a group of pulldown menus, one for each interval-row, each menu applying to all interval sets for that interval. Note this includes all interval sets on that interval's row, plus all interval sets on that interval's column. Each applicable interval set has its Presence/Absence set to match, but its Position (described below) retains any previous setting, unchanged. For values of this pulldown, see the interval set presence/absence 1003 above. The default value is "--", no first attribute.

Within the pulldown menu of the RC presence/absence 1002, <Interval 3a> is replaced with the text "nearer interval", and <Interval 3b> is replaced with the text "farther interval". For each affected interval set on that interval's row and column, Presence/Absence is set with its appropriate specific nearest or farthest interval.

A nearer set positions 1004 is the numeric input of one or more positions for the nearer interval-triplet within the generated melodies. E.g. if:

The interval-triplet is row 3:2, column 4:3; and . . .

Present 9:8, i.e. the nearer <Interval 3a>, is selected; and . . .

the nearer set positions 1004 is set to 1;

Then:

3:2 is the first interval in the first set of notes; and . . .

4:3 is the second interval in the first set of notes.

If the triplet's position is not of interest, then the nearer set positions 1004 may be set to 0. The default value is 0. A farther set positions 1005 is the numeric input of one or more positions for the farther interval-triplet within the generated melodies.

A context vertical scrollbar 1006 and a context horizontal scrollbar 1007 enable the use of interval sets which are longer than the context first attributes frame 1001, i.e. the use of sets for all 11 intervals (discounting 1:1) present in one octave of 12 notes.

Note the following functional equivalencies:

A context screen calculate 1008 is functionally equivalent to the scalar screen calculate 0819.

A context screen calculated 1009 is functionally equivalent to the scalar screen calculated 0820.

A context screen generate 1010 is functionally equivalent to the scalar screen generate 0821.

A context screen save to file 1011 is functionally equivalent to the scalar screen save to file 0822.

A context screen load file 1012 is functionally equivalent to the scalar screen load file 0823.

A context screen selector 1013 is the button to select the present/absent context-sensitive interval first attribute inputs display screen.

Figure 11:
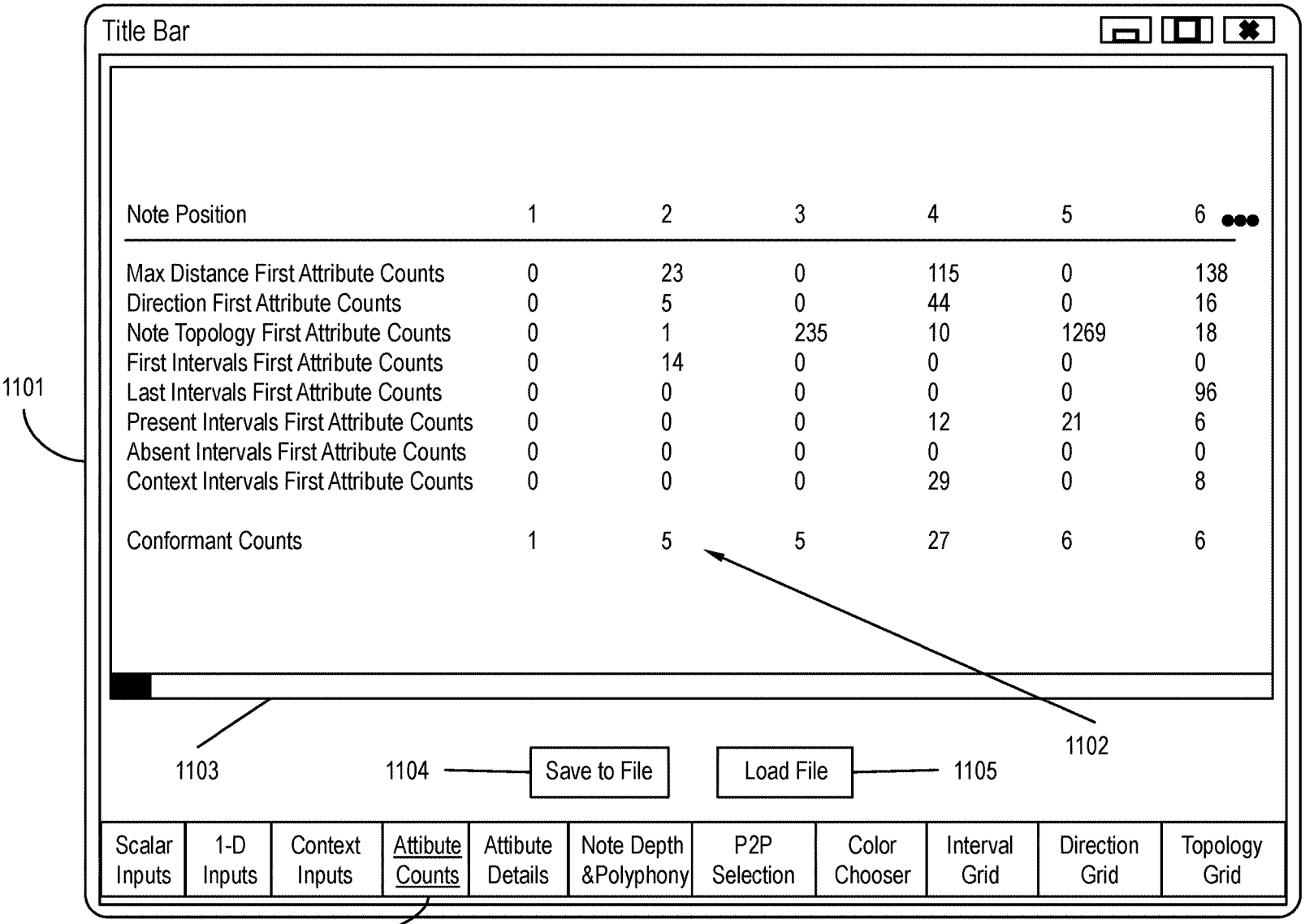
FIG. 11 is an exemplary display screen for summary third output regarding the effect of the various first attributes.

FIG. 11 is an exemplary display screen for the first form of third output regarding the effect of the various first attributes. Note that an ellipsis is shown on the right side, indicating that each row extends according to the size of a set of notes 0803 of FIG. 08.

A first attribute count output frame 1101 is the frame for this display screen. It is labeled with a title bar in the upper-left corner, and has standard (Microsoft Windows or Apple) buttons in the upper right corner to minimize, maximize, or exit this display screen.

A multiple of statistic indications 1102 includes two kinds of counts. The first kind is the count of non-conformant melodies, at each note position, for each first attribute. The second kind is a count of melodies, at each note position, which conformed to all first attributes thereat. The statistic indications 1102 is an example of third output indications, specifically effects. Counts for the effect of each element of the set of first attributes provide the basis for modifying the first attributes. These modifications may be iterated upon to bring the results into an acceptable range.

A count horizontal scrollbar 1103 enables the output of rows which are longer than the first attribute count output frame 1101, i.e. rows extending according to the size of a set of notes 0803 of FIG. 08.

Note the following functional equivalencies:

A count screen save to file 1104 is functionally equivalent to the scalar screen save to file 0822.

A count screen load file 1105 is functionally equivalent to the scalar screen load file 0823.

A count screen selector 1106 is the button to select the first attribute count output display screen.

Figure 12:
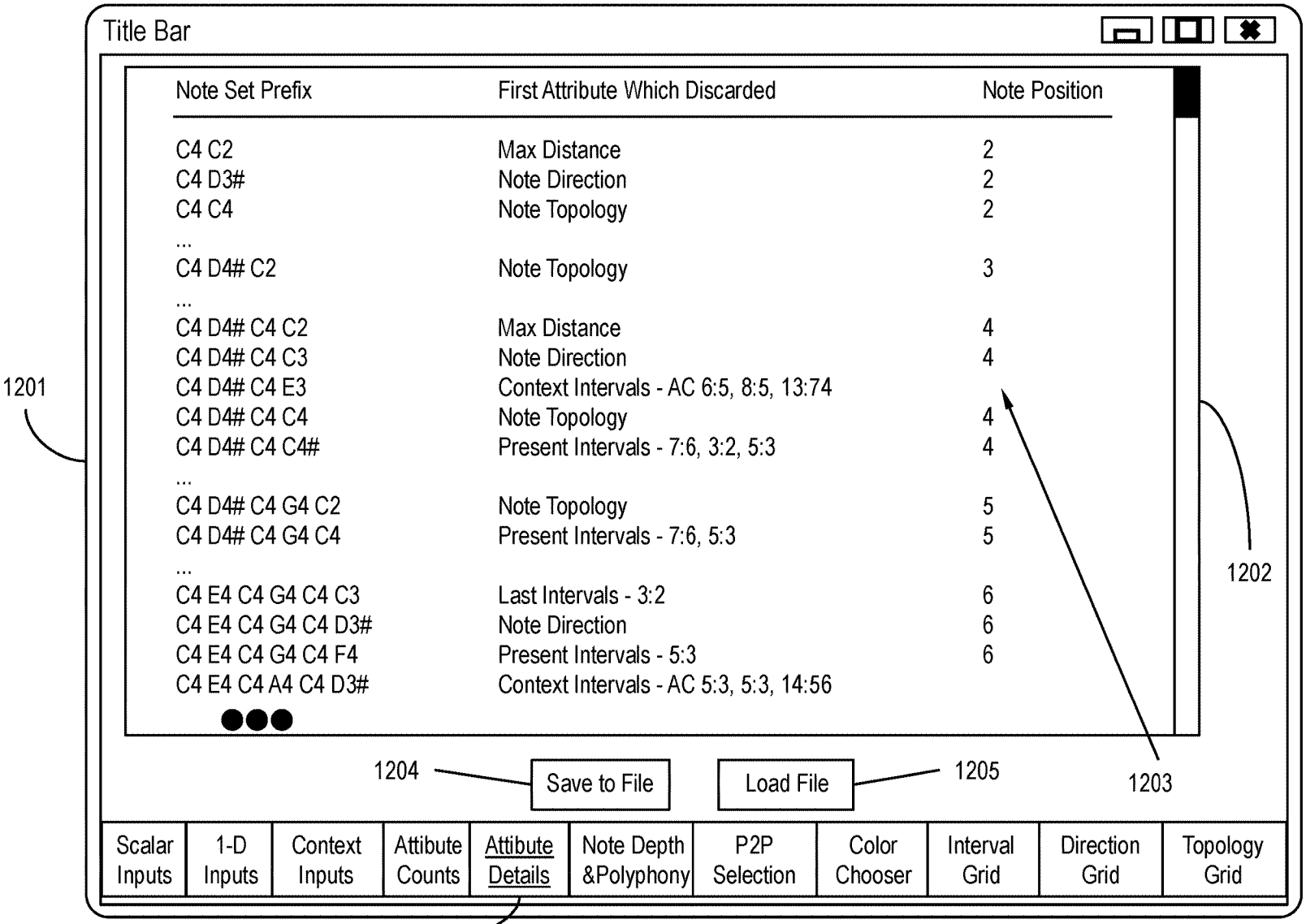
FIG. 12 is an exemplary display screen for detailed third output regarding the effect of the various first attributes.

FIG. 12 is an exemplary display screen for the second form of third output regarding the effect of the various first attributes. Note that an ellipsis is shown on the bottom, indicating that the text extends as necessary to show the effect of all first attributes.

A first attribute detail output frame 1201 is the frame for this display screen. It is labeled with a title bar in the upper-left corner, and has standard (Microsoft Windows or Apple) buttons in the upper right corner to minimize, maximize, or exit this display screen.

A detail horizontal scrollbar 1202 enables third output which is longer than the first attribute detail output frame 1201, i.e. the effect of all first attributes of FIG. 08.

A multiple of note set indications 1203 shows each discarded note sequence prefix, the first attribute which the sequence prefix did not meet, and the note position at which the discard occurred. The note set indications 1203 is an example of third output indications, specifically effects.

When a note at a specific position is explicitly discarded by a first attribute, all potential melodies to the right of that note are implicitly discarded. Implicit discards multiply combinatorially, and may be too numerous to describe individually. Explicit discards are simply the list of notes up to the note at which a first attribute was not met, and may be less than the number of implicit discards. Explicit discards are described individually.

Attribute detail output gives a qualitative assessment of the effect of each first attribute specified. For example, if an expected first set of notes has been discarded, the discarded first set of notes's note sequence prefix may be found, and a specific first attribute identified which resulted in discarding that first set of notes.

Note the following functional equivalencies:

A detail screen save to file 1204 is functionally equivalent to the scalar screen save to file 0822.

A detail screen load file 1205 is functionally equivalent to the scalar screen load file 0823.

A detail screen selector 1206 is the button to select the first attribute detail output display screen.

FIG. 13 is an exemplary display screen for the input of note depth in time and composition polyphony. These inputs are music analyzing device display parameters, and affect three types of music analyzing display screen (seen below), interval, direction, and topology. Specifically, the parameters are aspects of the composition to be analyzed. As noted in the Background section, this composition may extend beyond melody to aspects of harmony, rhythm, multi-instrument arrangement, etc.

A note depth in time and composition polyphony frame 1301 is the frame for this display screen. It is labeled with a title bar in the upper-left corner, and has standard (Microsoft Windows or Apple) buttons in the upper right corner to minimize, maximize, or exit this display screen.

A note depth in time 1302 is the pulldown menu input, e.g. 1 note, 2 notes, 3 notes, etc, for the depth of note depth in time. I.e. note depth in time 1302 is the span of past-time over which analysis is to be performed. The default value is 1.

A composition polyphony 1303 is structured as multiple columns of pulldown menu inputs, one menu for each musical part in the composition. The number of parts shown, 30, is suitable for compositions of size up to orchestral. Part label numbers denote the MIDI track number for that part. Each pulldown describes the degree of polyphony, e.g. 1 voice, 2 voice 3 voice, etc. A piano may be described as 10 voice, because each of 10 fingers is capable of striking a key, and each key may sound independently of the others. 0 voice indicates the part is not analyzed. The default value for all menus is 0.

Note the following functional equivalencies:

A polyphony screen save to file 1304 is functionally equivalent to the scalar screen save to file 0822.

A polyphony screen load file 1305 is functionally equivalent to the scalar screen load file 0823.

A polyphony screen selector 1306 is the button to select the note depth in time and composition polyphony inputs display screen.

Figure 14:
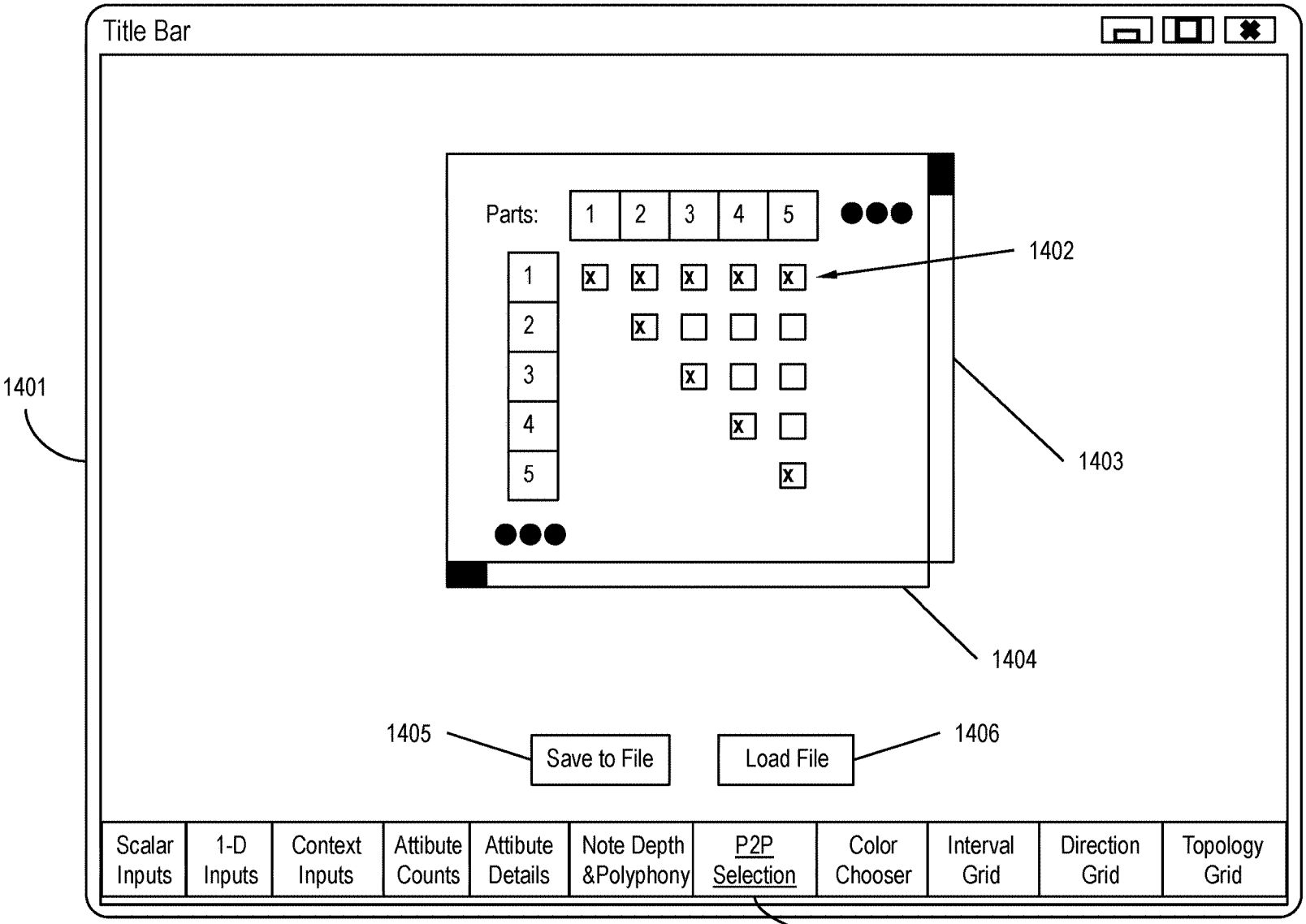
FIG. 14 is an exemplary display screen for the selection of musical parts within the composition to be analyzed.

FIG. 14 is an exemplary display screen for the selection of specific combinations of musical parts for analyzing. Like the inputs of FIG. 13, these inputs are music analyzing device display parameters, and apply to three types of music analyzing display screen (seen below), interval, direction, and topology. For interval analysis, only the selected combinations (pairs) of parts are analyzed. For direction and topology analysis, all parts (individual) which are members of a selected combination are analyzed.

Selections are structured as a 2 dimensional Cartesian square of parts. At each intersection between 2 parts, e.g. 1 & 3, a checkbox input is provided. Because the Cartesian square is symmetrical about the diagonal from upper-left to lower-right, there are no checkboxes below the diagonal.

Note that ellipses are shown on the right side and bottom, indicating each extends according to the 30 parts of FIG. 13.

A part-to-part selection frame 1401 is the frame for this display screen. It is labeled with a title bar in the upper-left corner, and has standard (Microsoft Windows or Apple) buttons in the upper right corner to minimize, maximize, or exit this display screen. This provides functional control.

A group of musical part-to-part first associations 1402 is a grid of checkboxes, one checkbox for each possible combination of parts. Checkboxes below the diagonal are symmetric and redundant with those above the diagonal, and have been removed. The default value for all checkboxes is un-checked.

A selection vertical scrollbar 1403 and a selection horizontal scrollbar 1404 enable the selection of part-to-part combinations beyond the size of the part-to-part selection frame 1401.

Note the following functional equivalencies:

A selection screen save to file 1405 is functionally equivalent to the scalar screen save to file 0822.

A selection screen load file 1406 is functionally equivalent to the scalar screen load file 0823.

A part to part screen selector 1407 is the button to select the part-to-part combination inputs display screen.

Figure 15:
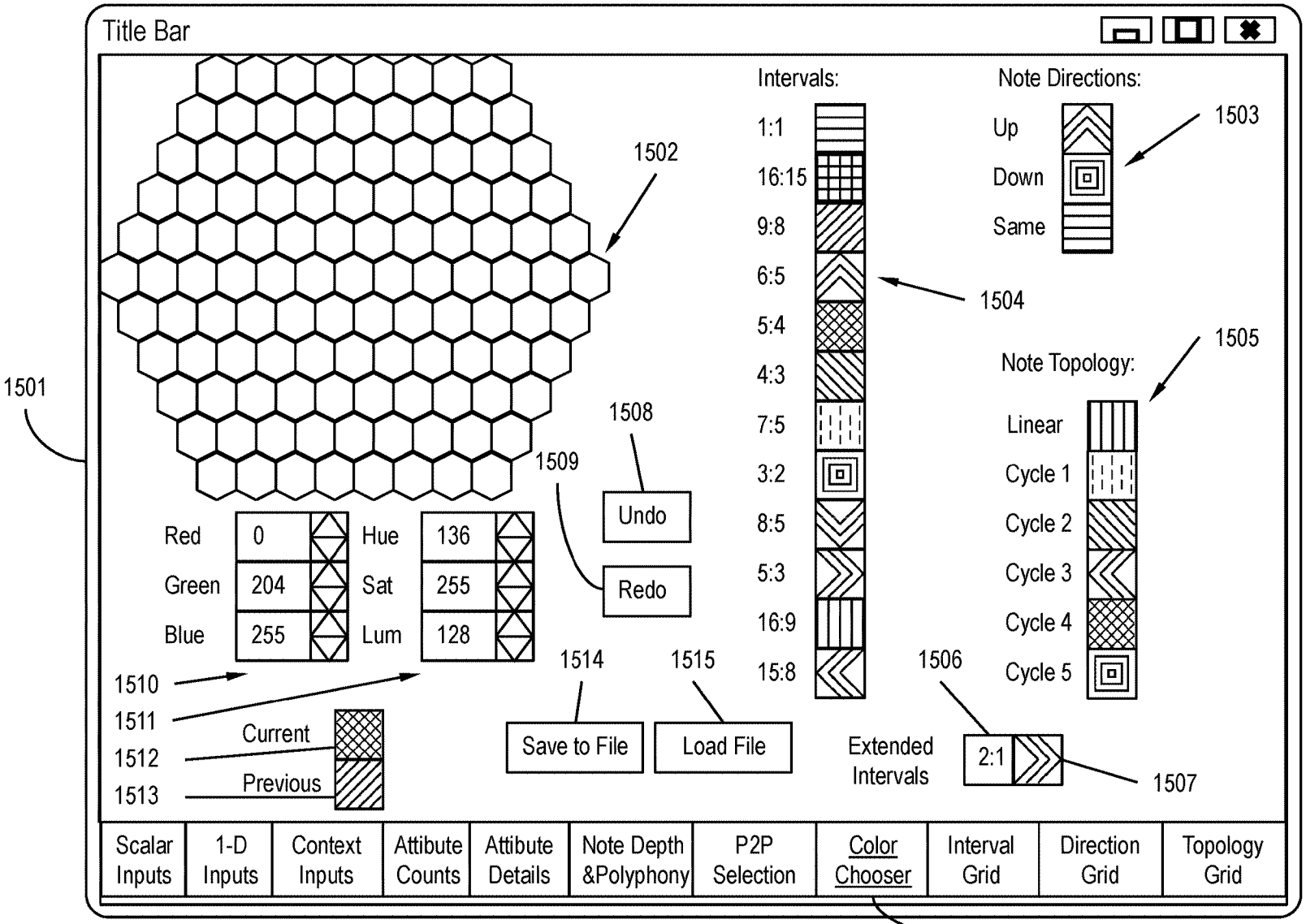
FIG. 15 is an exemplary display screen for selecting and assigning the color of various exemplary display elements.

FIG. 15 is an exemplary display screen for selecting and assigning the color of various display elements. Like the inputs of FIG. 13, these inputs are music analyzing device display parameters. These parameters affect three types of music analyzing display screen (seen below), interval, direction, and topology. Specifically, the parameters are aspects of visual information encoding during analysis.

A color chooser frame 1501 is the frame for this display screen. It is labeled with a title bar in the upper-left corner, and has standard (Microsoft Windows or Apple) buttons in the upper right corner to minimize, maximize, or exit this display screen.

Each reference number is noted below as either a selection, or as an assignment. In brief, a color is selected, then assigned. A color may be selected by clicking on a specific color in a predefined color palette 1502. A color may also be selected using an RGB specification 1510 or an HSL specification 1511. A specific element may be assigned the selected color by clicking on its adjacent color-square. Any occurrence of that element in the interval grid 1604, the direction grid 1705, or the topology grid 1805, seen below in FIGS. 16, 17 and 18 respectively, is then encoded with the selected color.

A predefined color palette 1502 is a hexagonal collection of predefined colors. Any color in this collection may be selected.

A group of note interval colors 1504 is a column of color assignments, one for each of the 12 intervals within an octave of 12 notes. These assignments are updated by the undo 1508 and the redo 1509 buttons. The default values are the colors shown.

A group of note direction colors 1503 is a column of color assignments, one for each value of the note directions 0902, FIG. 09, described above. These assignments are updated by an undo 1508 and a redo 1509 buttons, described below. The default values are the colors shown.

A group of note topology colors 1505 is a column of color assignments. The first assignment is for all topological lines. The next five assignments are for each of five topological cycles. The quantity five is exemplary. These assignments are updated by the undo 1508 and the redo 1509 buttons. The default values are the colors shown.

An extended interval selector 1506 is a pulldown menu of intervals which exist beyond an octave of 12 notes, e.g. the notes C4 and C5 forming the interval 2:1. This selection is updated by the undo 1508 and the redo 1509 buttons. The default value is 2:1.

An extended interval color 1507 is the assigned color for the interval selected by the extended interval selector 1506. This assignment is updated by the undo 1508 and the redo

1509 buttons. The default value is the color shown. Note the functional dependency between the extended interval selector 1506 and the extended interval color 1507.

An undo 1508 is a button to un-do the most recent color assignment, up to a limit of 10. The quantity 10 is exemplary.

A redo 1509 is a button to re-do the most recently un-done color assignment, up to a limit of 10. The exemplary quantity 10 matches the quantity of the undo 1508. Note the functional dependency between the undo 1508 and the redo 1509.

An RGB specification 1510 is a column of 3 spin-controls with numeric subfields, one each for the Red, Green, and Blue components of a possible color. The numeric subfields are updated to match any color chosen using either the predefined color palette 1502 or the HSL specification 1511. This selection is not updated by the undo 1508 nor the redo 1509 buttons. The default values are R=127, G=127, B=127, matching the default for the current selected color 1512 below.

An HSL specification 1511 is a column of 3 spin-controls with numeric subfields, one each for the Hue, Saturation, and Lightness components of a possible color. The numeric subfields are updated to match any color chosen using either the predefined color palette 1502 or the RGB specification 1510. This selection is not updated by the undo 1508 nor the redo 1509 buttons. The default values are H=170, S=0, L=127, matching the default for a current selected color 1512.

A current selected color 1512 displays the current color selected using either the predefined color palette 1502, the RGB specification 1510, or the HSL specification 1511. This assignment is not updated by the undo 1508 nor the redo 1509 buttons. The default value is gray, matching the default for the RGB specification 1510 and the HSL specification 1511.

A previous selected color 1513 displays the previous color selected using either the predefined color palette 1502, the RGB specification 1510, or the HSL specification 1511. This assignment is not updated by the undo 1508 nor the redo 1509 buttons. The default value is black, matching the RGB specification 1510 of R=0, G=0, B=0, and the HSL specification 1511 of H=170, S=0, L=0.

Note the following functional dependencies:

predefined color palette 1502

RGB specification 1510

HSL specification 1511 current selected color 1512 previous selected color 1513

Also note the following functional equivalencies:

A color screen save to file 1514 is functionally equivalent to the scalar screen save to file 0822.

A color screen load file 1515 is functionally equivalent to the scalar screen load file 0823.

A color screen selector 1516 is the button to select the color chooser and parameter configuration display screen.

FIG. 16 is an exemplary display screen for the output of the interval music analyzing device grid. This screen displays multiple time series of color-coded musical intervals. These musical intervals, and their coordinates, are included within output indications, specifically correlations. Display changes occur in near-synchrony with time progression of the audio.

An interval music analyzing device frame 1601 is the frame for this display screen. It is labeled with a title bar in the upper-left corner, and has standard (Microsoft Windows or Apple) buttons in the upper right corner to minimize, maximize, or exit this display screen.

An interval grid 1604 is a Cartesian square of cells displaying intervals for selected combinations of musical part, voice and note depth count. In this example, the word "voice" is used in the sense of polyphony, e.g. a piano may be described as 10 voice, one voice per finger/key. While part, voice, and note depth count may be considered as 3 separate dimensions of a Cartesian cube, for display purposes this example unrolls each dimension so that the Cartesian cube is presented as a 2 dimensional Cartesian square. The interval grid 1604 is unrolled as described above for the display space data structure 0711.

Each cell in the Cartesian square corresponds to the musical interval between 2 specific notes in the composition. The content of each cell is the color chosen for a given interval using the color chooser of FIG. 15. The default color is gray. Each cell provides a popup screen of amplifying information if the user clicks on the cell, described below with FIG. 19.

Coordinates within the 2 dimensional Cartesian square are triplets consisting of (musical part, musical voice, note depth in time). A display cell is provided at each intersection between 2 triplets. Because the Cartesian square is symmetrical about the diagonal from upper-left to lower-right, there are no cells below the diagonal. Note that the diagonal cells, if present, would display the color for the identity interval of 1:1. Therefore they are also absent from the grid. Note also that ellipses are shown on the right side and bottom, indicating each extends according to the input parameters of FIG. 13 and FIG. 14.

A group of interval column coordinates 1602 provides the vertical indexing for each cell in the grid as numeric values. These coordinates are labeled in the upper-left margins with the following legend:

P: for musical part, i.e. an instrument.

V: for musical voice, i.e. a given voice of an instrument, polyphonic instruments having multiple voices.

M: for note depth in time, i.e. the time dimension.

A group of interval row coordinates 1603 provides the horizontal indexing for each cell in the grid, and is labeled with the same legend as the interval column coordinates 1602.

An interval legend 1605 shows the association between colors seen in the grid and each of 12 intervals. The number 12 is exemplary.

An interval vertical scrollbar 1606 and an interval horizontal scrollbar 1607 enable the display of grid cells beyond the size of the interval music analyzing device frame 1601.

An interval screen pause button 1608 pauses updates to the music analyzing device grid. An interval screen continue button 1609 continues updates to the music analyzing device grid.

An interval screen start from file 1610 starts analysis with a previously-saved MIDI or MusicXML file. This opens a standard OS-level (e.g. Microsoft, Apple) load-file dialog. In loading a file for analyzing, multiple third input indications are made. First, the musical data source is indicated to be the selected file. Second, the musical data destination is indicated to be the music analyzing device. In the exemplary plug-in computing device 0501, all second sets of notes within the musical data source file are analyzed. Note this file may have originated e.g. via the output to MIDI file 0815, or via the output to XML file 0816.

An interval screen stop from file 1611 stops analysis from the MIDI or MusicXML file.

An interval screen selector 1612 is the button to select the interval music analyzing device grid display screen.

The cells of the interval grid 1604 change colors via movement between adjacent cells, subject to regional bounds on the grid. To illustrate this, refer now to FIG. 24, which is a block diagram of an example of the movement of color-encoded intervals. In this example, there is one bounded region, between two musical parts selected with input via the musical part-to-part first associations 1402 above. Each of the two parts has one voice, input via the composition polyphony 1303 above. The region has a time-window of 3 note depth counts, input via the note depth in time 1302 above. The number of cells in the region corresponds to (part1×1 voice×3 note depths in time)×(part2×1 voice×3 note depths in time)=3×3=9 cells.

Figure 24:
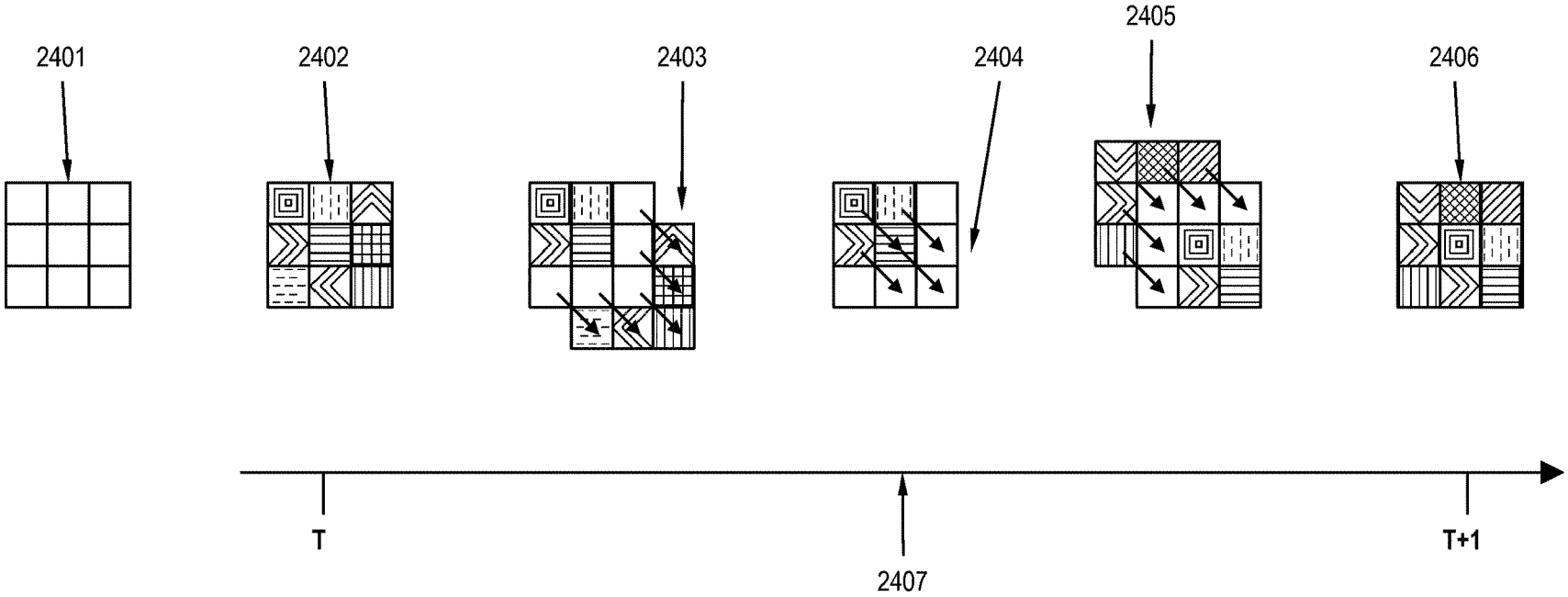
FIG. 24 is block diagram of an example of color movement in one region of the interval music analyzing device grid.

A 3×3 regional boundary of cells 2401 provides a fixed visual reference for the dynamic elements of FIG. 24. A cell coloration at time T 2402 shows the color-encoding for intervals initially in the 3×3 regional boundary of cells 2401. A group of intervals exiting the grid 2403 do so because their destination is outside of the 3×3 regional boundary of cells 2401. A group of interval remaining in the grid 2404 shift down/right within the 3×3 regional boundary of cells 2401. A group of intervals entering the grid 2405 shift into the 3×3 regional boundary of cells 2401 from the upper/left. A cell coloration at time T+1 2406 shows the color-encoding for the updated intervals in the 3×3 regional boundary of cells 2401. A timeline 2407 shows the time progression of time from T to T+1, for the cell coloration at time T 2402 thru the cell coloration at time T+1 2406.

Visually, a color appearing at time Tin cell[I, J], will move diagonally right/down into cell[I+1, J+1] at time T+1, but only if the destination cell is within the region. If the destination is out of the region, the color exits the music analyzing device grid. New intervals shift into the region from the upper/left.

If an interval of interest is displayed on the grid, e.g. 7:5 coded red, the interval screen pause button 1608 of FIG. 16 may be selected, which pauses all updates to the grid. Once the grid is paused, the red cell itself may be selected, and amplifying information displayed regarding the circumstances of this 7:5 interval. The popup screen with this amplifying information is described below with FIG. 19. With this information, determination can be made whether to modify the composition. The interval screen continue button 1609 of FIG. 16 may be selected to continue updates to the grid.

Returning now, refer to FIG. 17, which is an exemplary display screen for the output of the note direction music analyzing device grid. This screen displays multiple time series of color-coded musical note directions. As with FIG. 16, these note directions, and their coordinates, are included within output indications, specifically correlations. Display cells are derived from note-level data for one or more musical parts within a composition. Display changes occur in near-synchrony with time progression of the audio.

The direction-grid has a simpler structure than the interval-grid. Grid cells are structured as multiple 1 dimensional columns, each column a tuple consisting of (musical part, musical voice) on the vertical axis, and (note depth in time) on the horizontal axis. Each column is analyzed independently, and its associated cells are maintained separately.

The color-encoded note direction of each cell is determined by the note of that cell, and the note of the cell immediately below it. Visually, a color appearing at time T in cell[I, J], will move vertically down into cell[I, J+1], at time T+1. New note directions shift into the column from the top.

Note that ellipses are shown on the right side and bottom, indicating each extends according to the input parameters of FIG. 13 and FIG. 14.

A note direction music analyzing device frame 1701 is the frame for this display screen. It is labeled with a title bar in the upper-left corner, and has standard (Microsoft Windows or Apple) buttons in the upper right corner to minimize, maximize, or exit this display screen.

A group of direction column coordinates 1702 provide the vertical indexing for each cell in the grid as numeric values. These coordinates are labeled in the upper-left with the following legend:

P: for musical part, i.e. an instrument.

V: for musical voice, i.e. a given voice of an instrument, polyphonic instruments having multiple voices.

A group of direction row coordinates 1703 provide the horizontal indexing for each cell in the grid, and are labeled with this legend:

M: for note depth in time, i.e. the time dimension.

A direction legend 1704 shows the association between colors seen in the grid and each note direction.

A direction grid 1705 is the grid, per se, of display cells. Each cell in the grid corresponds to the second note direction between 2 specific notes in the composition. The content of each cell is the color chosen for a given direction using the color chooser of FIG. 15. Note the phrase "second note direction" refers to a calculated correlation.

The default cell color is gray. Each cell provides a popup screen of amplifying information if the user clicks on the cell. The popup screen with this amplifying information is described below with FIG. 20.

A direction vertical scrollbar 1706 and a direction horizontal scrollbar 1707 enable the display of grid cells beyond the size of the note direction music analyzing device frame 1701.

Note the following functional equivalencies:

A direction screen pause button 1708 is functionally equivalent to the interval screen pause button 1608.

A direction screen continue button 1709 is functionally equivalent to the interval screen continue button 1609.

A direction screen start from file 1710 is functionally equivalent to the interval screen start from file 1610.

A direction screen stop from file 1711 is functionally equivalent to the interval screen stop from file 1611.

A direction screen selector 1712 is the button to select the note direction music analyzing device grid display screen.

Figure 18:
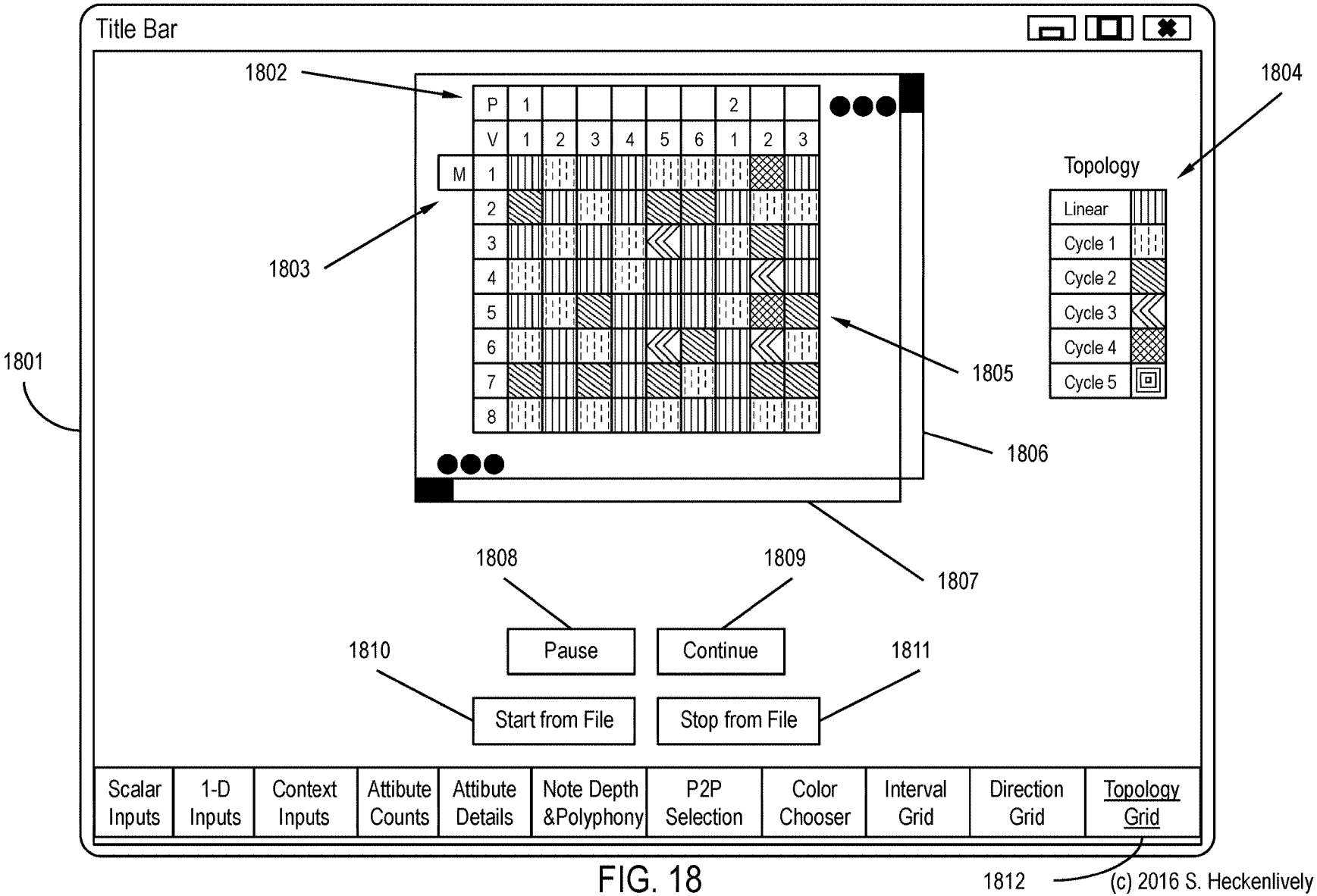
FIG. 18 is an exemplary display screen for analyzing the color-coded topology of musical notes.

FIG. 18 is an exemplary display screen for the output of the note topology music analyzing device grid. This screen displays multiple time series of color-coded musical note topologies. As with FIG. 16, these note topologies, and their coordinates, are included within output indications, specifically correlations. Display cells are derived from note-level data for one or more musical parts within a composition. Display changes occur in near-synchrony with time progression of the audio.

Grid cells are structured as multiple 1 dimensional columns, each column a tuple of (musical part, musical voice) on the vertical axis, and (note depth in time) on the horizontal axis. Each column is analyzed independently, and its associated cells are maintained separately.

A color may be assigned to each numerical instance of a topological cycle which may appear, first, second, third, etc. As described above, a cycle is defined to be two cells whose underlying notes are the same, e.g. C4. Cells which are not a member of any cycle are defined to be linear. Assignment may be made of a single color or shade, e.g. gray, for all cells which are linear. Cycles are denoted during analysis by the presence of 2 cells, in the same column, sharing the same color. If a cell is a member of any cycle within the column, then the content of that cell is the color chosen for that cycle using the color chooser of FIG. 15.

The color-encoded note topology of each cell is determined by the note of that cell, and the notes of all the cells below it. Visually, a color appearing at time T in cell[I, J], will move vertically down into cell[I, J+1], at time T+1. New note topology elements shift into the column from the top.

Note that ellipses are shown on the right side and bottom, indicating each extends according to the input parameters of FIG. 13 and FIG. 14.

A note topology music analyzing device frame 1801 is the frame for this display screen. It is labeled with a title bar in the upper-left corner, and has standard (Microsoft Windows or Apple) buttons in the upper right corner to minimize, maximize, or exit this display screen.

A group of topology column coordinates 1802 provide the vertical indexing for each cell in the grid as numeric values. These coordinates are labeled in the upper-left with the following legend:

P: for musical part, i.e. an instrument.

V: for musical voice, i.e. a given voice of an instrument, polyphonic instruments having multiple voices.

A group of topology row coordinates 1803 provide the horizontal indexing for each cell in the grid, and are labeled with this legend:

M: for note depth in time, i.e. the time dimension.

A topology legend 1804 shows the association between colors seen in the grid and colors chosen using the color chooser of FIG. 15. The number of cycles, 5, is exemplary.

Cycles are numbered 1, 2, 3, etc. simply by their time-ordered appearance within the column. Once all the cycle colors have been assigned to cells, color assignment begins anew with the first cycle's color. I.e. cycle colors are assigned modulo the number of cycle colors.

If a cell enters the column without membership in any cycle within the column, the cell's initial color is the linear color chosen using the color chooser of FIG. 15. If a cell initially has Linear color, and later gains membership in a cycle, that cell's color is changed to the cycle's color. The membership is retained until the cell exits the grid.

The default cell color is gray. Each cell provides a popup screen of amplifying information if the user clicks on the cell. The popup screen with this amplifying information is described below with FIG. 21.

A topology grid 1805 is the grid, per se, of display cells. Each cell in the grid corresponds to the second note topology between 1 specific note, and all other notes sharing the same column with that note. Cells enter the column at the top, move down over time, and exit the column at the bottom. Note that "second note topology" refers to a calculated correlation.

A topology vertical scrollbar 1806 and a topology horizontal scrollbar 1807 enable the display of grid cells beyond the size of the note topology music analyzing device frame 1801.

Note the following functional equivalencies:

A topology screen pause button 1808 is functionally equivalent to the interval screen pause button 1608.

A topology screen continue button 1809 is functionally equivalent to the interval screen continue button 1609.

A topology screen start from file 1810 is functionally equivalent to the interval screen start from file 1610.

A topology screen stop from file 1811 is functionally equivalent to the interval screen stop from file 1611.

A topology screen selector 1812 is the button to select the note topology music analyzing device grid display screen.

Figure 21:
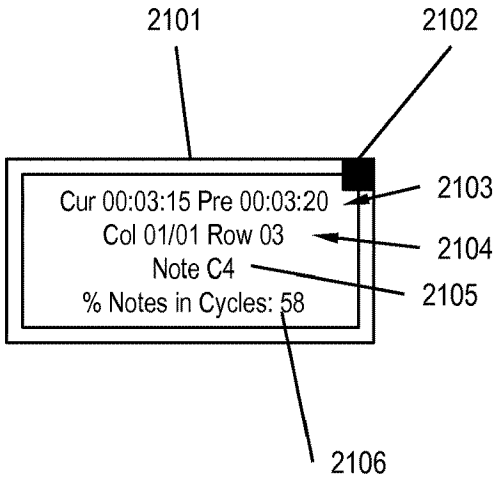
FIG. 21 is an exemplary display screen for output of amplifying information from a cell within the note topology music analyzing device grid.
Figure 19:
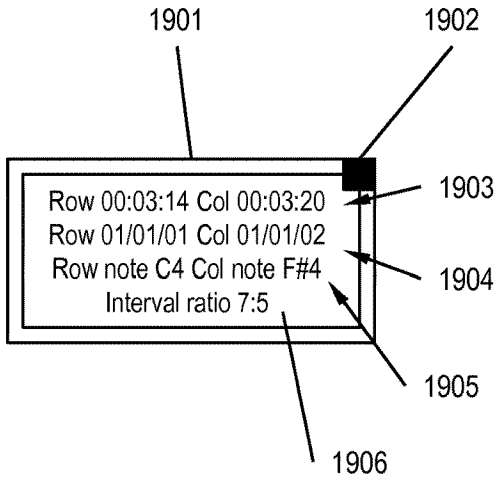
FIG. 19 is an exemplary display screen for output of amplifying information from a cell within the interval music analyzing device grid.

FIG. 19 is an exemplary display screen for output of detailed information for a cell within the interval music analyzing device grid. The screens of FIG. 19, FIG. 20, and FIG. 21 are moveable and overlay the associated music analyzing device grid screen.

An interval music analyzing device cell frame 1901 is the frame for this display screen. An interval details exit button 1902 is the button to exit this popup screen. A group of interval details playback times 1903 are the playback times of the two notes forming the interval for the selected cell. A group of interval details grid coordinates 1904 are the grid coordinates of the selected cell as musical part, musical voice, and note depth in time. A group of interval notes 1905 are the notes forming the interval for the selected cell. An interval ratio 1906 is the interval for the selected cell.

Figure 20:
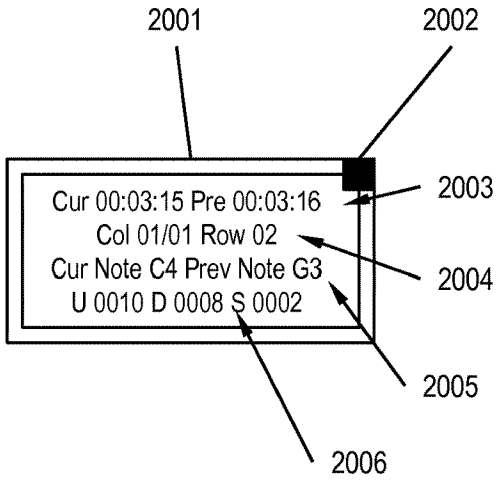
FIG. 20 is an exemplary display screen for output of amplifying information from a cell within the note direction music analyzing device grid.

FIG. 20 is an exemplary display screen for output of detailed information for a cell within the note direction music analyzing device grid.

A direction music analyzing device cell frame 2001 is the frame for this display screen. A direction details exit button 2002 is the button to exit this popup screen. A group of direction details playback times 2003 are the playback times of the two notes for the selected cell. A group of direction details grid coordinates 2004 are the grid coordinates of the selected cell as musical part, musical voice, and note depth in time. A group of current and previous notes 2005 are the current and previous notes forming the note direction for the selected cell. A group total up/down/same 2006 is three counts of the number of notes Up, Down, and Same, respectively.

FIG. 21 is an exemplary display screen for output of detailed information for a cell within the note topology music analyzing device grid.

A topology music analyzing device cell frame 2101 is the frame for this display screen. A topology details exit button 2102 is the button to exit this popup screen. A group of topology details playback times 2103 are the playback times of the two notes forming the interval for the selected cell. A group of topology details grid coordinates 2104 are the grid coordinates of the selected cell as musical part, musical voice, and note depth in time. A topology note 2105 is the note for the selected cell. A percent cycles 2106 is the percentage of notes participating in cycles, up to the time of the note for the selected cell.

As noted in the Background above, the exemplary plug-in computing device 0501 of FIG. 05 may be used within the context of a wider toolset. Appendix 06 describes an example workflow to modify a large project, from power up of the computing device 0301, to power down.

As noted above, information conveyed in music analyzing device grids includes colors assigned to intervals, note directions, and note topology. Appendix 07 describes an example workflow using the color chooser to make color assignments.

The operation of music analyzing device grids involves both the VST2/AU host application 0401 and the exemplary plug-in computing device 0501. The VST2/AU host application 0401 is performing the playback of a full musical composition, while the exemplary plug-in computing device 0501 is being updated in near-synchrony with time progression of the MIDI note data provided by the host. As described above, the VST2/AU standards describe 2 functional subsystems for the exemplary plug-in computing device 0501 as a plug-in: the device effect 0511, and the device editor 0502. The standards also describe the VST2/AU host application 0401 maintaining 2 processing threads for the exemplary plug-in computing device 0501, a higher-priority thread for processing audio data, and a lower-priority thread for updates of the user interface of the exemplary plug-in computing device 0501. Appendix 08 describes exemplary interaction between the VST2/AU host application 0401 and the exemplary plug-in computing device 0501 for updates to the interval music analyzing device grid during playback of the musical composition.

Description of Processes

Figure 25:
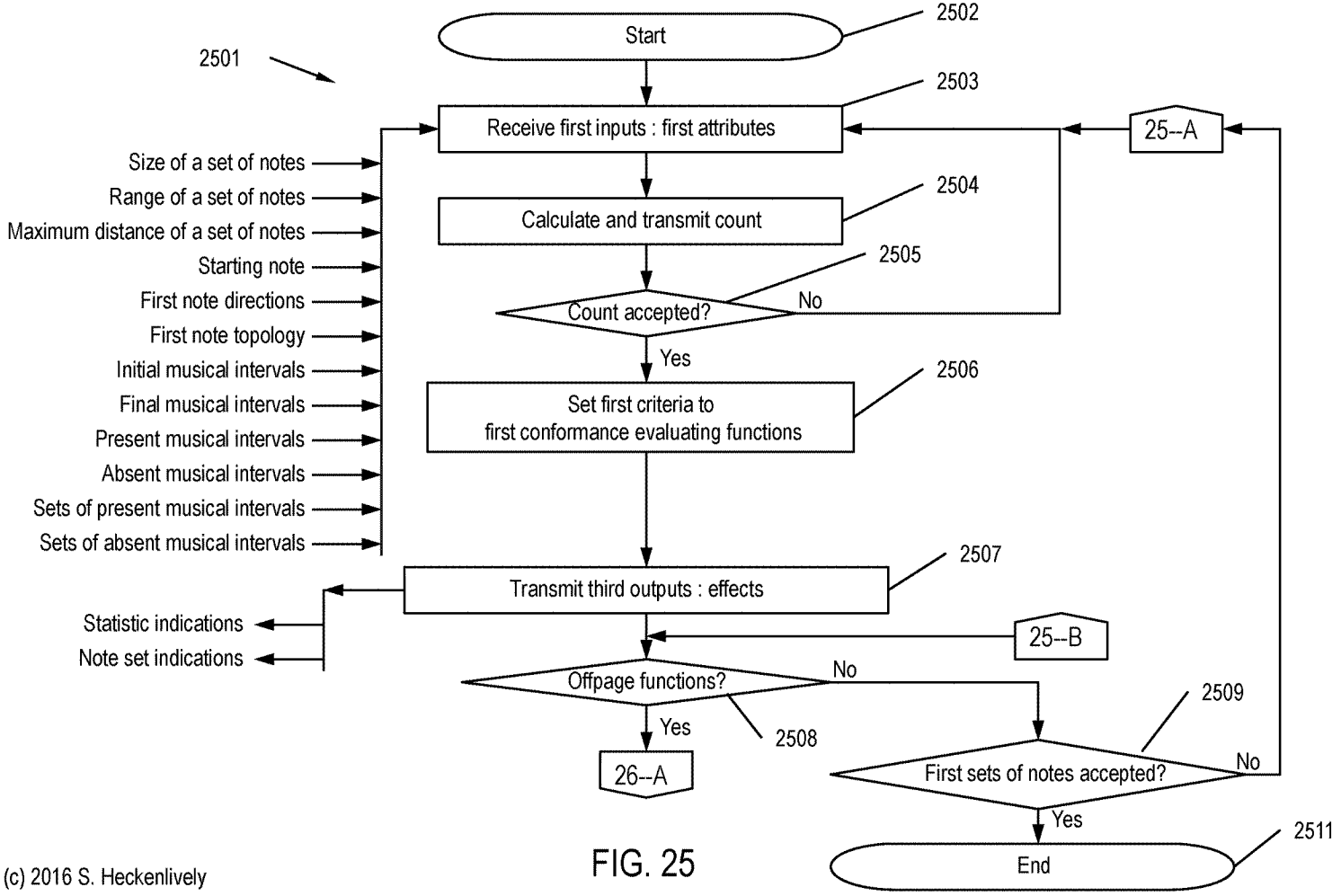
FIG. 25 is the first portion of a flow chart of a process for controlling music yielding devices.

FIG. 25 thru FIG. 28 are a flow chart of a process 2501 for controlling music yielding devices, such as the system music yielding device 0212 of FIG. 02. Referring first to FIG. 25, the process 2501 may begin at 2502, and may end at 2511 when one or more first sets of notes, which include notes of the music, have been accepted.

At 2503, first input indications may be received, including one or more first attributes of the first sets of notes, the first attributes including selections from the group consisting of:

size of a set of notes,
range of a set of notes,
maximum distance of a set of notes,
starting note of a set of notes,
first note directions,
first note topology,
initial musical intervals,
final musical intervals,
present musical intervals,
absent musical intervals,
sets of present musical intervals and
sets of absent musical intervals.

At 2504, a count of first sets of notes conforming, in one or more predetermined minimum second degrees, to the first attributes may be calculated and transmitted.

At 2505, a determination may be made if the count of first sets of notes is accepted. When the count is not accepted, the actions beginning at 2503 may be repeated. When the count is accepted, at 2506 first criteria may be set to one or more first conformance evaluating functions, which may calculate one or more second attributes of one or more of the first sets of notes, compare one or more of the second attributes to one or more of the first attributes and return one or more first degrees of conformance, to determine conformance in one or more first degrees of first sets of notes to the first attributes.

At 2507, third output indications may be transmitted, including effects of the first attributes upon the music yielding device, the effects including statistic indications and note set indications.

At 2508, a determination may be made if one or more offpage functions are to be performed. When offpage functions are to be performed, the process 2501 may continue at 2601 on FIG. 26. When offpage functions are not to be performed, at 2509 a determination may be made whether the first sets of notes yielded are accepted. When the first sets of notes yielded are not accepted, the actions beginning at 2503 may be repeated. When the first sets of notes yielded are accepted, the process 2501 may end at 2511.

Figure 26:
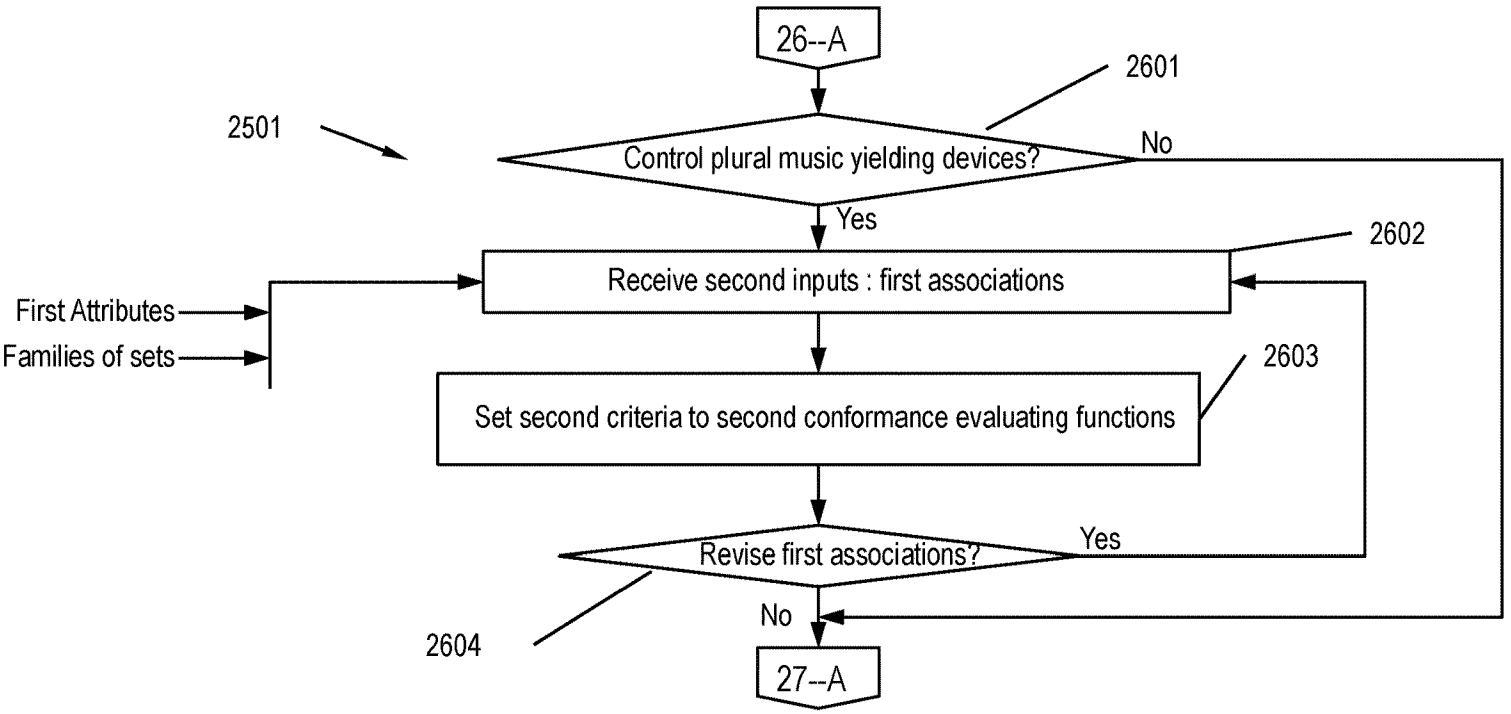
FIG. 26 is the second portion of the flow chart of the process for controlling music yielding devices.

Referring now to FIG. 26, at 2601, a determination may be made if control of a plurality of music yielding devices is to be performed, the plurality of music yielding devices assembling families of sets including first sets of notes. When control of a plurality of music yielding devices is not to be performed, the process 2501 may continue at 2701 on FIG. 27. When control of a plurality of music yielding devices is to be performed, at 2602 second input indications may be received, including first associations between first attributes and families of sets.

At 2603, second criteria may be set to one or more second conformance evaluating functions, which calculate one or more second associations of one or more of the families of sets, compare one or more of the second associations to one or more of the first associations and return one or more second degrees of conformance, to determine conformance in one or more second degrees of families of sets to the first associations.

At 2604, a determination may be made if the first associations are to be revised. If the first associations are to be revised, the actions beginning at 2602 may be repeated. If the first associations are not to be revised, the process 2501 may continue at 2701 on FIG. 27.

Figure 27:
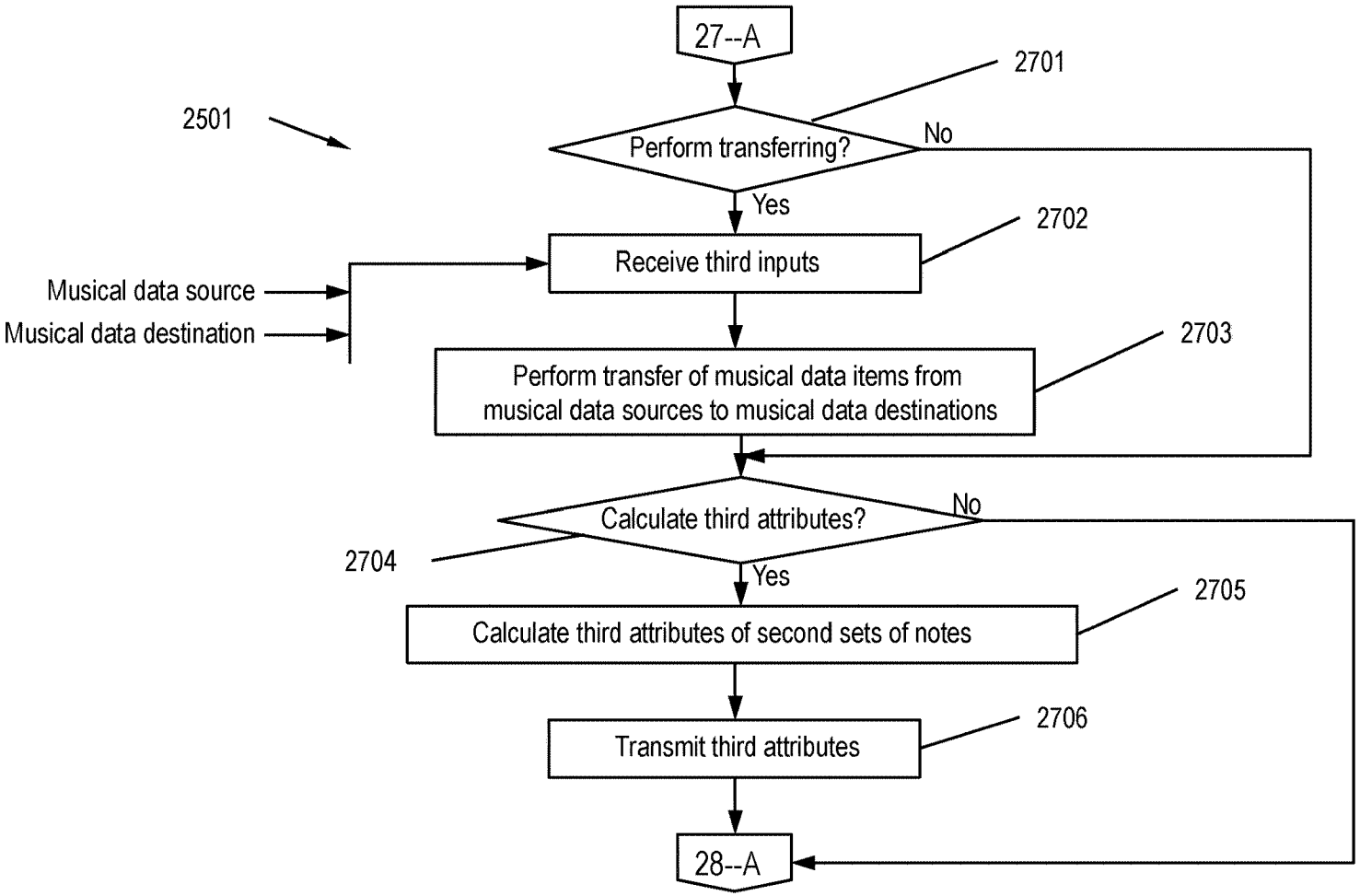
FIG. 27 is the third portion of the flow chart of the process for controlling music yielding devices.

Referring now to FIG. 27, at 2701 a determination may be made if transferring of musical data items is to be performed. When transferring is not to be performed, the process 2501 may continue at 2704. When transferring is to be performed, at 2702 third input indications may be received, including musical data sources and musical data destinations.

At 2703, musical data items, which may include second sets of notes which include musical notes, may be transferred from the musical data sources to the musical data destinations.

At 2704 a determination may be made if third attributes are to be calculated. When third attributes are not to be calculated, the process 2501 may continue at 2801 on FIG. 28. When third attributes are to be calculated, at 2705 one or more calculated third attributes of second sets of notes may be calculated.

At 2706, the calculated third attributes may be transmitted as second output indications. The process 2501 may then continue at 2801 on FIG. 28.

Figure 28:
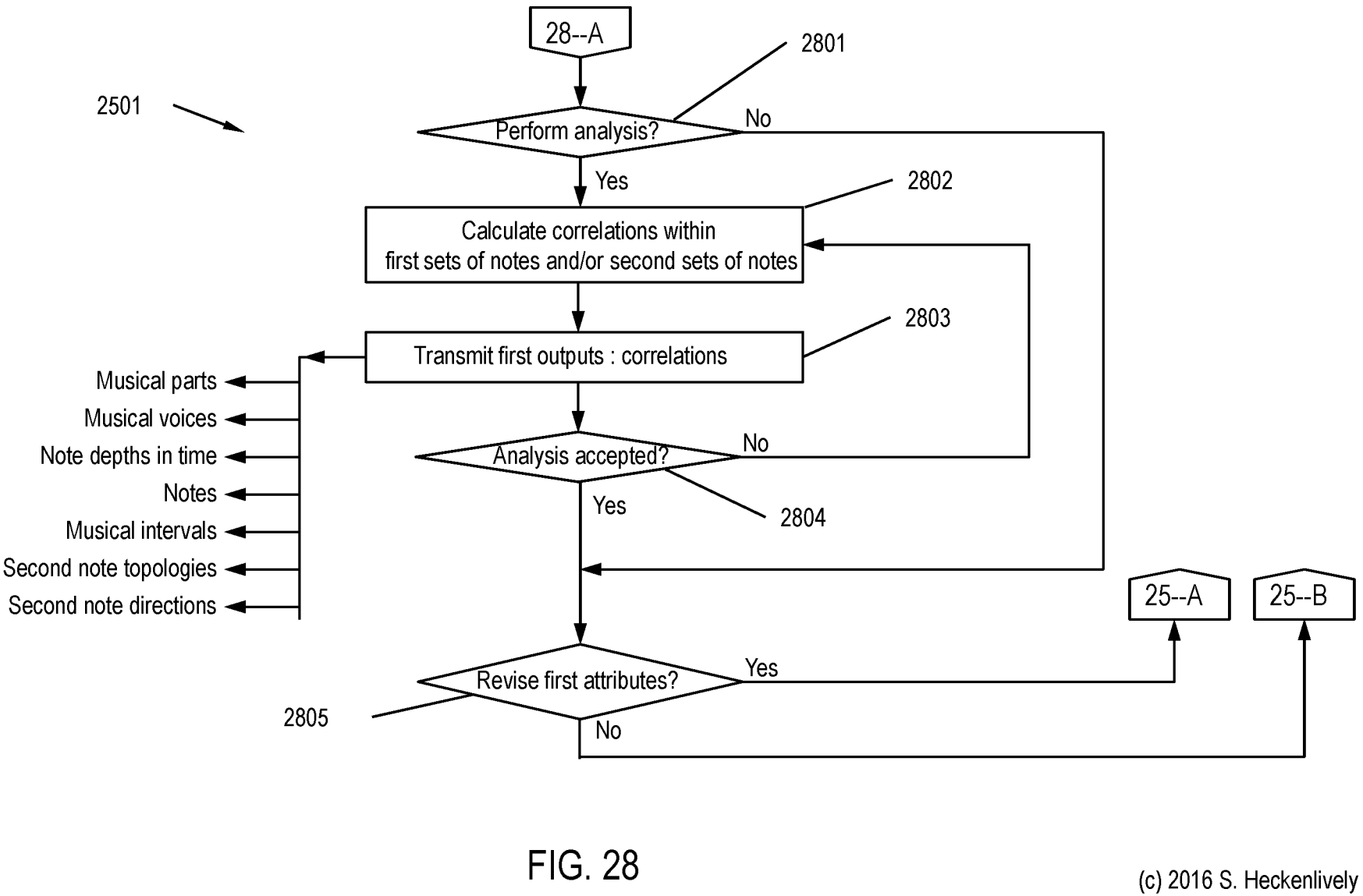
FIG. 28 is the fourth portion of the flow chart of the process for controlling music yielding devices.

Referring now to FIG. 28, at 2801 a determination may be made if analysis is to be performed. When analysis is not to be performed, the process 2501 may continue at 2805. When analysis is to be performed, at 2802 correlations within the first sets of notes and/or second sets of notes may be calculated.

At 2803, first output indications may be transmitted, including the correlations which include selections from the group consisting of:

musical parts,
musical voices,
note depths in time,
notes,
musical intervals,
second note topologies and
second note directions.

Transmission of the first output indications may be performed in near-synchrony with time progression of the first sets of notes and/or second sets of notes.

At 2804, a determination may be made if the analysis is accepted. When the analysis is not accepted, the actions beginning at 2802 may be repeated. When the analysis is accepted, at 2805 a determination may be made if the first attributes are to be revised.

If the first attributes are to be revised, the actions beginning at 2503 on FIG. 25 may be repeated. If the first attributes are not to be revised, the actions beginning at 2508 on FIG. 25 may be repeated.

A process for calculation of a set of third attributes, given a second set of notes, may be described by framing the above first attributes as questions against the given second set of notes:

1) What is the second set of notes's size of a set of notes?
2) What is the second set of notes's range of a set of notes?
3) What is the second set of notes's maximum distance of a set of notes?
4) What is the second set of notes's starting note of a set of notes?
5) What are the second set of notes's note directions?
6) What is the second set of notes's note topology?
7) What is the second set of notes's initial musical interval?
8) What is the second set of notes's final musical interval?
9) What are the second set of notes's present musical intervals, as ordered?
10) What are the second set of notes's absent musical intervals, as ordered?
11) What are the second set of notes's sets of present musical intervals, and their respective positions?
12) What are the second set of notes's sets of absent musical intervals, and their respective positions?

As seen from the discussion of first attributes above, the second set of notes, and the notes it includes, provide determinants to answer each question.

Description of Plural Apparatus

Figure 29:
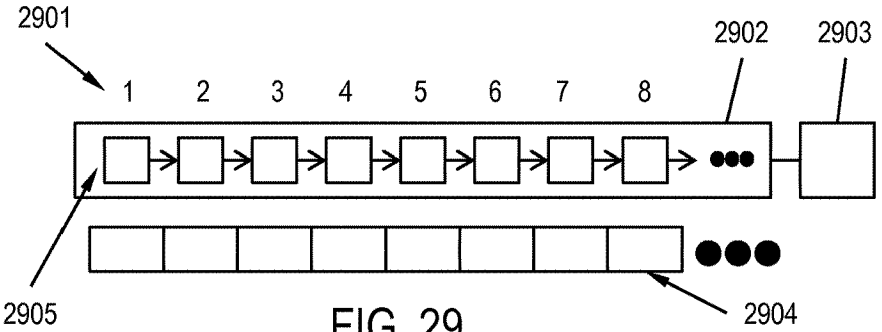
FIG. 29 is a block diagram of a single engine and controller in the exemplary computing device.

For comparison with plural apparatus, FIG. 29 is a block diagram of a single engine 2902 and a single controller 2903 included in the exemplary plug-in computing device 0501, described above with FIG. 03 thru FIG. 24. The combination of the single engine 2902 and the single controller 2903 is referred to below as "the single controller example".

The single engine 2902 includes a list of single engine loop objects 2905, one loop-object for each note position 1, 2, 3, . . . , each of the single engine loop objects 2905 generating one or more notes at a note position within one or more first sets of notes generated by the single engine 2902. A single position 2901 shows the note position of each of the single engine loop objects 2905 within the single engine 2902, and each of the notes within a single first set of notes 2904.

The single controller 2903 sets one or more first criteria (not shown) to one or more first conformance evaluating functions (not shown), which calculate one or more second attributes of one or more of the first sets of notes, compare one or more of the second attributes to one or more first attributes (not shown) and return one or more first degrees of conformance, to determine conformance to one or more of the first attributes. The first criteria are evaluated within the single engine loop objects 2905. Control flow and evaluation of the first criteria proceeds as shown by the arrows between the single engine loop objects 2905, and as noted above, is described in more detail in Appendix 02.

Figure 30:
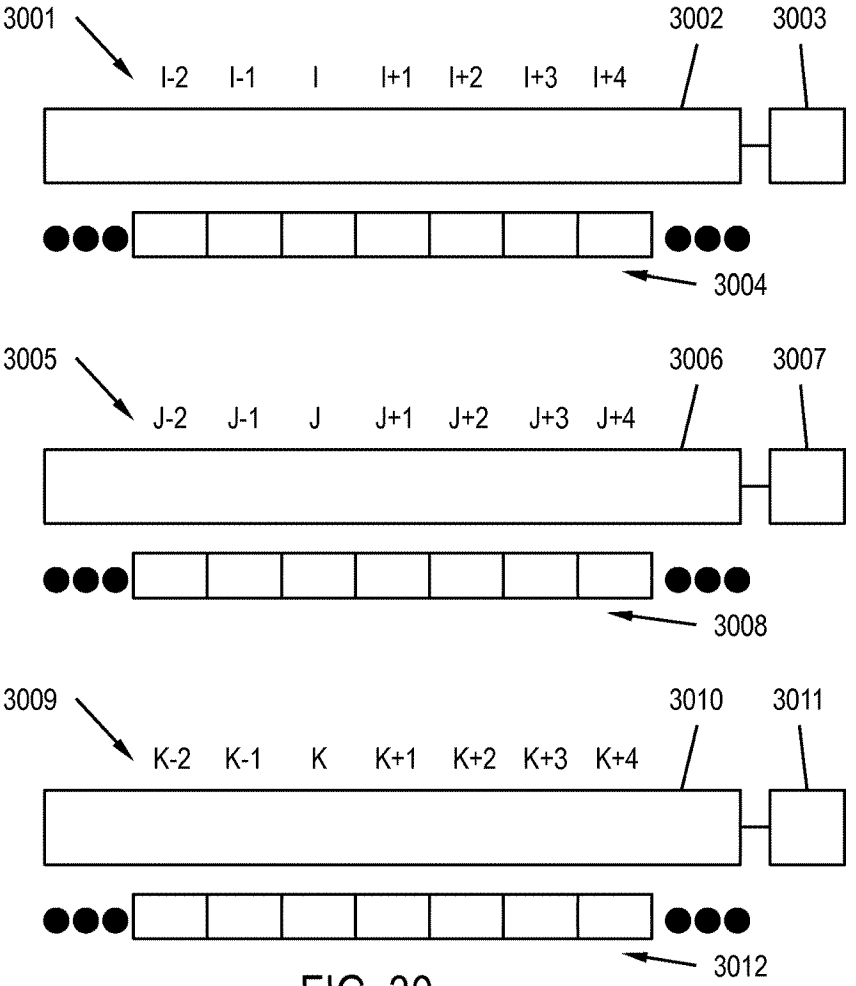
FIG. 30 is a block diagram of an exemplary device which includes plural controllers and plural engines.

FIG. 30 is a block diagram of an exemplary device which includes plural controllers and plural engines. In this example, and FIG. 30 thru FIG. 45, a music yielding device is referred to as an engine, and the action of yielding is referred to as generating. This example may generate harmony as well as melody. Three engines, a plural engine1 3002, a plural engine2 3006, and a plural engine3 3010, are described as a representative plurality. Also shown are controllers for each of the engines, a plural controller1 3003, a plural controller2 3007, and a plural controller3 3011 respectively. This is referred to below as "the plural controller example".

In FIG. 30, the loop-objects within each of the plural engines are not shown. Plural engines and plural controllers are described in more detail with FIG. 31 thru FIG. 45. Throughout the examples of FIG. 30 thru FIG. 45, conformance is quantized to a predetermined degree of true/false.

As background, in the art of music, melody is often referred to as the horizontal aspect of music. Harmony is referred to as the vertical aspect. FIG. 30 thru FIG. 45 describe how the aspects of harmony and melody may be generated with plural engines and plural controllers. To convey this, each engine is shown with an independent note position. Engine 1 is indexed by I, engine 2 by J, and engine 3 by K. Thus:

a plural engine1 position 3001,
a plural engine2 position 3005 and
a plural engine3 position 3009

Each respectively shows the position of:

a plural first set of notes1 3004,
a plural first set of notes2 3008 and
a plural first set of notes3 3012.

Figure 31:
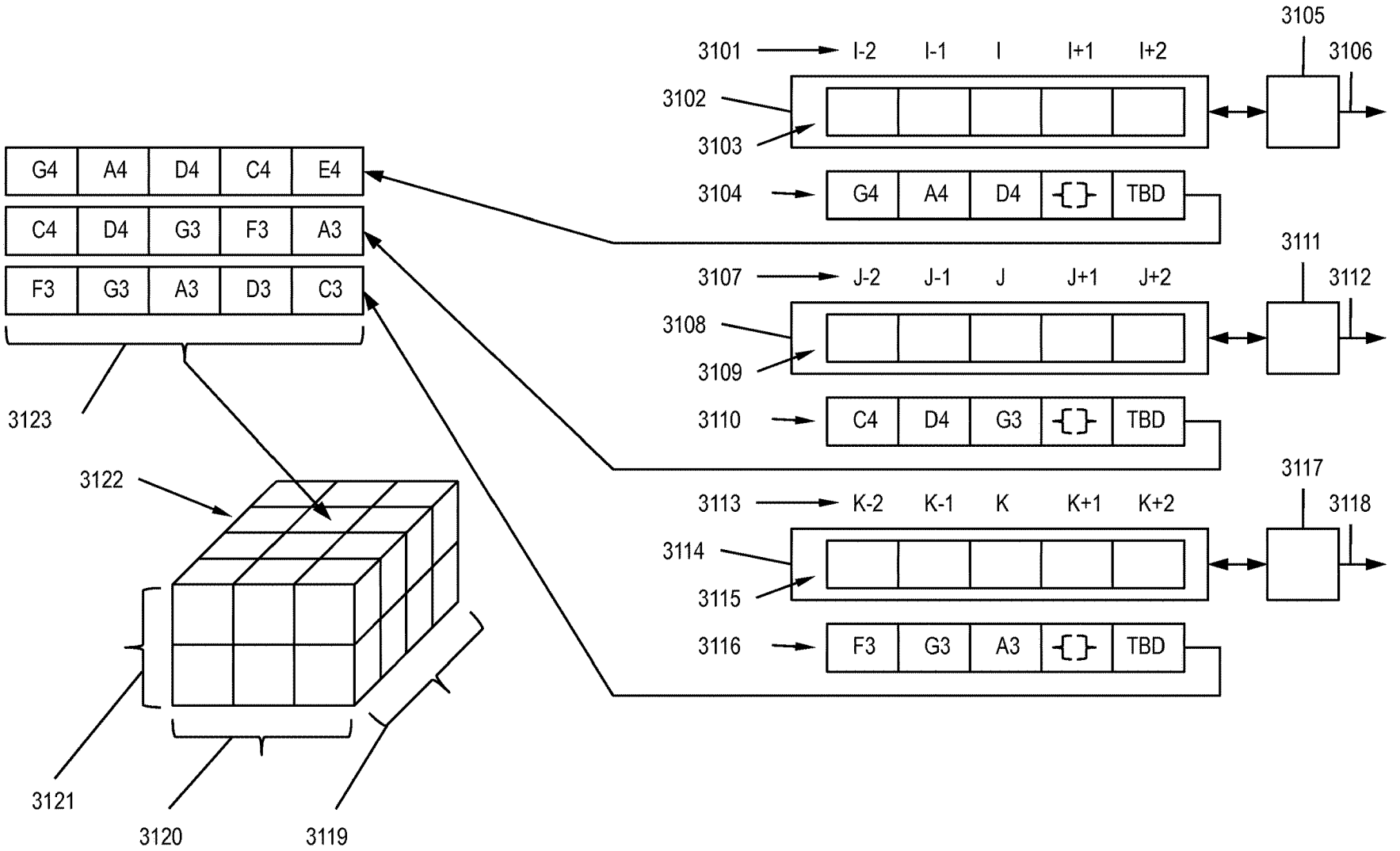
FIG. 31 is a block diagram of an example of plural engines and controllers assembling families of sets.

FIG. 31 is a block diagram of an exemplary device with plural engines and plural controllers assembling families of sets, which include first sets of notes. In this example, each engine includes a list of loop-objects. Also in this example, each controller sets second criteria (not shown) to one or more second conformance evaluating functions (not shown), which calculate one or more second associations of one or more of the families of sets, compare one or more of the second associations to one or more first associations and return one or more of the second degrees of conformance, to determine conformance to the first associations. The second criteria are evaluated within each loop-object.

An assembling note position1 3101 indexes a list of assembling loop-objects1 3103 within an assembling engine1 3102, and also indexes an assembling engine set1 3104. An assembling controller1 3105 sets second criteria evaluated by the assembling engine1 3102 to generate an in-progress assembling engine set1 3104, and transmits an assembling output indications1 3106 which include the effects of the first attributes upon the engine. Once complete, the assembling engine set1 3104 is included within a member of a group of assembling set families 3122, for example a assembling set family 3123, and another assembling engine set1 3104 is begun.

An assembling note position2 3107 indexes a assembling loop-objects2 3109 within an assembling engine2 3108, and also indexes an assembling engine set2 3110. An assembling controller2 3111 sets second criteria evaluated by the assembling engine2 3108 to generate an in-progress assembling engine set2 3110, and transmits an assembling output indications2 3112. Once complete, the assembling engine set2 3110 is included within a member of the assembling set families 3122, again for example the assembling set family 3123, and another assembling engine set2 3110 is begun.

An assembling note position3 3113 indexes a assembling loop-objects3 3115 within an assembling engine3 3114, and also indexes an assembling engine set3 3116. An assembling controller3 3117 sets second criteria evaluated by the assembling engine3 3114 to generate an in-progress assembling engine set3 3116, and transmits an assembling output indications3 3118. Once complete, the assembling engine set3 3116 is included within a member of the assembling set families 3122, again for example the assembling set family 3123, and another assembling engine set3 3116 is begun.

The in-progress assembling engine set1 3104 shows braces ({ }) at note position 1+1 to signify that the assembling loop-objects1 3103 is currently operating within the range of a set of notes at that position. The in-progress assembling engine set1 3104 shows "TBD" at note position 1+2 to signify that the assembling loop-objects1 3103 has not yet operated on the in-progress assembling engine set1 3104 at that position.

In this example, each member of the assembling set families 3122 includes 3 first sets of notes, and each first set of notes includes 5 musical notes. Also in this example, the assembling set families 3122 has 3 dimensions, an assembling engine1 dimension 3121, an assembling engine2 dimension 3120, and an assembling engine3 dimension 3119. For this example, the assembling engine1 dimension 3121 has cardinality 2, the assembling engine2 dimension 3120 has cardinality 3, and the assembling engine3 dimension 3119 has cardinality 4. The assembling set family 3123 is the family of sets at coordinates (1, 2, 3).

Note that in assembling the members of assembling set families 3122, the engines generate a given first set of notes multiple times, once for each family of sets which includes the first set of notes. For example, for all families of sets having the assembling engine1 dimension 3121 coordinate of 1, the families of sets also include the same assembling engine set1 3104, in this example, "G4 A4 D4 C4 E4". For families of sets having the assembling engine1 dimension 3121 coordinate of 2, the families of sets will have a different assembling engine set1 3104, not shown. Further details are provided with FIG. 41 and FIG. 42 below.

FIG. 32 thru FIG. 45, below, are block diagrams showing how a given association may apply to the plural controller example of FIG. 30. Case-by-case examples are described for each of the 3 types of first attributes described above for the exemplary plug-in computing device 0501 of FIG. 05:

Scalar first attributes, i.e. single-valued.

1 dimensional first attributes, i.e. a list of values.

2 dimensional first attributes.

In FIG. 32 thru FIG. 45, engines and controllers are not shown, and instead first sets of notes and first attributes are shown. The first attributes are included within first input indications. The second conformance evaluating functions are described in more detail in Appendix 01.

Figure 32:
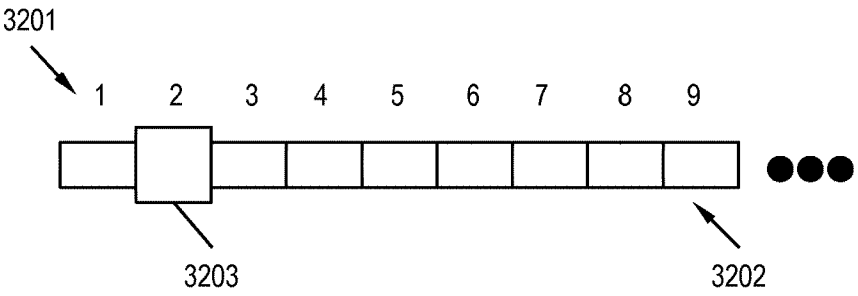
FIG. 32 is a block diagram of one scalar first attribute in the exemplary computing device.

As an example scalar first attribute, consider the maximum distance of a set of notes 0804 of FIG. 08, set to the value of 8, then refer to FIG. 32. FIG. 32 is a block diagram showing the notes of a first set of notes, and the scalar first attribute, in the context of the single controller example of FIG. 29. Again, a single scalar position 3201 shows the position of each of a multiple of single scalar engine notes 3202. A single scalar distance 3203, currently at note position 2, corresponds with evaluation of one first criteria, between Note 2 and Note 1. If the distance of a set of notes is less than or equal to the maximum distance of a set of notes specified, 8, the first set of notes conforms to the first attribute. Otherwise, the first set of notes does not conform to the first attribute.

Figure 33:
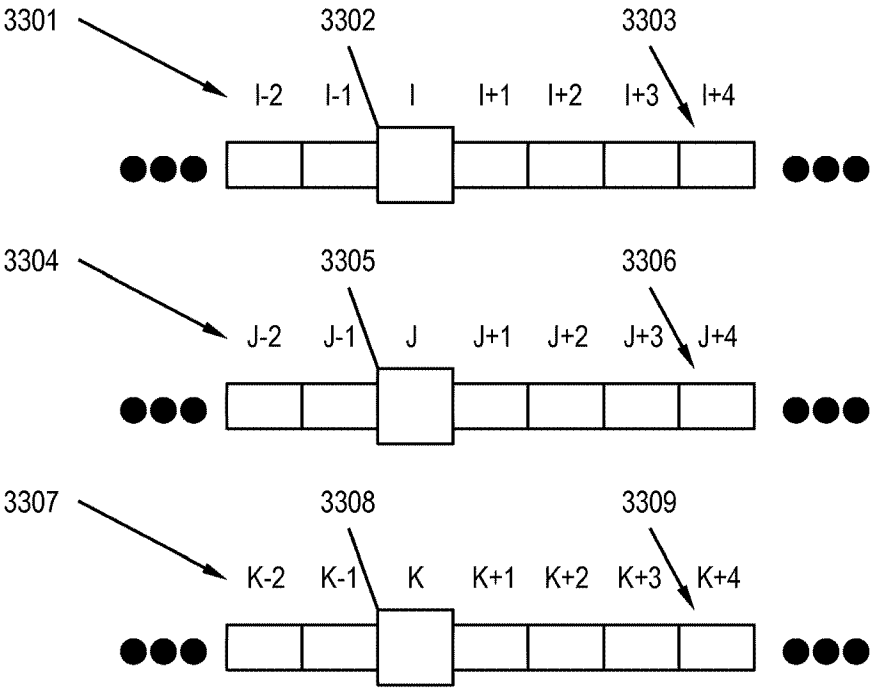
FIG. 33 is a block diagram of plural scalar first attributes in the context of the plural controller example of FIG. 30.

FIG. 33 is a block diagram of an example of plural scalar first attributes in the context of the plural controller example of FIG. 30. Again:

a scalar engine1 position 3301, a scalar engine2 position 3304 and a scalar engine3 position 3307

Each respectively shows the position of:

a scalar first set of notes1 3303, a scalar first set of notes2 3306 and a scalar first set of notes3 3309.

A scalar controller) distance 3302 corresponds with evaluation of a second criteria for the exemplary maximum distance of a set of notes of 8, between the engine 1, note I, and the engine 1, note I-1. Additional second criteria may be evaluated for the distance between the engine 1, note I, and each of the following:

The engine 2, note J−1.

The engine 2, note J.

The engine 3, note K−1.

The engine 3, note K.

Similar second criteria exist for a scalar controller2 distance 3305 and a scalar controller3 distance 3308, each with independent values.

Figure 34:
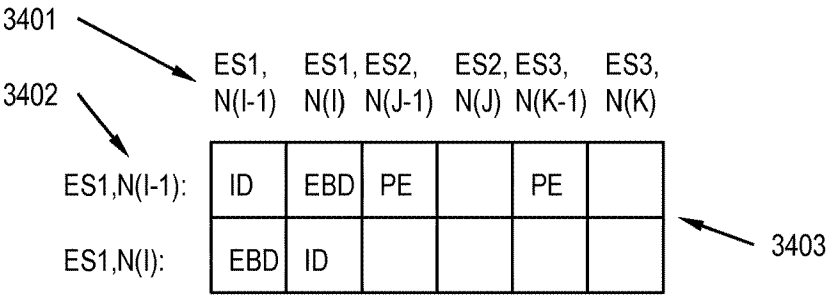
FIG. 34 is a block diagram of an example of association of a scalar first attribute with families of sets assembled with the first attributes of FIG. 33.

FIG. 34 is a block diagram of an example of association of the scalar first attribute scalar controller) distance 3302 of FIG. 33, with the families of sets assembled with the first attributes. The families of sets include first sets of notes, e.g. the assembling set family 3123 of FIG. 31.

A group of scalar comparisons 3403 is a grid of cells, one cell for each of the second criteria of the 3 engines. A group of scalar vertical coordinates 3401 and a group of scalar horizontal coordinates 3402 show the first sets of notes (ES1, ES2, ES3) and note index (I, J, K) for each cell in the grid. For each cell with no legend, one or more second input indications are made, specifically first associations, as to whether the corresponding second criteria is to be evaluated, or not. Cells with the legend "EBD" are indicated by definition of the maximum distance of a set of notes 0804 of FIG. 08, given the input of 8 for this example. However to allow complete control, an option is provided to over-ride "EBD" second criteria, and mark them for non-evaluation. Cells with the legend "ID" are identity-comparisons, resulting in the distance of a set of notes of 0, and have no relevant second criteria. Cells with the legend "PE" are the object of a prior evaluation, e.g. when the scalar controller1 distance 3302 and the scalar controller2 distance 3305 are one position to the left of the position shown.

Note that the scalar controller2 distance 3305 and the scalar controller3 distance 3308 each has its own grid of cells (not shown), analogous to the scalar comparisons 3403. This is because each controller has its own independent first attributes.

Figure 35:
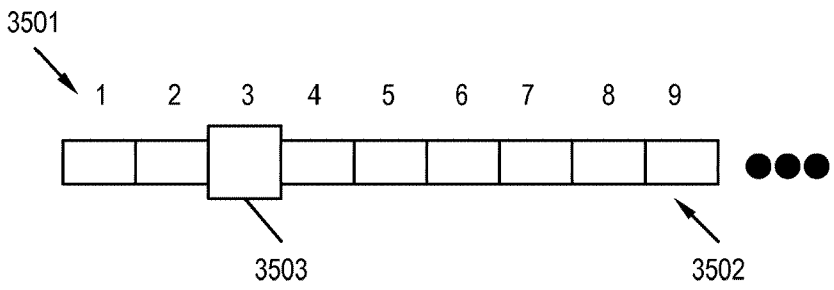
FIG. 35 is a block diagram of one 1-D first attribute in the exemplary computing device.

As an example 1 dimensional first attribute, consider the absent musical intervals 0907 of FIG. 09, then refer to FIG. 35. In this example, the note depth in time for absent intervals 0909 has been set for a depth of 2 notes. Also, 2 intervals have been set in the absent musical intervals 0907, 7:5 and 8:5. FIG. 35 is a block diagram of the first set of notes and 1 dimensional first attribute in the context of the single controller example of FIG. 29. Again, a single 1D position 3501 shows the position of each of a multiple of single 1D engine notes 3502. A single 1D intervals 3503 has 4 absent musical intervals 0907 of interest, namely:

the 7:5 interval at note depth in time of 1, the 7:5 interval at note depth in time of 2, the 8:5 interval at note depth in time of 1 and the 8:5 interval at note depth in time of 2.

The single 1D intervals 3503, currently at note position 3, corresponds with evaluation of the following 4 first criteria:

Do notes 3 and 2 form the 7:5 interval?

Do notes 3 and 1 form the 7:5 interval?

Do notes 3 and 2 form the 8:5 interval?

Do notes 3 and 1 form the 8:5 interval?

If the evaluation of any first criteria is 'yes', the first set of notes does not conform to the first attribute. Otherwise, the first set of notes conforms to the first attribute. Comparison of Notes 2 and 1 has previously occurred, when the single 1D intervals 3503 was at note position 2.

Figure 36:
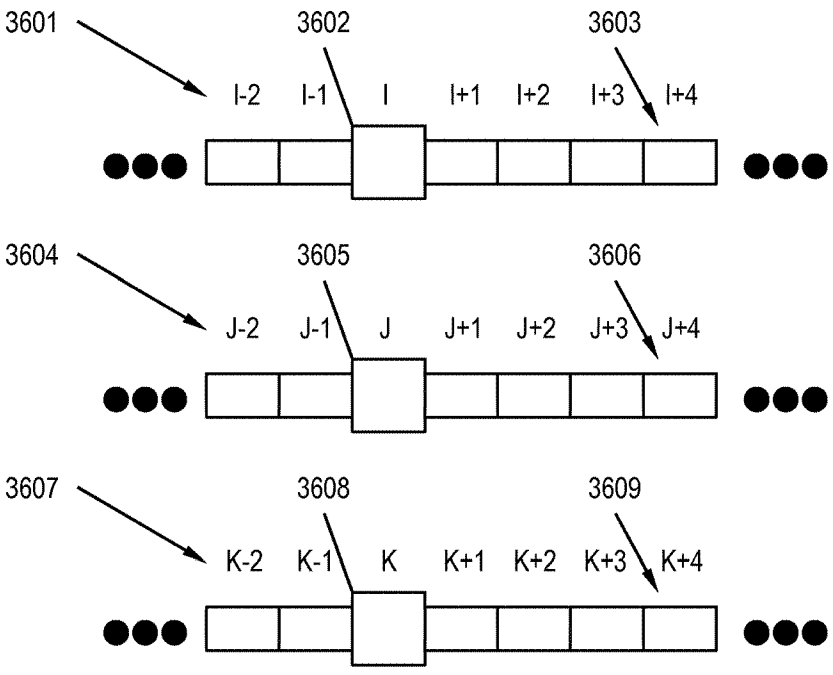
FIG. 36 is a block diagram of plural 1-D first attributes in the context of the plural controller example of FIG. 30.

FIG. 36 is a block diagram of an example of plural 1-D first attributes in the context of the plural controller example of FIG. 30. Again:

a 1-D engine1 position 3601, a 1-D engine2 position 3604 and a 1-D engine3 position 3607

Each respectively shows the position of:

a 1-D first set of notes1 3603, a 1-D first set of notes2 3606 and a 1-D first set of notes3 3609

A 1-D engine1 intervals 3602 corresponds with evaluation, first, of the following 4 second criteria:

Do the engine 1, notes I and I−1, form the 7:5 interval?

Do the engine 1, notes I and I−2, form the 7:5 interval?

Do the engine 1, notes I and I−1, form the 8:5 interval?

Do the engine 1, notes I and I−2, form the 8:5 interval?

Additional second criteria may be evaluated for the intervals between engine 1, note I, and each of the following:

The engine 2, note J.

The engine 2, note J−1.

The engine 2, note J−2.

The engine 3, note K.

The engine 3, note K−1.

The engine 3, note K−2.

Similar second criteria exist for a 1-D engine2 intervals 3605 and a 1-D engine3 intervals 3608, each with independent values.

Figure 37:
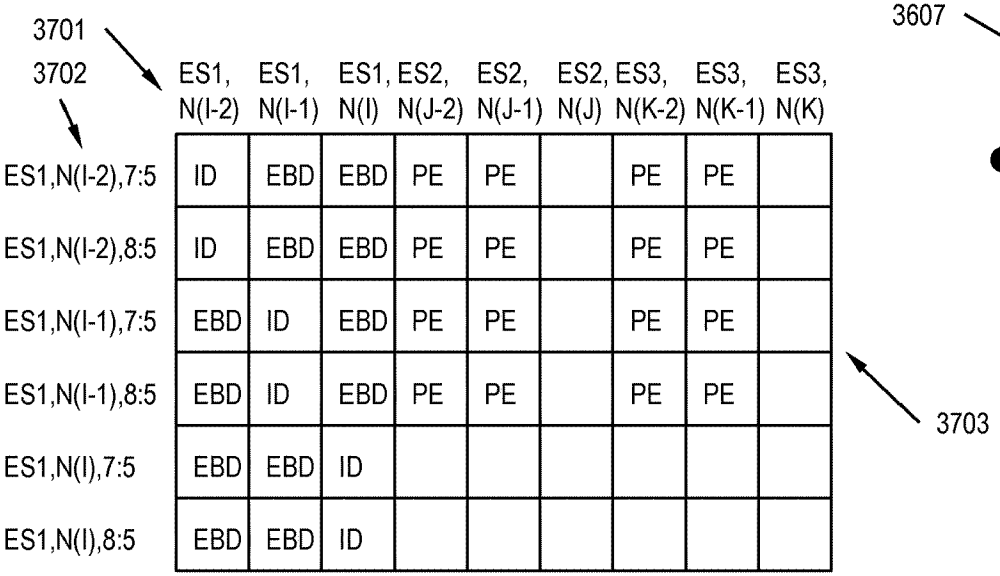
FIG. 37 is a block diagram of an example of association of a 1-D first attribute with families of sets assembled with the first attributes of FIG. 36.

FIG. 37 is a block diagram of an example of association of the 1-D first attribute 1-D engine1 intervals 3602 of FIG. 36, with the families of sets assembled with the first attributes. The families of sets include first sets of notes, e.g. the assembling set family 3123 of FIG. 31.

A group of 1-D comparisons 3703 is a grid of cells, one cell for each of the second criteria of the 3 engines. A group of 1-D vertical coordinates 3701 show the first sets of notes (ES1, ES2, ES3) and note index (I, J, K) for each column in the grid. A group of 1-D horizontal coordinates 3702 show the first sets of notes (ES1, ES2, ES3), note index (I, J, K), and interval (7:5, 8:5) for each row in the grid. Note that index factors of −1 and −2 reflect the fact that the note depth in time for absent intervals 0909 of FIG. 09 has been set to an exemplary depth of 2 notes. For each cell with no legend, one or more second input indications are made, specifically first associations, as to whether the corresponding second criteria is to be evaluated, or not. Cells with the legend "ID" are identity-comparisons, resulting in the interval 1:1, and have no relevant second criteria. Cells with the legend "EBD" are indicated by definition of the absent musical intervals 0907 of FIG. 09, given inputs for this example. As with FIG. 34, an option is provided to over-ride "EBD" second criteria, and mark them for non-evaluation. Cells with the legend "PE" are the object of a prior evaluation, e.g. when the 1-D engine1 intervals 3602 and the 1-D engine2 intervals 3605 are one position to the left of the position shown.

Note that the 1-D engine2 intervals 3605 and the 1-D engine3 intervals 3608 of FIG. 36 each has its own grid of cells (not shown), analogous to the 1-D comparisons 3703. This is because each controller has its own independent first attributes.

As an example 2 dimensional first attribute, consider the interval set presence/absence 1003 of FIG. 10, then refer to FIG. 38. In this example, a first attribute has been input for one present set of interval set presence/absence 1003, 3:2 and 4:3, in that order, with selection for either of <Interval 3a>, 6:5, or <Interval 3b>, 7:4. The nearer set positions 1004 and farther set positions 1005 have both been set to 0, so the interval set may appear at any note position. FIG. 38 is a block diagram of the first set of notes and 2 dimensional first attribute in the context of the single controller example of FIG. 29. Again, a single 2D position 3801 shows the position of each of a single 2D engine notes 3802. A single 2D intervals 3803, currently at note position 3, corresponds with evaluation of the following 2 first criteria:

Do Notes 1 and 2 form the 3:2 interval?

Do Notes 2 and 3 form the 4:3 interval?

If the evaluation of both first criteria is 'yes', the first set of notes conforms to the first attribute. Otherwise, the first set of notes does not conform to the first attribute.

FIG. 39 is a block diagram of an example of plural 2-D first attributes in the context of the plural controller example of FIG. 30. Again:

a 2-D engine1 position 3901 a 2-D engine2 position 3904 a 2-D engine3 position 3907

Each respectively shows the position of:

a 2-D first set of notes1 3903 a 2-D first set of notes2 3906 a 2-D first set of notes3 3909

A 2-D engine1 intervals 3902 corresponds with evaluation, first, of the following 2 second criteria:

Do the notes I−2 and I−1 form the 3:2 interval?

Do the notes I−1 and I form the 4:3 interval?

Additional second criteria may be evaluated for the interval values 4:3 and 3:2, between Engine 1, notes I-2, I−1, and 1, and each of the following:

The engine 2, notes J−2, J−1, and J.

The engine 3, note K−2, K−1, and K.

Second criteria also exist for a 2-D engine2 intervals 3905 and a 2-D engine3 intervals 3908, each with independent values.

FIG. 40 is a block diagram of an example of association of the 2-D first attribute 2-D engine1 intervals 3902 of FIG. 39, with the families of sets assembled with the first attributes. The families of sets include first sets of notes, e.g. the assembling set family 3123 of FIG. 31.

A 2-D comparisons 4003 is a grid of cells, one cell for each of the second criteria of the 3 engines. A group of 2-D vertical coordinates 4001 show the first sets of notes (ES1, ES2, ES3) and note index (I, J, K) for each column in the grid. A group of 2-D horizontal coordinates 4002 show the first sets of notes (ES1, ES2, ES3), note index (I, J, K), and interval (3:2, 4:3) for each row in the grid. For each cell with no legend, one or more second input indications are made, specifically first associations, as to whether the corresponding second criteria is to be evaluated, or not. Cells with the legend "ID" are identity-comparisons, resulting in the interval 1:1, and have no relevant second criteria. Cells with the legend "EBD" are indicated by definition of the interval set presence/absence 1003 inputs above, for this example. As with FIG. 34, an option is provided to over-ride "EBD" second criteria, and mark them for non-evaluation. Cells with the legend "NA" are for notes forming either of <Interval 3a> or <Interval 3b>, and are not applicable for second input indications specifying first associations. Note that unlike scalar comparisons 3403 and 1-D comparisons 3703, 2-D comparisons 4003 has no cells with the legend "PE", prior evaluation. This is because of the aspect of ordering between the 2 present intervals input to interval set presence/absence 1003, 3:2 and 4:3.

Note that the 2-D engine2 intervals 3905 and the 2-D engine3 intervals 3908 of FIG. 39 each has its own grid of cells (not shown), analogous to the 2-D comparisons 4003 of FIG. 40. This is because each controller has its own independent first attributes.

Figure 41:
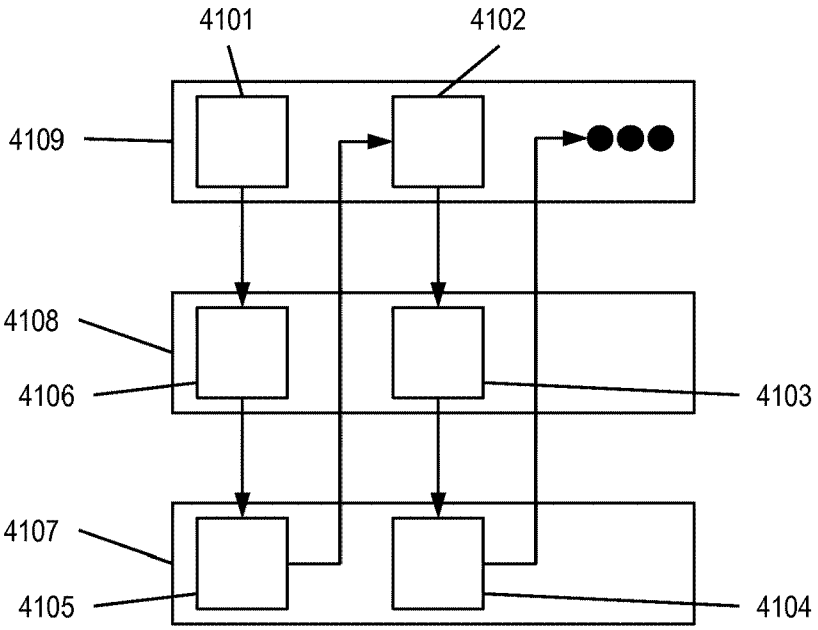
FIG. 41 is a block diagram of an example of connectivity between plural engines to assemble families of sets.

FIG. 41 is a block diagram of an example of connectivity between loop-objects of plural engines to assemble families of sets, which include first sets of notes. Assembly flow begins with a CF engine1 loop-object1 4101 of a CF engine1 4109. The CF engine1 loop-object1 4101, at note position 1, loops thru the notes within an input range of a set of notes of the lowest note 0805 and the highest note 0806 of FIG. 08, evaluating second criteria which determine conformance to one or more first associations of the CF engine1 4109's controller (not shown).

For all loop objects except the CF engine1 loop-object1 4101, the loop objects originate further evaluation of second criteria of first attributes associated with families of sets. This is described with FIG. 42. When a note meets all second criteria, assembly flows from the CF engine1 loop-object1 4101 to a CF engine2 loop-object1 4106 of a CF engine2 4108. When a note does not meet all second criteria, the CF engine1 loop-object1 4101 loops to the next note within the range of a set of notes. The CF engine2 loop-object1 4106, and a CF engine3 loop-object1 4105 of a CF engine3 4107, also loop and evaluate second criteria.

Assembly then flows from the CF engine3 loop-object1 4105 to a CF engine1 loop-object2 4102. Assembly flow also proceeds from the CF engine1 loop-object2 4102, to a CF engine2 loop-object2 4103, then to a CF engine3 loop-object2 4104. The ellipsis indicates continuation for an input size of a set of notes 0803 of FIG. 08 Completed and conforming first sets of notes are included within the members of the assembling set families 3122 of FIG. 31. Further details are provided with FIG. 43.

Figure 42:
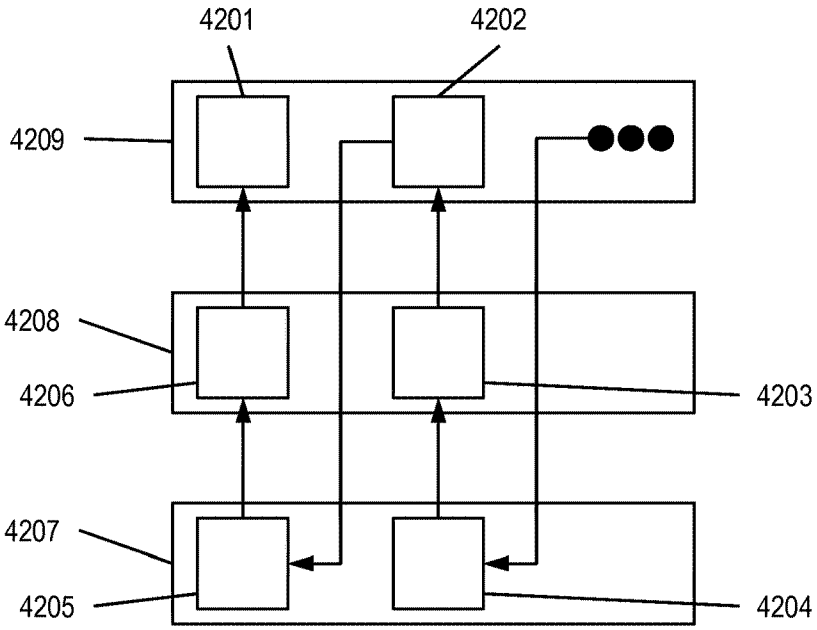
FIG. 42 is a block diagram of an example of connectivity between plural engines to determine conformance of families of sets during assembly.

FIG. 42 is a block diagram of an example of connectivity between loop-objects of plural engines to determine conformance of families of sets during assembly. The families of sets include first sets of notes. The ellipsis indicates origination from a note position further within the input size of a set of notes 0803, and evaluation flows back to an FC engine3 loop-object2 4204 of an FC engine3 4207.

The FC engine3 loop-object2 4204 evaluates second criteria to determine conformance of the family of sets being assembled to the first associations of the FC engine3 4207's controller (not shown). If any second criteria is false, an appropriate indication returns back to the originating loop-object, which then discards its current note within the range of a set of notes, and loops to its next note. If all second criteria at the FC engine3 loop-object2 4204 are true, and if the first set of notes and the current note are within scope of a prior loop-object, then evaluation flows from the FC engine3 loop-object2 4204 back to an FC engine2 loop-object2 4203 of an FC engine2 4208. The FC engine2 loop-object2 4203, and an FC engine1 loop-object2 4202 of an FC engine1 4209, also evaluate second criteria subject to scope, as do an FC engine3 loop-object1 4205, an FC engine2 loop-object1 4206, and an FC engine1 loop-object1 4201.

If all second criteria at the FC engine1 loop-object1 4201 are true, an appropriate indication returns back to the originating loop-object, which then accepts its current note within the range of a set of notes, and evaluation flows to the next loop object, as described above in FIG. 41. Completed and conforming first sets of notes are included within families of sets of the assembling set families 3122. Further details are provided with FIG. 44.

Description of Plural Process

Figure 43:
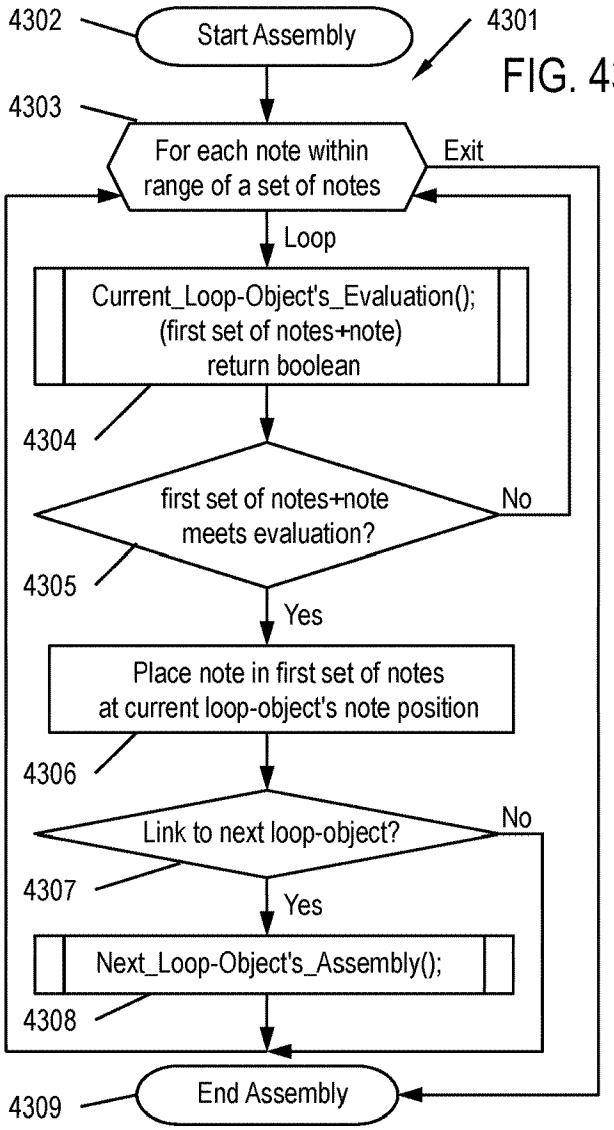
FIG. 43 is a flow chart of an exemplary process for loop-objects of plural engines assembling families of sets.

FIG. 43 is a flow chart of an exemplary process 4301 for plural loop-objects of plural engines assembling families of sets, such as the loop-objects 3103, 3109, and 3115 of FIG. 31, which include first sets of notes.

The process 4301 may begin at 4302 with the first loop-object of the first engine. Each loop-object may perform its own instance of process 4301 as described below. The process 4301 for a current loop-object may end at 4309 when assembly is completed by the loop-object for all notes within a range of a set of notes of a first attribute of the controller of the loop-object's engine. The process 4301 for all loop-objects may end at 4309 when assembly is completed by all loop-objects of the plurality of engines for all notes within a respective range of a set of notes of a first attribute of each engine's controller. Note range of a first attributes are input via the lowest note 0805 and the highest note 0806 of FIG. 08

At 4303, the process 4301 may begin a loop to process each note within the range of a set of notes of a first attribute of the controller of the current loop-object's engine.

Figure 44:
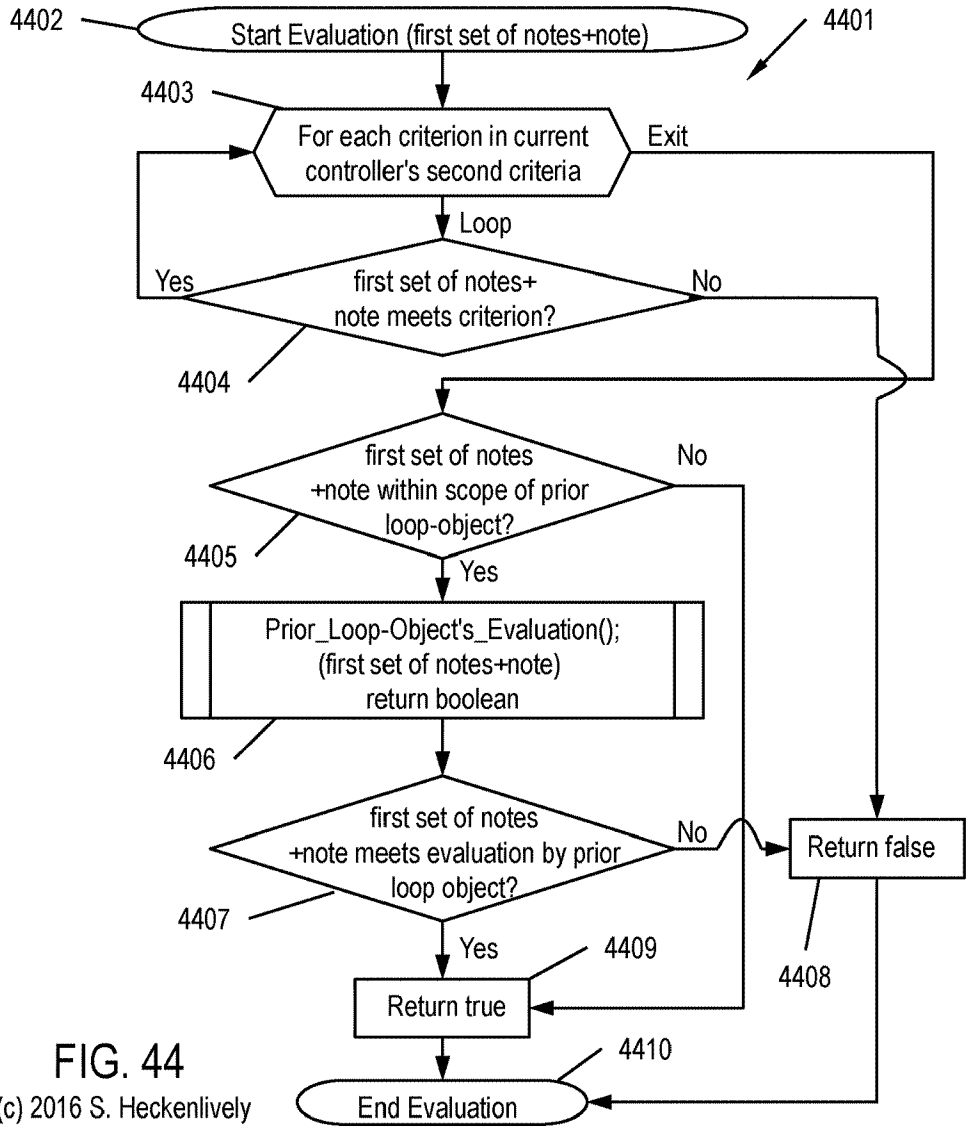
FIG. 44 is a flow chart of an exemplary process for loop-objects evaluating second criteria for plural controllers.

At 4304, the current first set of notes and current note of the current loop object may be passed to process 4401 of FIG. 44 for evaluation of second criteria.

At 4305, a determination of the result of the evaluation may be made. When the result of the evaluation is false, the loop at 4303 may continue with the next note within the range of a set of notes. When the result of the evaluation is true, at 4306 the note may be placed within the first set of notes at the current note position of the current loop-object.

At 4307, a determination may be made whether the current loop-object is linked to a next loop-object, e.g. as shown above, with the CF engine1 loop-object1 4101 of FIG. 41 linked to CF engine2 loop-object1 4106. When the current loop-object is not linked to a next loop-object, the loop at 4303 may continue with the next note within the range of a set of notes. When the current loop-object is linked to a next loop-object, at 4308 the process 4301 may continue to the next loop-object, and the next loop-object may perform its own instance of process 4301.

When the linked-to next loop-object completes it own instance of process 4301, the loop at 4303 may continue with the next note within the range of a set of notes. When the loop at 4303 completes processing of all notes within the range of a set of notes, the process 4301 for the current loop-object may end at 4309.

FIG. 44 is a flow chart of an exemplary process 4401 for plural loop-objects of plural engines evaluating second criteria for plural controllers. The second criteria are evaluated on a first set of notes and a note, provided to the process 4401. Plural engines assemble families of sets, which include one or more first sets of notes, conforming to first associations.

The process 4401 may begin at 4402 with the first loop-object of the first engine. Each loop-object may perform its own instance of process 4401 as described below. The process 4401 for a current loop-object may end at 4410 when evaluation is completed by the loop-object for all second criteria on the first set of notes and the note. The process 4401 for all loop-objects may end at 4410 when evaluation is completed by all loop-objects of the plurality of engines for which the first set of notes and the note are within scope. The scope is derived from the first associations.

At 4403, the process 4401 may begin a loop to evaluate second criteria of the controller of the current loop-object's engine.

At 4404, the current second criterion may be evaluated on the first set of notes and the note, and a determination may be made whether the first set of notes and the note conform to the association. When the first set of notes and the note do not conform to the association, the result of false may be returned at 4408, and the process 4401 for the current loop-object may end at 4410. When the first set of notes and the note do conform to the association, the loop at 4403 may continue with the next second criterion within the second criteria.

When the loop at 4403 completes evaluating second criteria of the current loop object's controller, at 4405 a determination may be made whether the first set of notes and the note are within scope of a prior loop-object. When the first set of notes and the note are not within scope of a prior loop-object, the result of true may be returned at 4409, and the process 4401 for the current loop-object may end at 4410. When the first set of notes and the note are within scope of a prior loop-object, at 4406 the process 4401 may continue to the prior loop-object, and the prior loop-object may perform its own instance of process 4401. The continuation to a prior loop-object is shown above, e.g. from the FC engine3 loop-object2 4204 of FIG. 42 to the FC engine2 loop-object2 4203.

At 4407, a determination of the result of the evaluation by the prior loop-object may be made. When the evaluation is false, the result of false may be returned at 4408, and the process 4401 for the current loop-object may end at 4410. When the evaluation is true, the result of true may be returned at 4409, and the process 4401 for the current loop-object may end at 4410.

Description of Process Using Plural Engines

As described above, harmony as well as melody may be generated by using plural engines, i.e. multiple voices in polyphony. Each engine creates one or more first sets of notes. Consider an example outlined by the following workflow:

1) Create a melody using 1 engine.
2) At a later time, create harmony for that melody using plural engines.

The plural controller example of FIG. 30 enables this by the following steps:

1 a) Create a melody using 1 engine.
1b) Save the first set of notes for that melody to a storage device.
2a) Subsequently, read the saved melody, as a third set of notes of a first attribute, for the output for 1 engine, among plural engines.
2b) Create harmony for that melody using the plural engines.

At step 2b), one or more first attributes may be defined which inter-relate first sets of notes generated by the harmony engines, with the previously defined melody's first set of notes. Definition of the first attributes follows the above description of the plural controller example. Furthermore, in other examples, recital of previously defined first sets of notes may be extended to plural previously defined first sets of notes, and plural engines.

Figure 45:
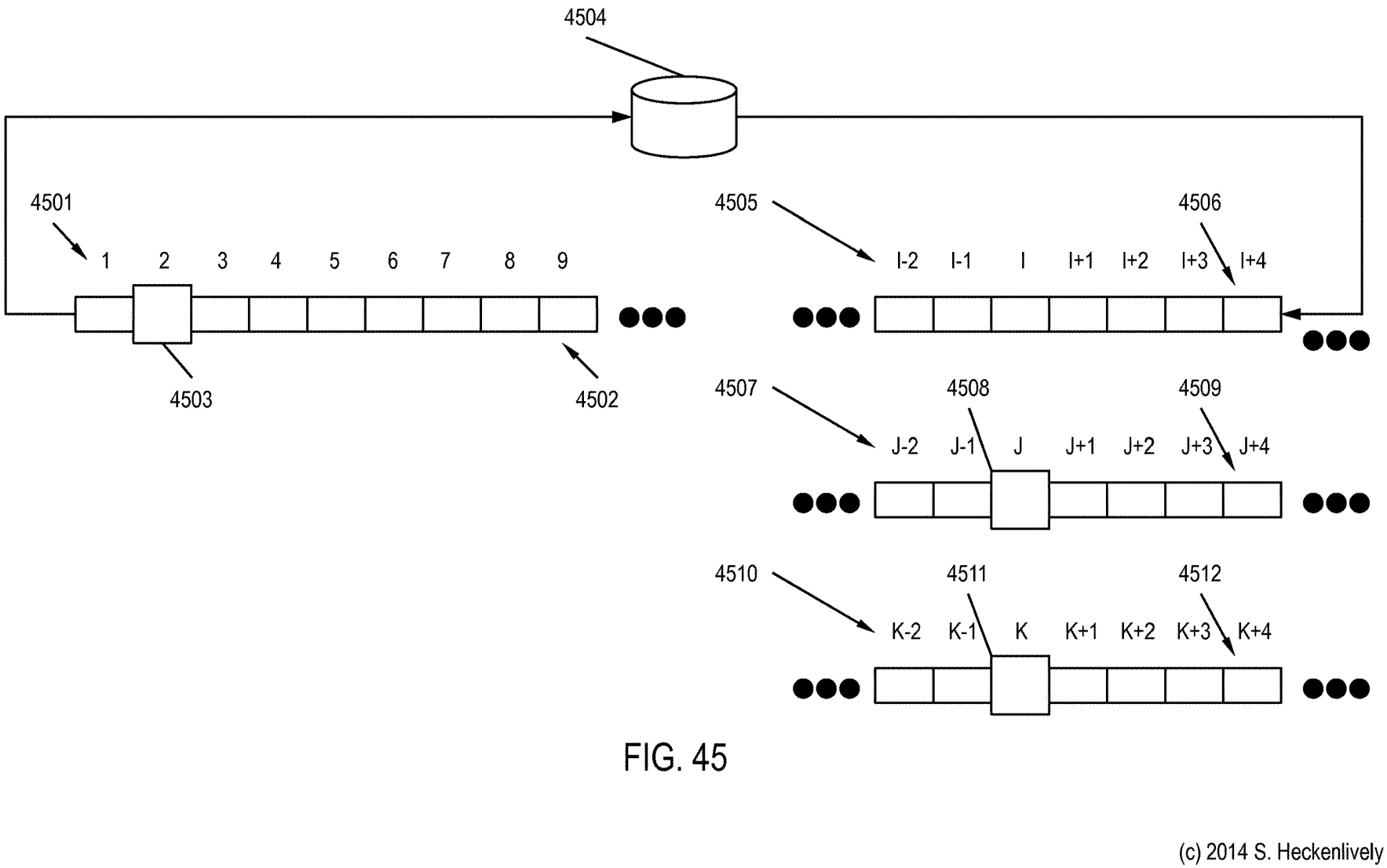
FIG. 45 is a block diagram of an example of creation of a melody using 1 engine, then the creation of harmony for that melody, in the context of the plural controller example of FIG. 30.

FIG. 45 is a block diagram of an example of creation of a melody using 1 engine, then the subsequent creation of harmony for that melody, in the context of the plural controller example of FIG. 30. In FIG. 45, first attribute sets are described, and not individual first attributes. A melody position 4501 shows the position of each of a melody engine notes 4502. A set of melody first attributes 4503 are applied at each Note Position until the entire melody is completed. The first set of notes included within the melody is then saved to a melody storage device 4504.

Subsequently, the first set of notes included within the melody is read from the melody storage device 4504, and recited as a predefined first set of notes1 4506. Referring to FIG. 04 and FIG. 05, the flow of the melody's first set of notes is the read MIDI file 0407-->(via the device musical data transferring device 0514)-->the device controller 0525-->the device engine 0522. In this example, the melody's first set of notes flows to a first attribute input-indication of the device controller 0525, specifically a third set of notes, and is recited by the device engine 0522.

Referring back to FIG. 45, again:

a predefined position 4505
a harmony engine2 position 4507
a harmony engine3 position 4510

Each respectively shows the position of:

a predefined first set of notes1 4506
a harmony first set of notes2 4509
a harmony first set of notes3 4512

A set of harmony engine2 first attributes 4508 and a set of harmony engine3 first attributes 4511 are then associated with the families of sets for the three engines, as described above for FIG. 34, FIG. 37, and FIG. 40. Note that the intermediate use of the melody storage device 4504 is exemplary, and that in other examples, a melody may be created using engine 1, and harmony may be created contemporaneously using engines 2 and 3.

Description of Alternative Apparatus.

In the examples of FIG. 08 thru 45, the music yielding devices generate first sets of notes on-demand. FIG. 46 thru FIG. 60 are block diagrams of an exemplary database which may be suitable for the system music yielding device 0212 of FIG. 02.

In this example, the pre-existing first sets of notes have an exemplary value of 7 for size of a set of notes 0803 of FIG. 08, and are stored in the database. Also, a prerequisite is imposed upon the pre-existing first sets of notes, in that the maximum distance between 2 notes is 12. Therefore the intervals present in the first sets of notes are within a range of 13 values, 1:1 thru 2:1. The interval 1:1 has only 1 note direction, "same", while the remaining 12 intervals, 16:15 thru 2:1, each have 2 possible note directions, "up" or "down". Notating "up" and "down" as "+" and "−", respectively, and merging the aspects of direction and interval, there are 12 "+" intervals, 12 "−" intervals, and 1 "same" interval, for a total of 25. We refer to these below as "signed intervals". In this example, the pre-existing first sets of notes are encoded in the database as signed interval sets. For the exemplary first sets of notes containing 7 notes, the maximum number of possible unique interval values, unsigned, within any generated first set of notes, is 6. The total number of stored encoded first sets of notes is 25^6.

Figure 46:
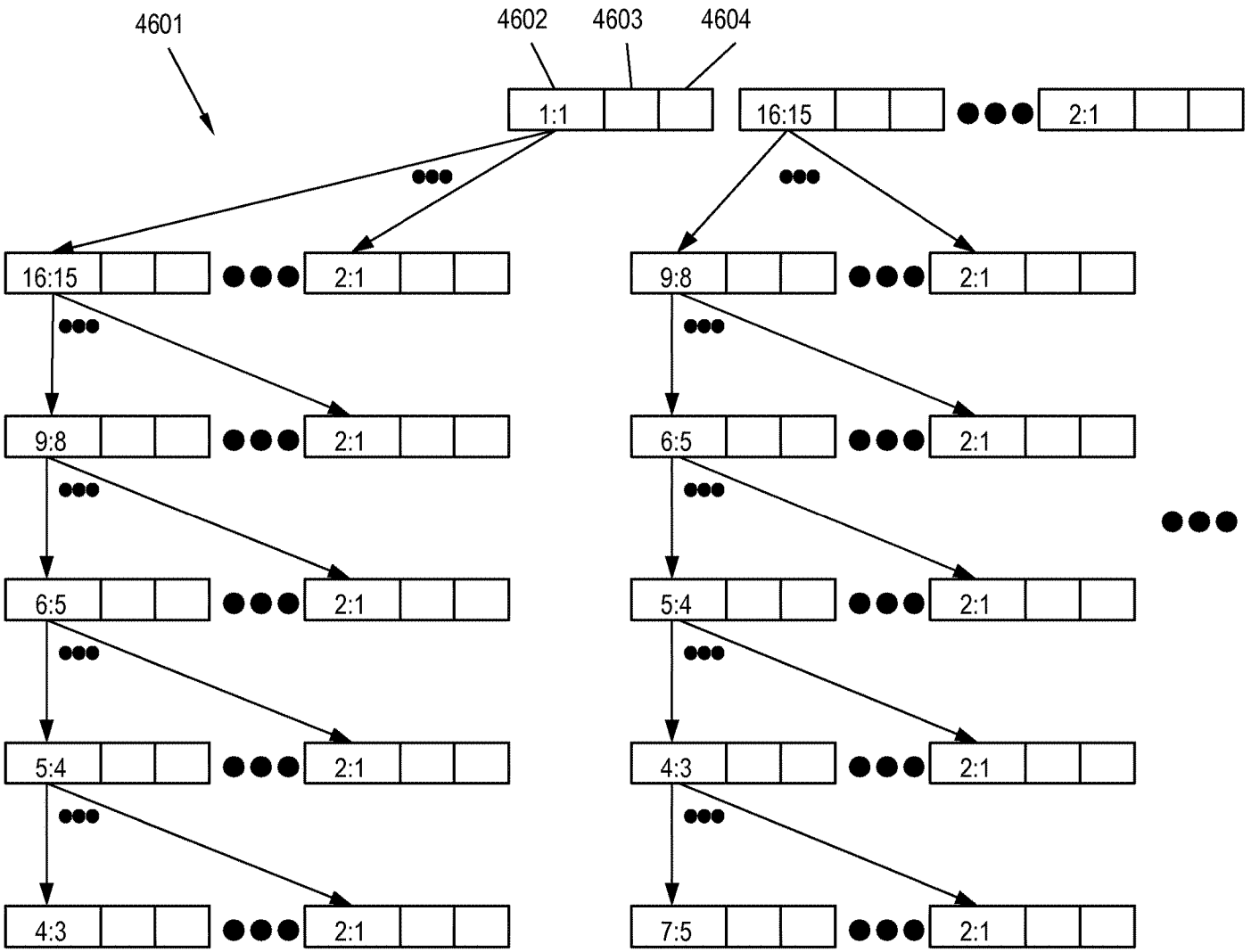
FIG. 46 is a block diagram of the first portion of an exemplary database.

FIG. 46 is a block diagram of the first portion of an exemplary database. A root trie 4601 is a 6-level trie data structure at the top of the database hierarchy of datastructures. Each node in the root trie 4601 includes an interval 4602, an absent intervals characteristic vector 4603, a link to note direction index table 4604, and zero or more links to nodes at the succeeding level.

The nodes at the first level of the root trie 4601 are organized left to right by ascending interval 4602 distance, i.e 1:1, 16:15, 9:8, etc. Each respective node at the first level includes zero or more links to a group of nodes at the second level. The linked-to nodes in the group each have an interval 4602 distance greater than the linked-from node, and the group is organized left to right by ascending interval 4602 distance. Each node at levels 2 thru 5 is linked to a group of nodes at the subsequent level. The interval 2:1 has the greatest interval distance, and nodes with interval 4602 of 2:1 have zero links to subsequent nodes. All the descendants of a node have a common prefix of the intervals upon the path to that node. Ellipses indicate that only a subset of the nodes and links of the root trie 4601 are shown. However it should be understood the root trie 4601 is fully populated, as described above.

The absent intervals characteristic vector 4603 of each node is a sorted list of unique interval values, known to be absent, for a path terminating at that node. An absent intervals characteristic vector 4603 is referred to below as an AICV. Each link to note direction index table 4604 links to a note direction index table 4701 of FIG. 47.

Figure 47:
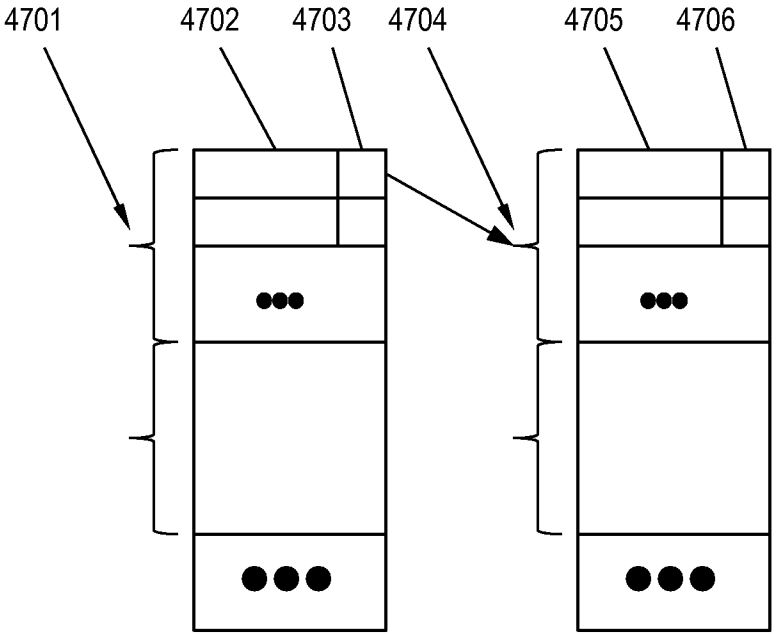
FIG. 47 is a block diagram of the second portion of the exemplary database.

FIG. 47 is a block diagram of the second portion of the exemplary database. The note direction index tables 4701 include multiple rows, each row including a note direction characteristic vector 4702 and a link to note topology index table 4703.

The note direction characteristic vector 4702 is a base-3 6-digit value. Recall that a note direction can have one of 3 possible values, and the exemplary 7-note first sets of notes have 6 note directions. Each link to note topology index table 4703 links to a note topology index table 4704.

The note topology index tables 4704 include multiple rows, each row including a note topology characteristic vector 4705 and a link to interval position trie 4706.

The note topology characteristic vector 4705 is a numeric value in the range of 1 to 7-factorial. Recall that the exemplary 7-note first sets of notes have 7 possible note topology values, 1, 2, 3, 4, 5, 6, 7, respectively. Calculation of a note topology characteristic vector 4705 is analogous to calculating an address in a multi-dimensional array of dimensions [1][2][3][4][5][6][7]. Each link to interval position trie 4706 links to an interval position trie 4801 of FIG. 48.

Figure 48:
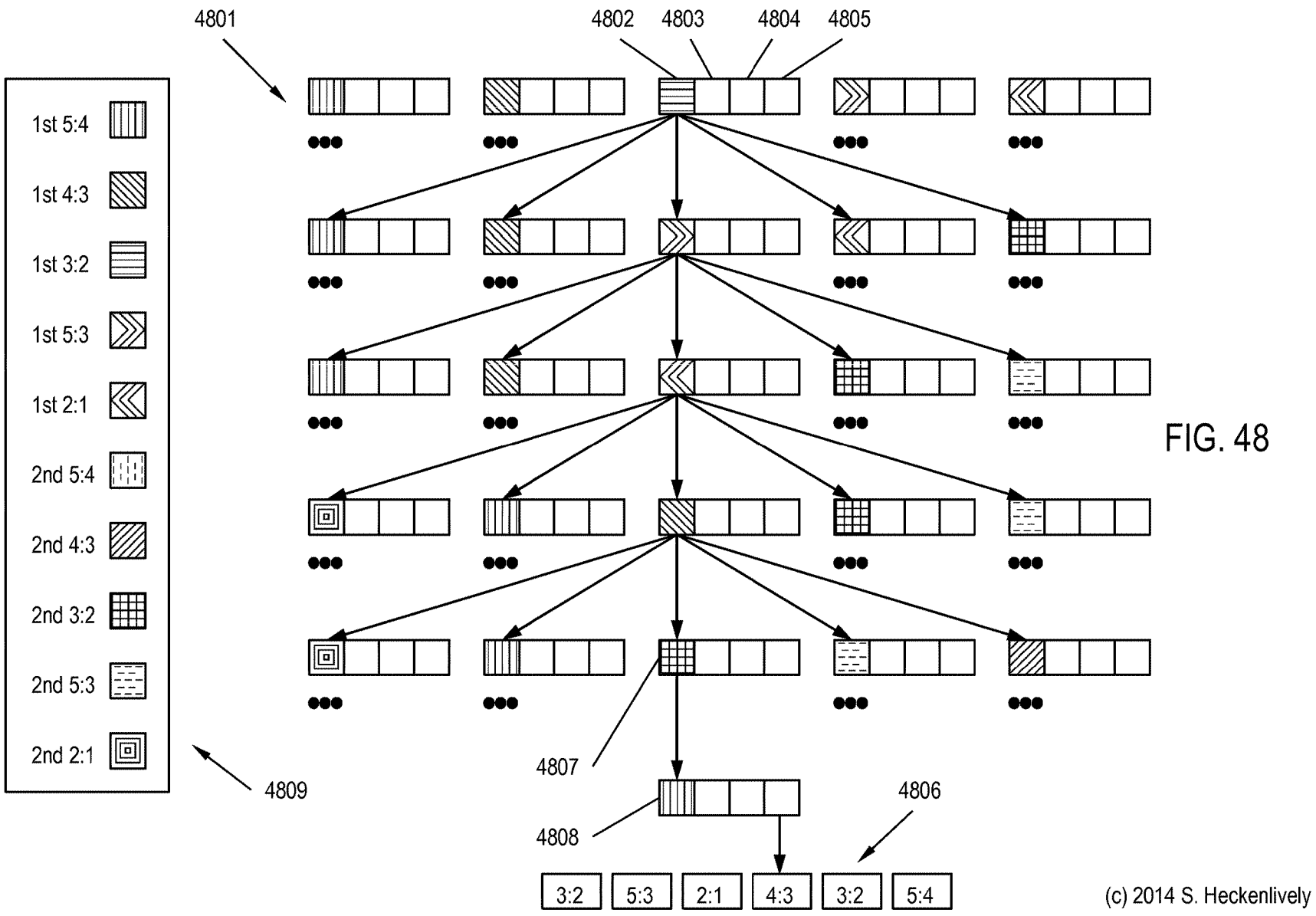
FIG. 48 is a block diagram of the third portion of the exemplary database.

FIG. 48 is a block diagram of the third portion of the exemplary database. The interval position trie 4801 is a 6-level trie data structure storing positional information of signed interval sets. Each node in the interval position trie 4801 includes an encoded interval 4802, a contiguity flag 4803, a quota flag 4804, a link to signed interval sets 4805, and zero or more links to nodes at the succeeding level.

A given interval value, e.g. 3:2, can occur at more than one possible interval position. Therefore each interval instance in the signed interval set is encoded with an interval code table 4809, associated with the interval position trie 4801. In the exemplary interval position trie 4801, there are 5 interval values, known from the path thru the root trie 4601 of FIG. 46 which led to the interval position trie 4801. The 5 exemplary interval values are 5:4, 4:3, 3:2, 5:3, and 2:1. Each interval value is known to occur once, and may occur a second time, for a total of 10 possible interval instances, and 10 entries in the interval code table 4809. In this example, interval instances are encoded as colors, for ease of explanation. The interval code table 4809 is sorted by instance, e.g first instance before second instance, and by ascending interval distance, e.g. 5:4 before 4:3.

The interval position trie 4801 contains 1 level for each of the corresponding 6 interval positions within the signed interval sets. For each node on a given path thru the interval position trie 4801, the links to the nodes at the next level are determined by the remaining possible interval instances which have not appeared on that path. Each of the 5 known interval values must appear at least once on a full path thru the interval position trie 4801. A second instance of an interval value can only appear after its first appearance, and second instances do not appear at level 1. Links on partial paths show the possible interval instances for a given originating node shown in the interval position trie 4801.

Each link to signed interval sets 4805 links to storage for one or more signed interval sets, e.g. the interval set 4806. The contiguity flag 4803 and quota flag 4804 are described below with FIG. 52 thru FIG. 60.

One full path thru the interval position trie 4801 is shown, for an exemplary interval set 4806, which includes a first 3:2, a 5:3, a 2:1, a 4:3, a second 3:2, and a 5:4. The second 3:2 at level 5 4807 is shown with a necessary link to level 6, i.e. the link to include a first 5:4 4808 upon the full path.

Ellipses indicate that only a subset of the nodes and links of the interval position trie 4801 are shown. However it should be understood the interval position trie 4801 is fully populated, as described above.

Three additional datastructures, not shown, are associated with each interval position trie 4801. These datastructures are the link-traversal table, the checklist, and the semaphore table.

The link-traversal table, referred to below as the LT table, is a 3-dimensional array of boolean flags, one flag for each of the possible interval-pairs among the maximum of 6 intervals present in the interval position trie 4801, at the 5 possible interval positions. Interval values are sorted and encoded as integers. A row of the LT table is indexed by the encoded interval value of a parent node. A column of the LT table is indexed by the encoded interval value of a child node linked to by the parent. A level of the LT table is indexed by the level, i.e. interval position, of the pair within the interval position trie 4801. The LT table and its associated functions are described in Appendix 09.

The checklist is a 4-dimensional array of cells, one cell for each of the possible interval-triplets among the maximum of 6 intervals present in the interval position trie 4801, at the 5 possible interval positions Interval values are sorted and encoded as integers. A row of the checklist is indexed by the interval position of a parent node. A column of the checklist is indexed by the numeric values 1 and 2, corresponding to 2 possibilities for interval 3a and interval 3b in the interval set presence/absence 1003. The 3rd and 4th dimensions of the checklist are indexed by the encoded first and second interval values of the triplet. The checklist and its associated functions are described in Appendix 09.

The semaphore table is a 1-dimensional array of semaphores, one semaphore for each of the possible interval values among the maximum of 6 intervals present in the interval position trie 4801. Interval values are sorted and encoded as integers. The semaphore table is indexed by the encoded interval values. Each semaphore is a counting semaphore, initialized to the maximum number of instances possible in the interval position trie 4801. In the exemplary interval position trie 4801 of FIG. 48, the initial value for each semaphore is 2.

Description of Processes With Alternative Apparatus

Figure 49:
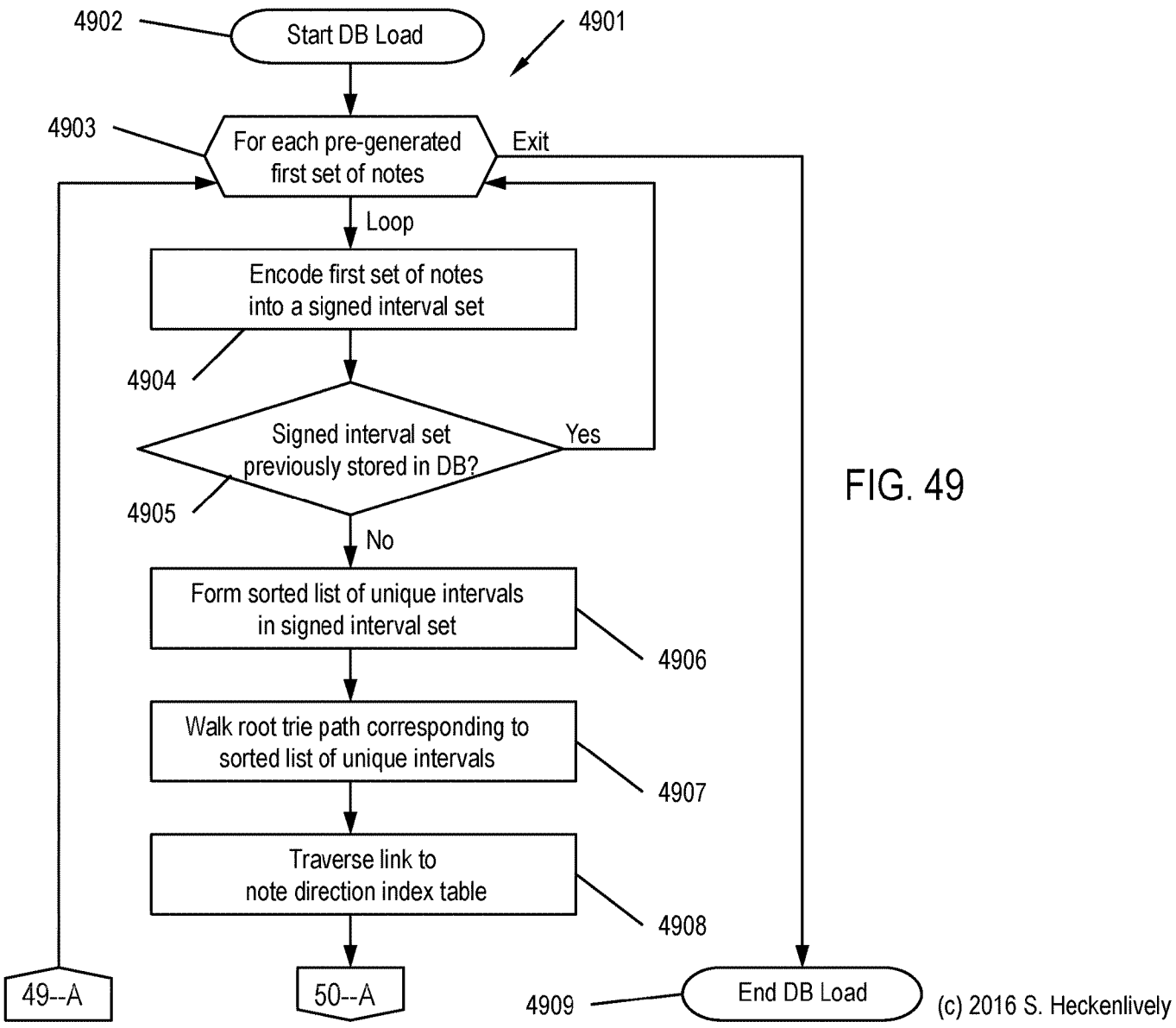
FIG. 49 is the first portion of a flow chart of an exemplary process for loading pre-existing first sets of notes into the exemplary database.
Figure 50:
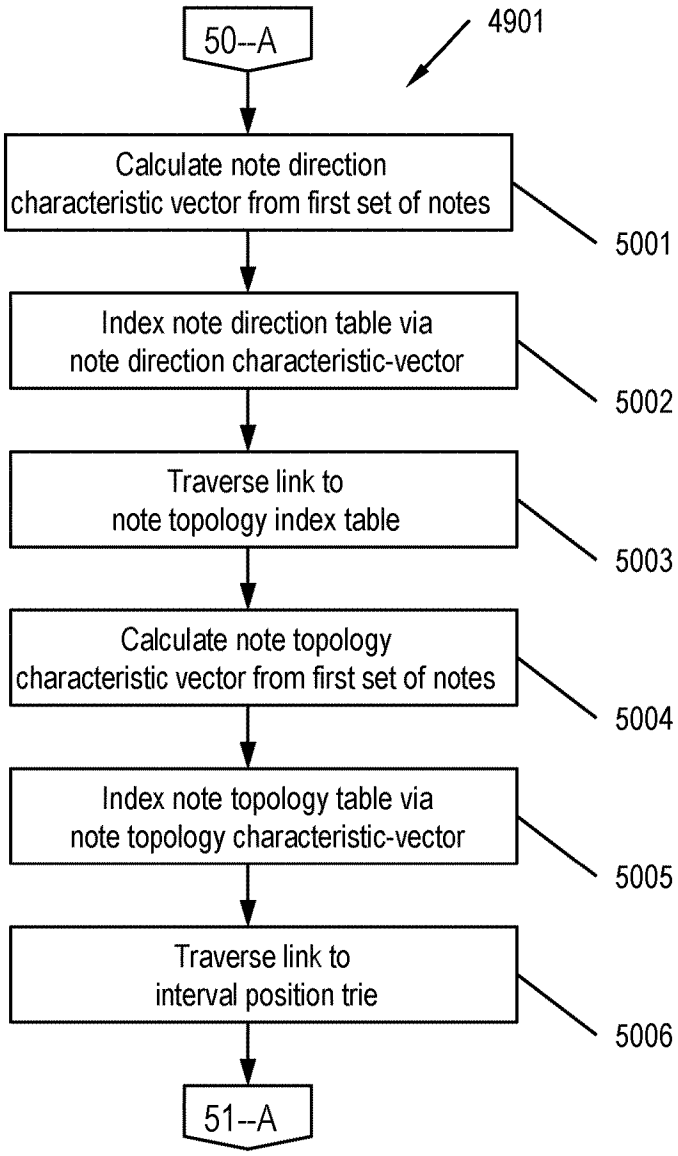
FIG. 50 is the second portion of the flow chart of the exemplary process for loading pre-existing first sets of notes into the exemplary database.
Figure 51:
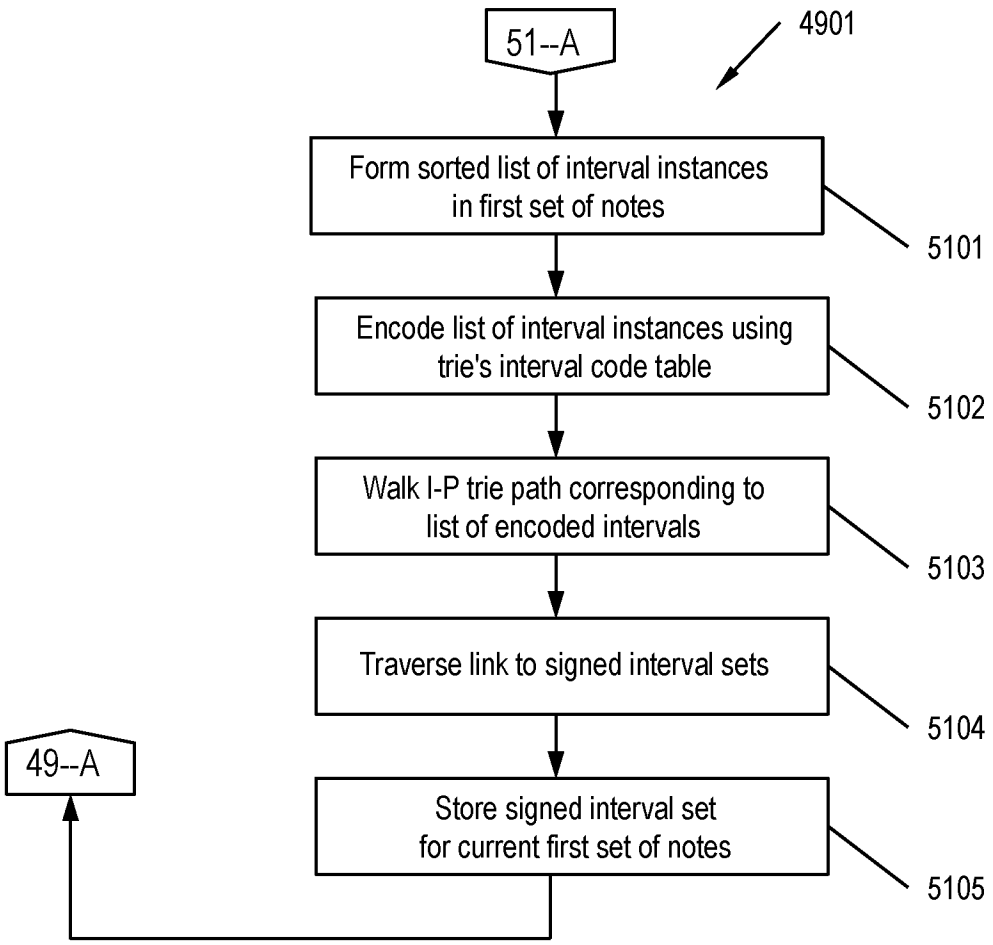
FIG. 51 is the third portion of the flow chart of the exemplary process for loading pre-existing first sets of notes into the exemplary database.

FIG. 49 thru FIG. 51 are a flow chart 4901 of an exemplary process for loading pre-existing first sets of notes into the exemplary database of FIG. 46 thru 48. The process 4901 may be suitable for the system music yielding device 0212 of FIG. 02.

The process 4901 may begin at 4902 when the first pre-existing first set of notes is to be loaded into the database, and may end at 4909 when the last pre-existing first set of notes has been loaded into the database.

At 4903 process 4901 may begin a loop to load each of the pre-existing first sets of notes into the database.

At 4904, the exemplary 7 notes of the first set of notes may be encoded into a signed interval set, where the note direction "up" may be "+", "down" may be "−", and "same" may be an aspect of the interval 1:1.

At 4905, a determination may be made whether the signed interval set has been previously stored in the database, i.e. the notes of the current first set of notes are a transposition of the notes of a previous first set of notes. When the signed interval set has been previously stored in the database, the loop at 4903 may continue with the next generated first set of notes.

At 4906, a sorted list may be formed of the unique interval values in the signed interval set, in ascending interval distance.

At 4907, a path thru the root trie 4601 of FIG. 46 may be walked, corresponding to the sorted list of unique interval values. The number of nodes in the path equals the number of unique intervals in the list.

At 4908, the current node's link to note direction index table 4604 may be traversed to a note direction index table 4701 of FIG. 47, and the process 4901 may continue at 5001 of FIG. 50.

When the loop at 4903 has loaded the last pre-existing first set of notes into the database, the process 4901 may end at 4909.

Referring now to FIG. 50, at 5001, a note direction characteristic vector 4702 of FIG. 47 may be calculated, as a base-3 6-digit value, from the first set of notes.

At 5002, the note direction index table 4701 of FIG. 47 may be indexed via the note direction characteristic vector 4702.

At 5003, the current row's link to a note topology index table 4703 of FIG. 47 may be traversed to the note topology index table 4704 of FIG. 47.

At 5004, a note topology characteristic vector 4705 of FIG. 47 may be calculated, as a numeric value in the range of 1 to 7-factorial.

At 5005, the note topology index table 4704 of FIG. 47 may be indexed via the note topology characteristic vector 4705.

At 5006, the current row's link to interval position trie 4706 of FIG. 47 may be traversed to an interval position trie 4801 of FIG. 48, and the process 4901 may continue at 5101 of FIG. 51.

Referring now to FIG. 51, at 5101, a list may be formed of the interval instances in the first set of notes, sorted by instance, e.g first instance before second instance, and by ascending interval distance, e.g. 5:4 before 4:3.

At 5102, the sorted list of interval instances may be encoded using the interval position trie 4801's interval code table 4809 of FIG. 48.

At 5103, a path thru the interval position trie 4801 of FIG. 48 may be walked, corresponding to the sorted list of interval instances.

At 5104, the current node's link to signed interval sets 4805 may be traversed to a storage for one or more signed interval sets.

At 5105, the signed interval set for this first set of notes may be stored, the process 4901 may continue at 4903 of FIG. 49, and the loop at 4903 may continue with the next generated first set of notes.

FIG. 52 thru FIG. 60 are a flow chart 5201 of an exemplary process for retrieving first sets of notes from the exemplary database of FIG. 46 thru 48. The process 5201 may be suitable for the system controller 0202 of FIG. 02.

The process 5201 may begin at 5202 when one or more first attribute inputs have been received for first sets of notes to be retrieved from the database, and may end at 6005 when all the first sets of notes conforming to the first attributes have been retrieved from the database, decoded into first sets of notes, and output.

At 5203 a sorted list may be formed of the unique interval values in the present musical intervals 0906 of the first attribute inputs of FIG. 09, and the interval set presence/absence 1003 of the first attribute inputs of FIG. 10, (PCSI in the flow chart).

At 5204 the process 5201 may begin a loop for each node of a left-most, depth-first walk of the root trie 4601 of FIG. 46.

At 5205 a determination may be made whether all the intervals in the sorted list are on the current sub-path. Note that when the sorted list is null, i.e. the present interval inputs are null, then this determination results in true for all sub-paths. When all the intervals in the sorted list are on the current sub-path, at 5206 a determination may be made whether the AICV of the current node is equal to, or a superset of, the absent musical intervals 0907 of the first attribute input of FIG. 09.

Figure 53:
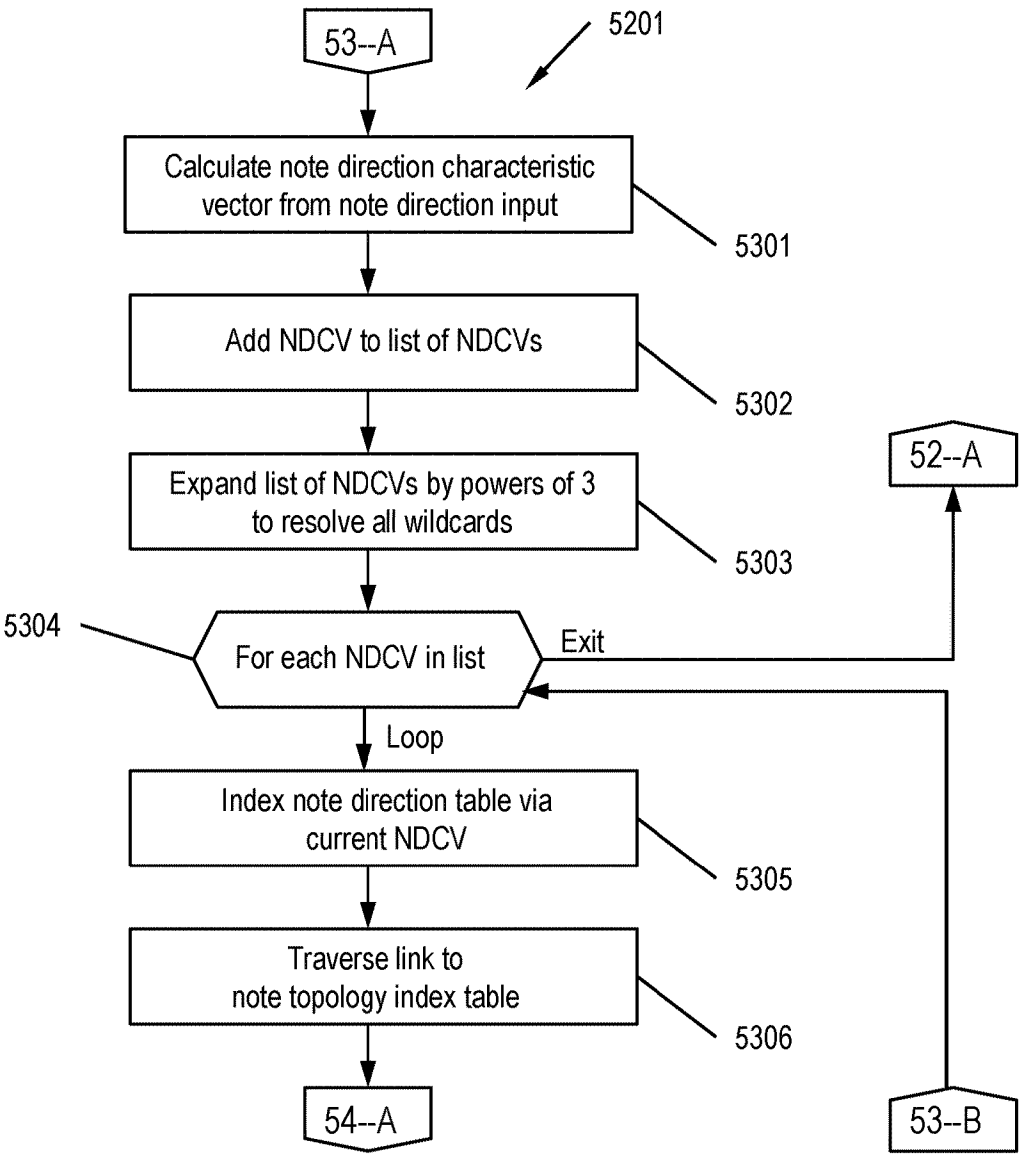
FIG. 53 is the second portion of the flow chart of the exemplary process for retrieving first sets of notes from the exemplary database.

When the AICV of the current node is equal to, or a superset of, the absent musical intervals 0907, at 5207 the current node's link to note direction index table 4604 to a note direction index table 4701 of FIG. 47 may be traversed, and the process 5201 may continue at 5301 of FIG. 53. When the AICV of the current node is not equal to, nor a superset of, the absent musical intervals 0907, at 5210 the walk may backtrack from the current node, and the loop at 5204 may continue with the next node of the walk.

Referring back to the determination at 5205, when all the intervals in the sorted list are not on the current sub-path, at 5208 the least missing interval on the current sub-path may be calculated.

At 5209 at determination may be made whether the interval of the current node is greater than the least missing interval. When the interval of the current node is greater than the least missing interval, at 5210 the walk may backtrack from the current node, and the loop at 5204 may continue with the next node of the walk. When the interval of the current node is not greater than the least missing interval, at 5211 the walk may continue from the current node, and the loop at 5204 may continue with the next node of the walk.

Figure 60:
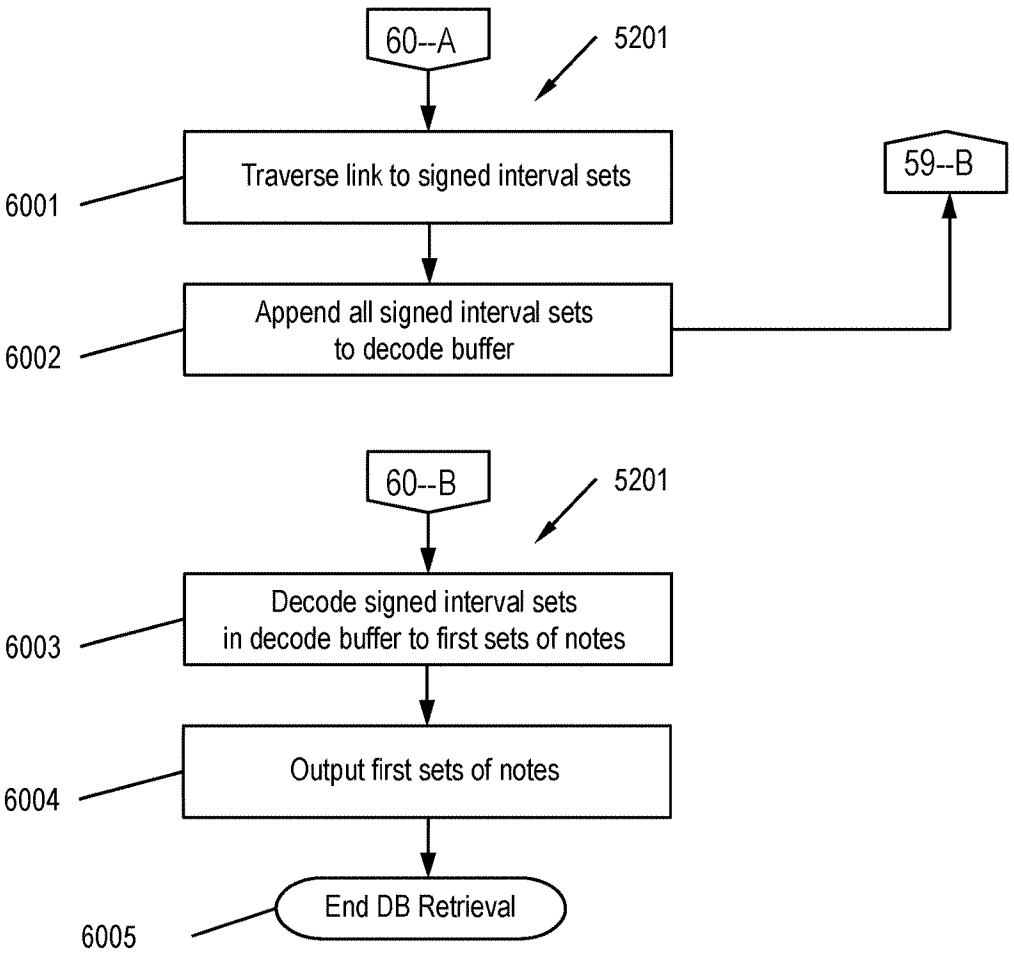
FIG. 60 is the ninth portion of the flow chart of the exemplary process for retrieving first sets of notes from the exemplary database.

When the loop at 5204 has completed for each node of the left-most, depth-first walk of the root trie 4601 of FIG. 46, the loop may exit, and the process 5201 may continue at 6003 of FIG. 60.

Referring now to FIG. 53, at 5301 a note direction characteristic vector may be calculated from the note directions 0902 of the first attribute inputs of FIG. 09. A note direction characteristic vector is referred to as an NDCV below. An NDCV may be a 6-digit base-3 number, where the 3 note directions of "Up", "Down", and "Same" are encoded as a base-3 digit. An input of "Any" at zero or more positions of note directions 0902 is encoded as a wild-card.

At 5302 the NDCV may be added as an initial member to a list of NDCVs.

At 5303 the list of NDCVs may be expanded by powers of 3 to resolve all wild-cards in the NDCVs of the list.

At 5304 the process 5201 may begin a loop for each NDCV in the list.

At 5305 a row of the current note direction index table 4701 of FIG. 47 may be indexed via the current NDCV.

Figure 54:
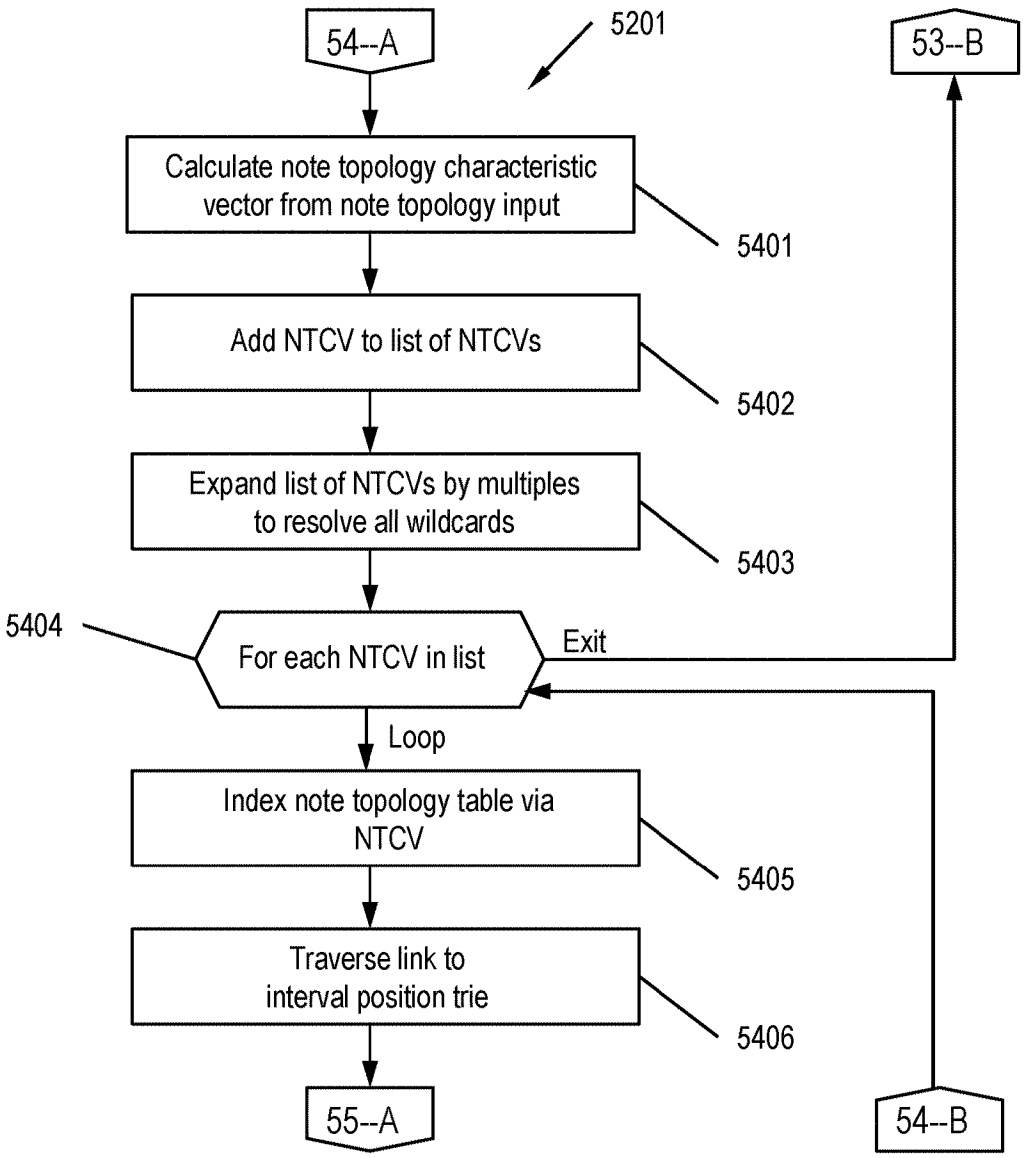
FIG. 54 is the third portion of the flow chart of the exemplary process for retrieving first sets of notes from the exemplary database.

At 5306 the current row's link to note topology index table 4703 of FIG. 47 may be traversed to a note topology index table 4704 of FIG. 47, and the process 5201 may continue at 5401 of FIG. 54.

Figure 52:
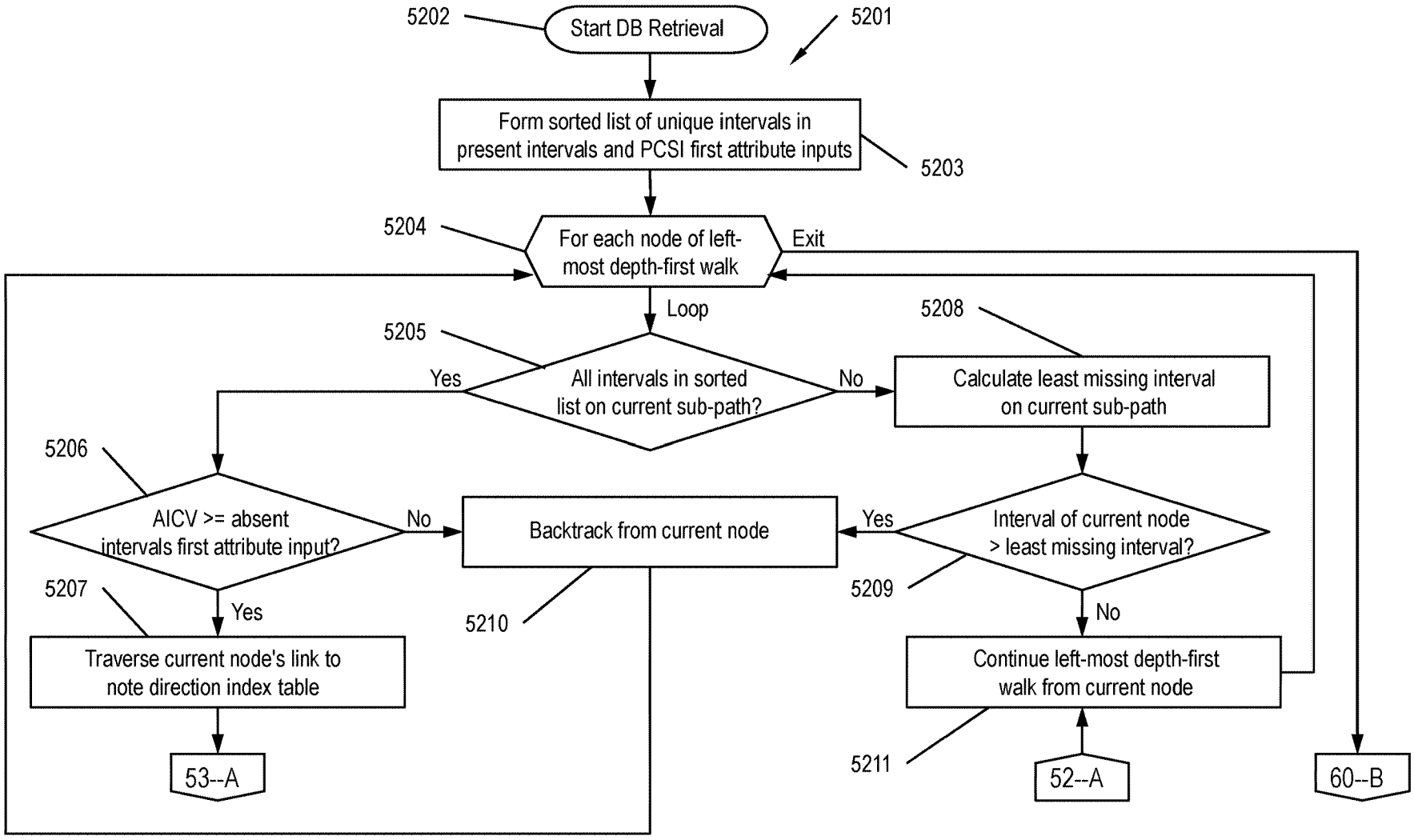
FIG. 52 is the first portion of a flow chart of an exemplary process for retrieving first sets of notes from the exemplary database.

When the loop at 5304 has completed for each NDCV in the list, the loop may exit, and the process 5201 may continue at 5211 of FIG. 52.

Referring now to FIG. 54, at 5401 a note topology characteristic vector may be calculated from the note topology 0903 of the first attribute inputs of FIG. 09. A note topology characteristic vector is referred to as an NTCV below. An NTCV may be a numeric value in the range of 1 to 7-factorial. An input of "Any" at zero or more positions of note topology 0903 is encoded as a wild-card.

At 5402 the NTCV may be added as an initial member to a list of NTCVs.

At 5403 the list of NTCVs may be expanded by multiples to resolve all wild-cards in the NTCVs of the list.

At 5404 the process 5201 may begin a loop for each NTCV in the list.

At 5405 a row of the current link to note topology index table 4703 of FIG. 47 may be indexed via the current NTCV.

Figure 55:
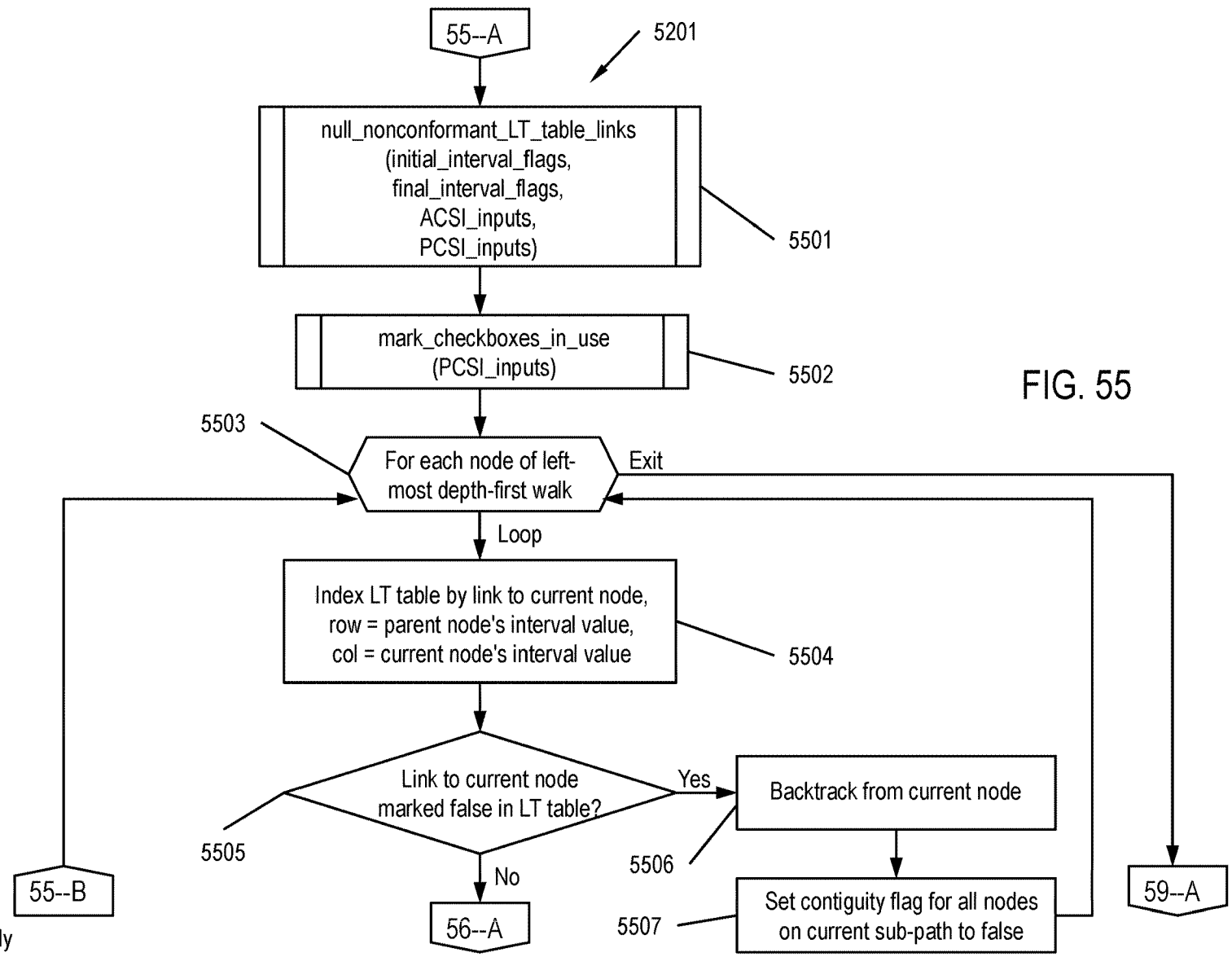
FIG. 55 is the fourth portion of the flow chart of the exemplary process for retrieving first sets of notes from the exemplary database.

At 5406 the current row's link to interval position trie 4706 of FIG. 47 may be traversed to an interval position trie 4801 of FIG. 48, and the process 5201 may continue at 5501 of FIG. 55.

When the loop at 5404 has completed for each NTCV in the list, the loop may exit, and the process 5201 may continue at 5304 of FIG. 53.

Referring now to FIG. 55, at 5501 the process 5201 may call the function null_nonconformant_LT_table_links( ) which is described in detail in Appendix 09. The function null_nonconformant_LT_table_links( ) sets all flags to false in the LT table whose corresponding links in the interval position trie 4801 do not conform with the interval first attribute inputs of FIG. 09 and FIG. 10.

At 5502 the process 5201 may call the function mark_checkboxes_in_use( ) which is described in detail in Appendix 10. The function mark_checkboxes_in_use( ) marks all checkboxes which are in-use for interval 3a and interval 3b positions indicated by all present interval inputs in interval set presence/absence 1003 of FIG. 10.

At 5503 the process 5201 may begin a loop for a left-most, depth-first walk of the interval position trie 4801.

At 5504 the LT table may be indexed by the link to the current node, where the LT table row equals the parent node's interval value, the column equals the current node's interval value, and the level equals the current node's level in the interval position trie 4801.

At 5505, a determination may be made whether the link to the current node is marked false in the LT table. When the link to the current node is not marked false in the LT table, the process 5201 may continue at 5601 of FIG. 56. When the link to the current node is marked false in the LT table, at 5506 the walk may backtrack from the current node. At 5507 the contiguity flag 4803 of FIG. 48 may be set to false for all nodes on the current subpath, and the loop at 5503 may continue with the next node of the walk.

Figure 59:
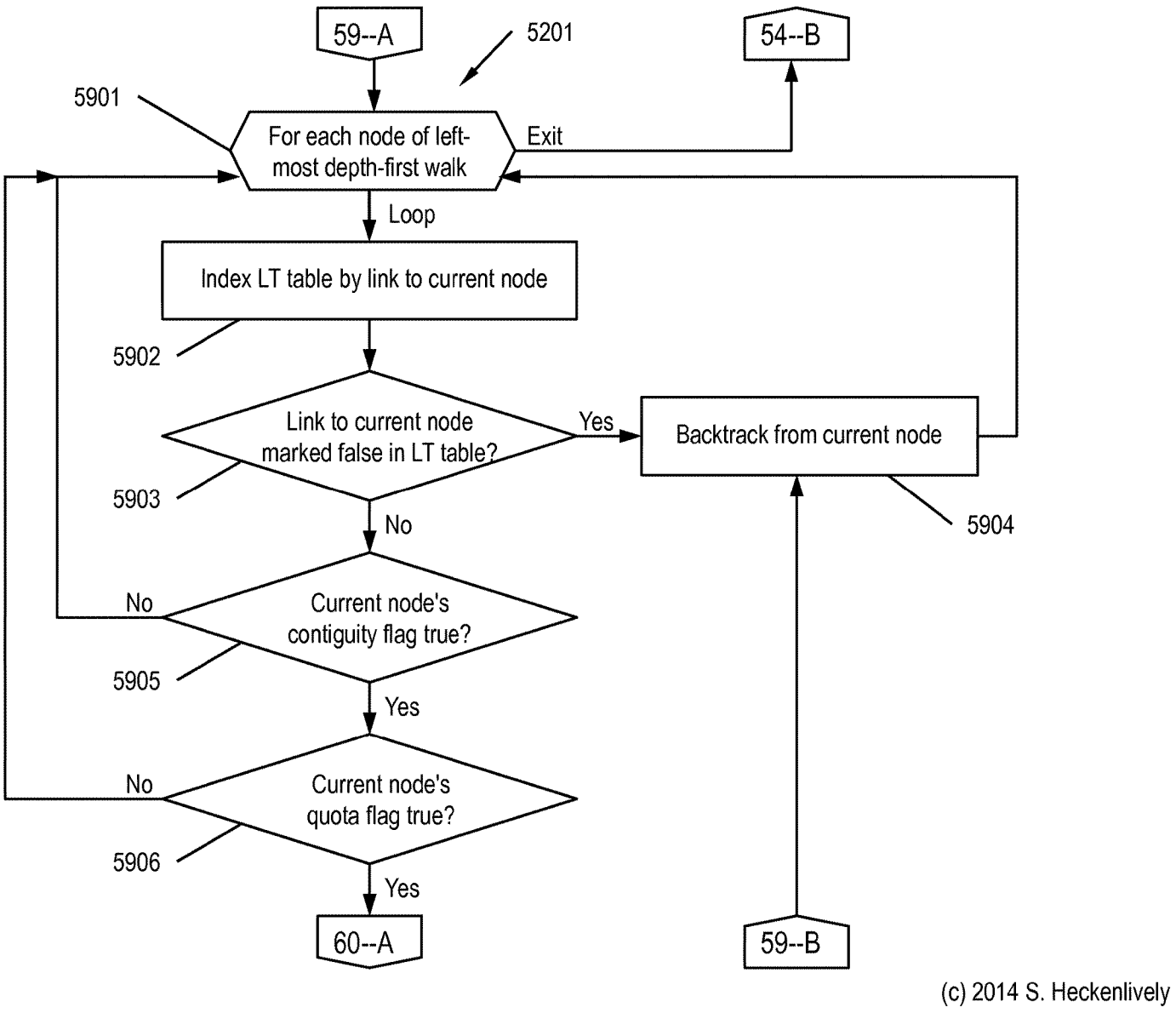
FIG. 59 is the eighth portion of the flow chart of the exemplary process for retrieving first sets of notes from the exemplary database.

When the loop at 5503 has completed for each node of the left-most, depth-first walk of the interval position trie 4801, the loop may exit, and the process 5201 may continue at 5901 of FIG. 59.

Figure 56:
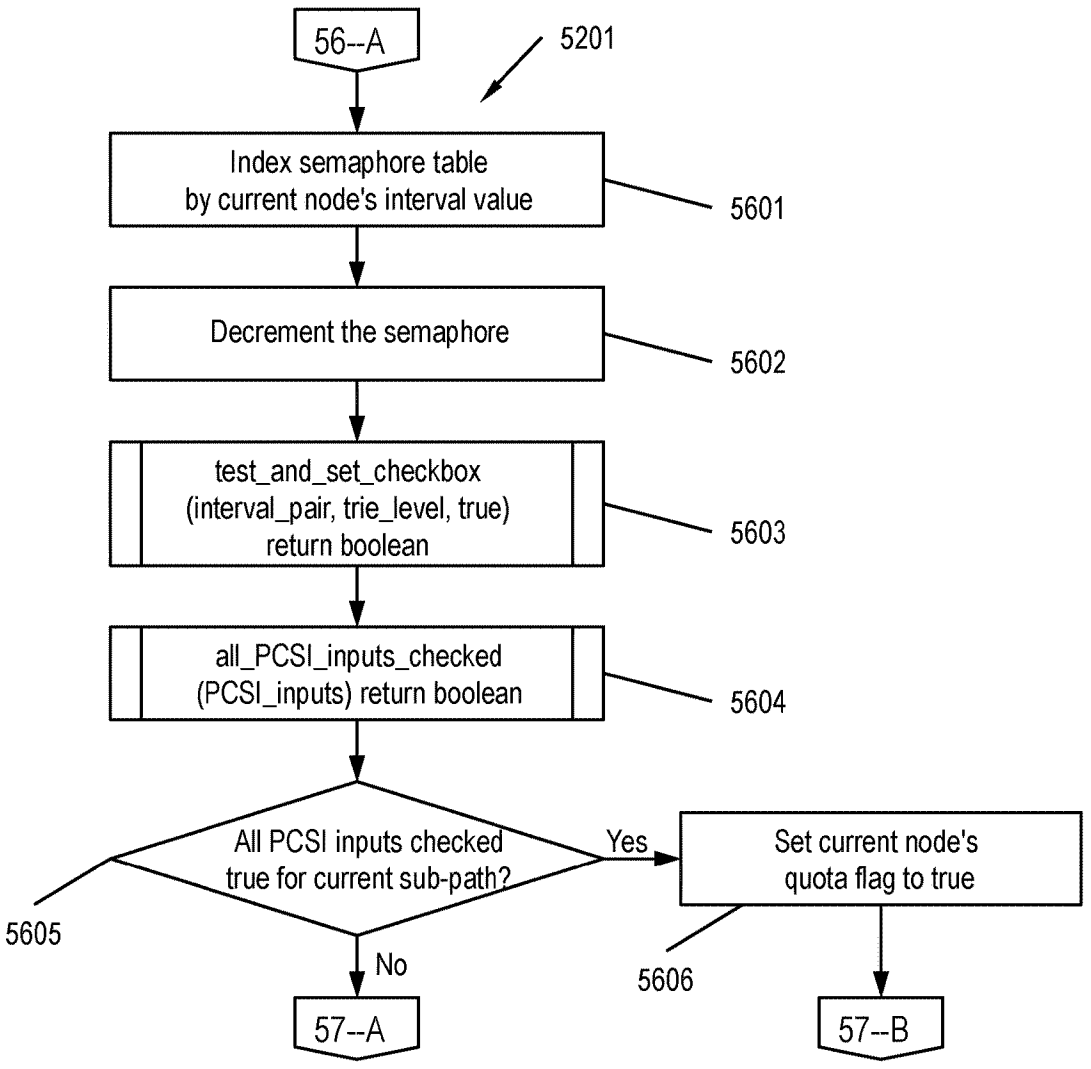
FIG. 56 is the fifth portion of the flow chart of the exemplary process for retrieving first sets of notes from the exemplary database.

Referring now to FIG. 56, at 5601 the process 5201 may index the semaphore table by the current node's interval value.

At 5602, the semaphore may be decremented.

At 5603, the process 5201 may call the function test_and_set_checkbox( ) which is described in detail in Appendix 10. The function test_and_set_checkbox( ) examines whether a checkbox is in-use for an interval 3a or an interval 3b position, and if so, sets the checkbox to a given value, at this step, true.

At 5604, the process 5201 may call the function all_PCSI_inputs_checked( ) which is described in detail in Appendix 10. The function all_PCSI_inputs_checked( ) examines the logical combination of checkboxes for interval 3a and interval 3b positions indicated by all present interval inputs in interval set presence/absence 1003 of FIG. 10.

At 5605, a determination may be made whether all PCSI inputs have been checkboxed true for the current sub-path. When all PCSI inputs have not been checkboxed true for the current sub-path, the process 5201 may continue at 5701 of FIG. 57. When all PCSI inputs have been checkboxed true for the current sub-path, at 5606 the quota flag 4804 of FIG. 48 may be set true, and the process 5201 may continue at 5702 of FIG. 57.

Figure 57:
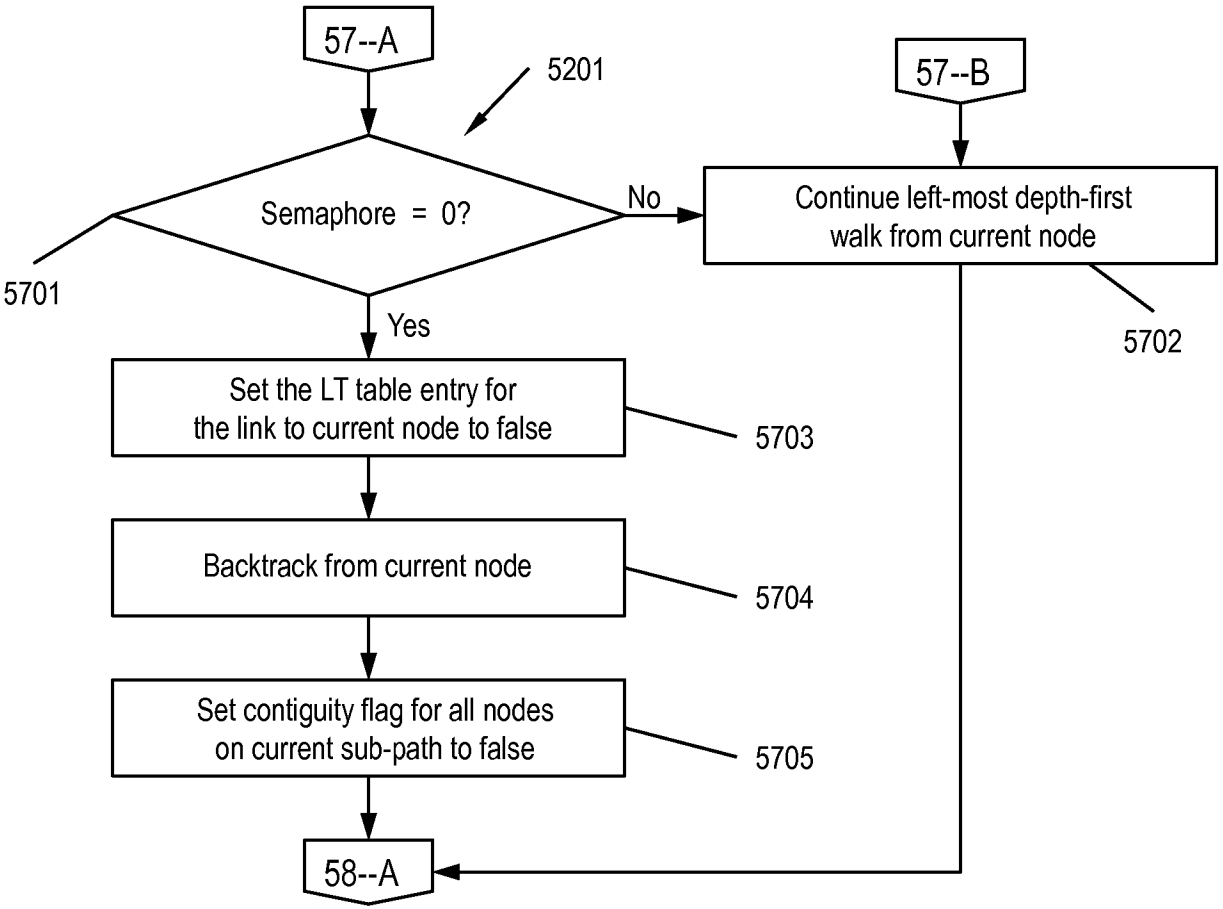
FIG. 57 is the sixth portion of the flow chart of the exemplary process for retrieving first sets of notes from the exemplary database.

Referring now to FIG. 57, at 5701 the process 5201 may make a determination whether the semaphore is 0. When the semaphore is not 0, at 5702 the walk may continue from the current node, and the process 5201 may continue at 5801 of FIG. 58. When the semaphore is 0, at 5703 the LT table entry for the link to the current node may be set to false.

At 5704 the walk may backtrack from the current node.

Figure 58:
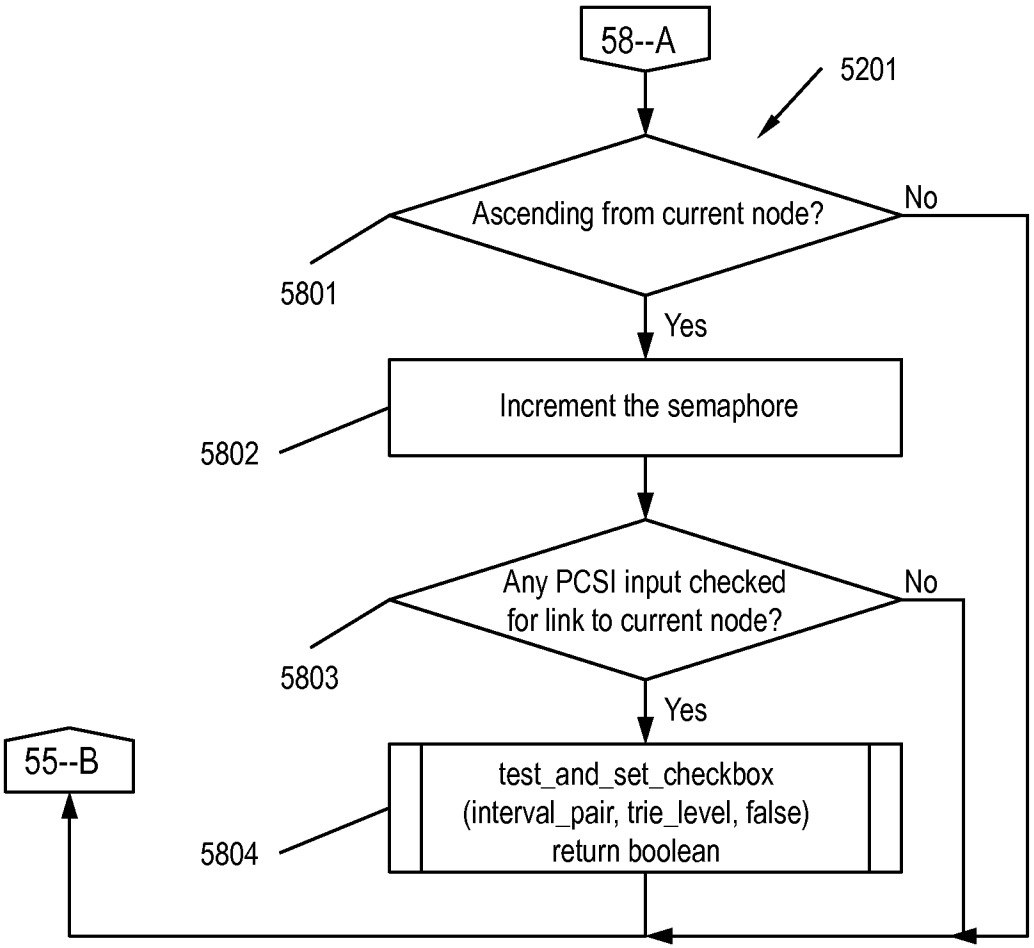
FIG. 58 is the seventh portion of the flow chart of the exemplary process for retrieving first sets of notes from the exemplary database.

At 5705 the contiguity flag 4803 of FIG. 48 may be set to false for all nodes on the current subpath, and the process 5201 may continue at 5801 of FIG. 58.

Referring now to FIG. 58, at 5801 the process 5201 may make a determination whether the walk is ascending from the current node. When the walk is not ascending from the current node, the loop at 5503 of FIG. 55 may continue with the next node of the walk. When the walk is ascending from the current node, at 5802 the semaphore may be incremented.

At 5803 a determination may be made whether any PCSI input has been checkboxed true for the link to the current node.

When no PCSI input has been checkboxed true for the link to the current node, the loop at 5503 may continue with the next node of the walk. When any PCSI input has been checkboxed true for the link to the current node, at 5804 the process 5201 may call the function test_and_set_checkbox( ) with the value of false, and the loop at 5503 of FIG. 55 may continue with the next node of the walk.

Referring now to FIG. 59, the process 5201 may begin a loop at 5901 for a left-most, depth-first walk of the interval position trie 4801.

At 5902 the LT table may be indexed by the link to the current node, where the LT table row equals the parent node's interval value, the column equals the current node's interval value, and the level equals the current node's level in the interval position trie 4801.

At 5903 a determination may be made whether the link to the current node is marked false in the LT table. When the link to the current node is marked false in the LT table, at 5904 the walk may backtrack from the current node, and the loop at 5901 may continue with the next node of the walk. When the link to the current node is not marked false in the LT table, at 5905 a determination may be made whether the current node's contiguity flag is true.

When the current node's contiguity flag is not true, the loop at 5901 may continue with the next node of the walk. When the current node's contiguity flag is true, at 5906 a determination may be made whether the current node's quota flag is true.

When the current node's quota flag is not true, the loop at 5901 may continue with the next node of the walk. When the current node's quota flag is true, the process 5201 may continue at 6001 of FIG. 60.

When the loop at 5901 has completed for each node of the left-most, depth-first walk of the interval position trie 4801, the loop may exit, and the process 5201 may continue at 5404 of FIG. 54.

Referring now to FIG. 60, at 6001 the process 5201 may traverse the current node's link to the signed interval sets 4805 to the storage for one or more signed interval sets.

At 6002 all the signed interval sets may be appended to a decode buffer, the process may continue at 5904 of FIG. 59, the walk may backtrack from the current node, and the loop at 5901 may continue with the next node of the walk.

Upon completion of the loop at 5204 of FIG. 52, at 6003 the signed interval sets in the decode buffer may be decoded into first sets of notes using the starting note of a set of notes 0802 of FIG. 08.

At 6004 the first sets of notes may be output, and the process may end at 6005.

Description of Plural Alternative Apparatus.

Figure 61:
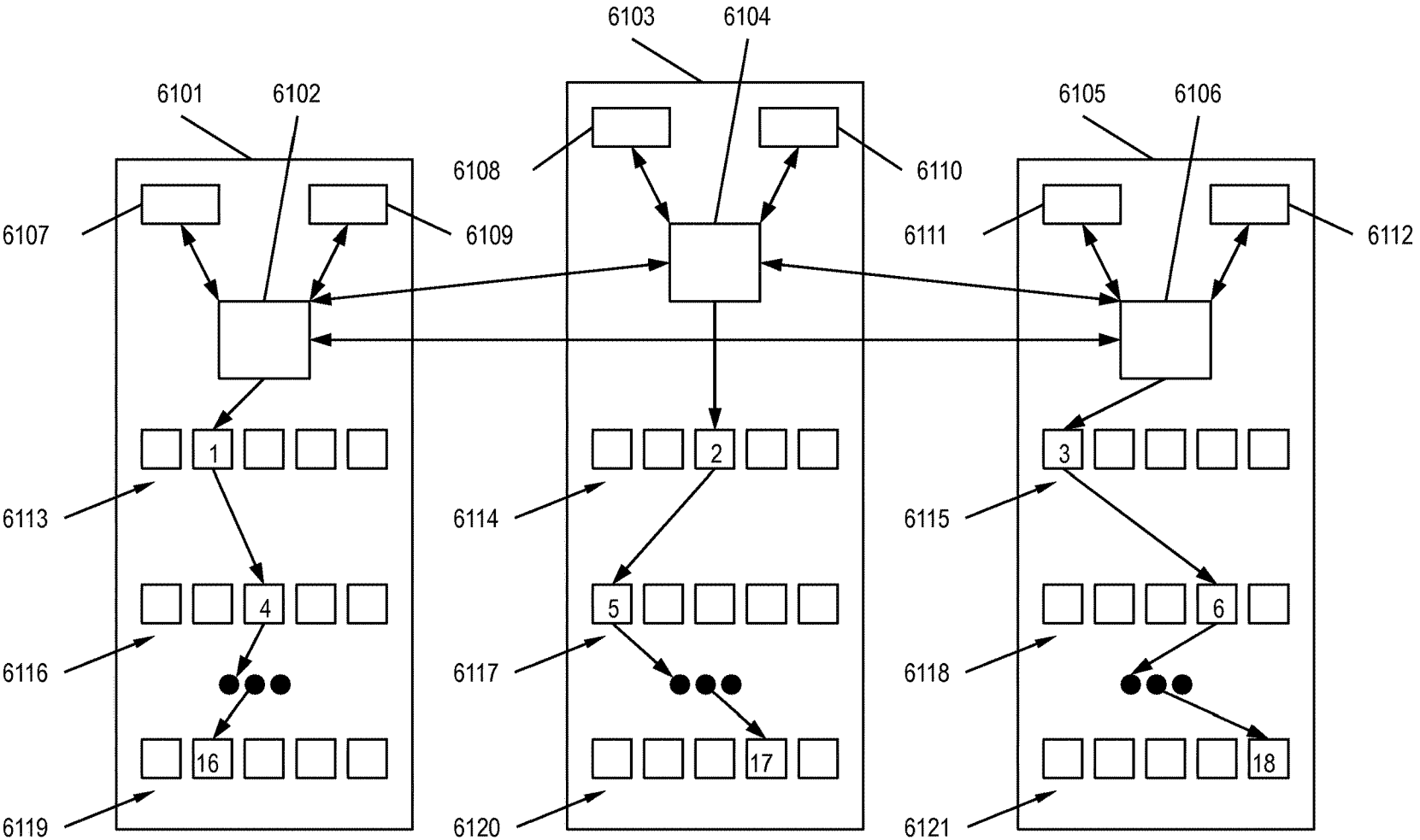
FIG. 61 is a block diagram of an example of plural controllers with plural database elements assembling families of sets from the database of FIG. 46 thru 48.

FIG. 61 is a block diagram of an example of plural controllers with plural database elements assembling families of sets, including aspects of harmony and melody, from the exemplary database of FIG. 46 thru 48.

In this example, 3 controllers are described as a representative plurality. Each controller is shown walking in an interval position trie 4801 of FIG. 48, with nodes of the 3 tries numbered to show the order of time progression of the controllers. The root trie 4601 of FIG. 46, the note direction index table 4701 and the note topology index table 4704 of FIG. 47, and the interval position trie 4801 of FIG. 48 retain their respective cardinalities, and have been loaded with pre-existing first sets of notes, as described above. Walks originate and progress thru the root trie 4601, the note direction index table 4701*s* and the note topology index table 4704*s*, as described above.

A controller1 6102 is shown in a walk in an interval position trie1 6101. The controller1 6102 has traversed thru trie1 level1 nodes 6113, and found that the node labelled 1 meets both the first attribute inputs of the controller1 6102, and first associations within the scope of controller1 6102. The scope is derived from the first associations. The first attribute inputs are described above with FIG. 08 thru FIG. 10. The first associations are described above with FIG. 34, FIG. 37, and FIG. 40.

The controller1 6102 has set first criteria (not shown) to one or more first conformance evaluating functions (not shown), which calculate one or more second attributes of one or more first sets of notes, compare one or more of the second attributes to one or more of the first attributes and return one or more first degrees of conformance, for usage with a controller) walk-state datastructure 6107. The controller) walk-state datastructure 6107 includes the link-traversal table, the checklist, and the semaphore table described above associated with FIG. 48. If plural controllers are walking in the same instance of an interval position trie 4801, e.g. interval position trie1 6101, each controller is allocated an instance of the walk-state datastructure. In this example, each interval position trie may have a plurality of 3 allocated controller walk-state datastructures.

The controller1 6102 has set second criteria (not shown) to one or more second conformance evaluating functions (not shown), which calculate one or more second associations of one or more of the families of sets, compare one or more of the second associations to one or more of the first associations and return one or more of the second degrees of conformance, for usage with a controller) second criteria datastructure 6109. The controller) second criteria datastructure 6109 includes the note of each of the nodes on the controller's current sub-path, derived from the signed intervals of the nodes and the starting note of a set of notes 0802 of FIG. 08. If plural controllers are walking in the same instance of an interval position trie 4801, e.g. interval position trie1 6101, each controller is allocated an instance of the second criteria datastructure. In this example, each interval position trie may have a plurality of 3 allocated controller second criteria datastructures.

A controller2 6104 is shown in a walk in an interval position trie2 6103 with an associated controller2 walk-state datastructure 6108 and an associated controller2 second criteria datastructure 6110. The controller2 6104 has traversed thru trie2 level) nodes 6114, and found that the node labelled 2 meets both the first attribute inputs of the controller2 6104, and first associations within the scope of controller2 6104.

A controller3 6106 is shown in a walk in an interval position trie3 6105 with an associated controller3 walk-state datastructure 6111 and an associated controller3 second criteria datastructure 6112. The controller3 6106 has traversed thru trie3 level) nodes 6115, and found that the node labelled 3 meets both the first attribute inputs of the controller3 6106, and first associations within the scope of controller3 6106.

The controller1 6102, the controller2 6104, and the controller3 6106 have also traversed thru the nodes labelled 4, 5, 6 of trie1 level2 nodes 6116, trie2 level2 nodes 6117, and trie3 level2 nodes 6118, respectively. Each of the nodes 4, 5, 6, meets the first attribute inputs and the first associations of the respective controller. Ellipses indicate that levels 3, 4 and 5 are not shown.

The controller1 6102, controller2 6104, and controller3 6106 have also traversed to the nodes labelled 16, 17, 18 of trie1 level6 nodes 6119, trie2 level6 nodes 6120, and trie3 level6 nodes 6121, respectively. Each of the nodes 16, 17, 18, meets the first attribute inputs and the first associations of the respective controller.

Upon traversal of fulls paths to level 6 nodes by all 3 controllers, the note data included in each of the 3 controller second criteria datastructures is included in a complete first set of notes. The 3 first sets of notes are collectively included in a family of sets, which is output.

Description of Plural Processes With Alternative Apparatus

FIG. 62 thru FIG. 68 are a flow chart 6201 of an exemplary process for assembling families of sets with the exemplary 3 plural controllers and the exemplary plural database elements of FIG. 61. As described with FIG. 61, note data is included in the plural controller second criteria datastructures prior to output of complete first sets of notes and families of sets.

The process 6201 may begin at 6202 when one or more first attribute inputs, and one or more association inputs, have been received by the controllers for first sets of notes to be retrieved from the database. The process 6201 may end at 6209 when all the families of sets, which include first sets of notes, conforming to the first attributes and to the first associations have been retrieved from the database, and output.

At 6203 the process 6201 may begin a loop for each interval position trie 4801 of FIG. 48 conforming to the first attributes of controller1 6102 (C1 in the flow chart) of FIG. 61.

When the loop at 6203 has completed for each interval position trie conforming to the C1 first attributes, the loop may exit, and the process 6201 may end at 6209.

At 6204 the process 6201 may begin a loop for each interval position trie 4801 of FIG. 48 conforming to the first attributes of controller2 6104 (C2 in the flow chart) of FIG. 61.

Figure 68:
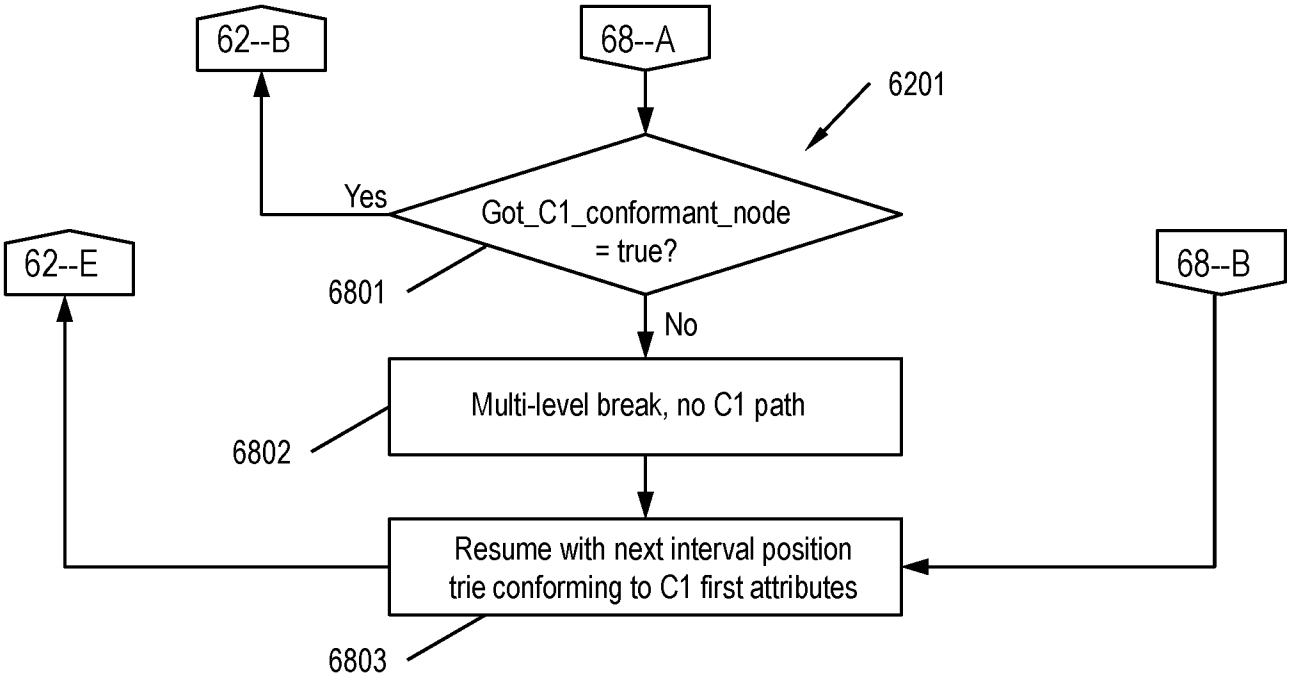
FIG. 68 is the seventh portion of the flow chart of the exemplary process for assembling families of sets with the plural controllers and the plural database elements of FIG. 61.
Figure 69:
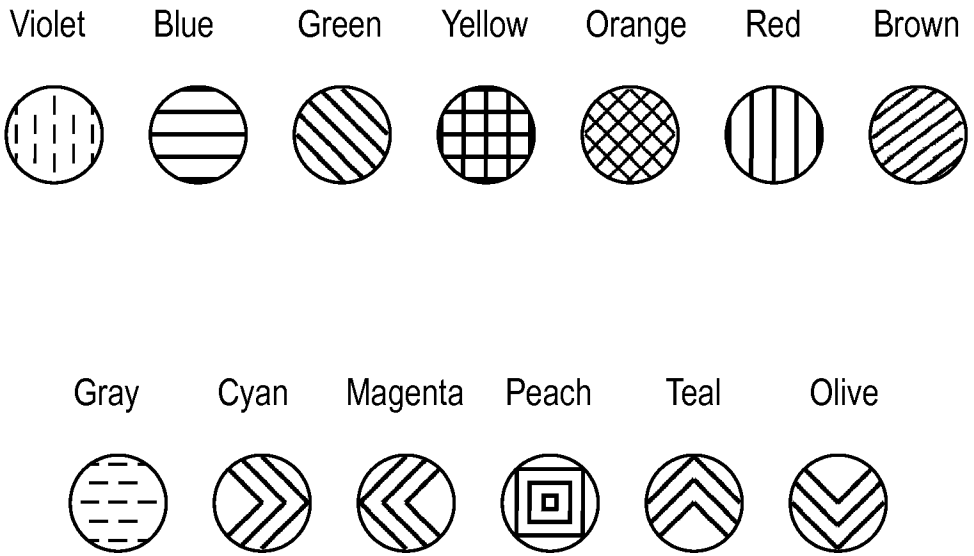
FIG. 69 is the key for color symbology.

When the loop at 6204 has completed for each interval position trie conforming to the C2 first attributes, the loop may exit, and the process 6201 may continue at 6803 of FIG. 68.

At 6205 the process 6201 may begin a loop for each interval position trie 4801 of FIG. 48 conforming to the first attributes of controller3 6106 (C3 in the flow chart) of FIG. 61.

Figure 67:
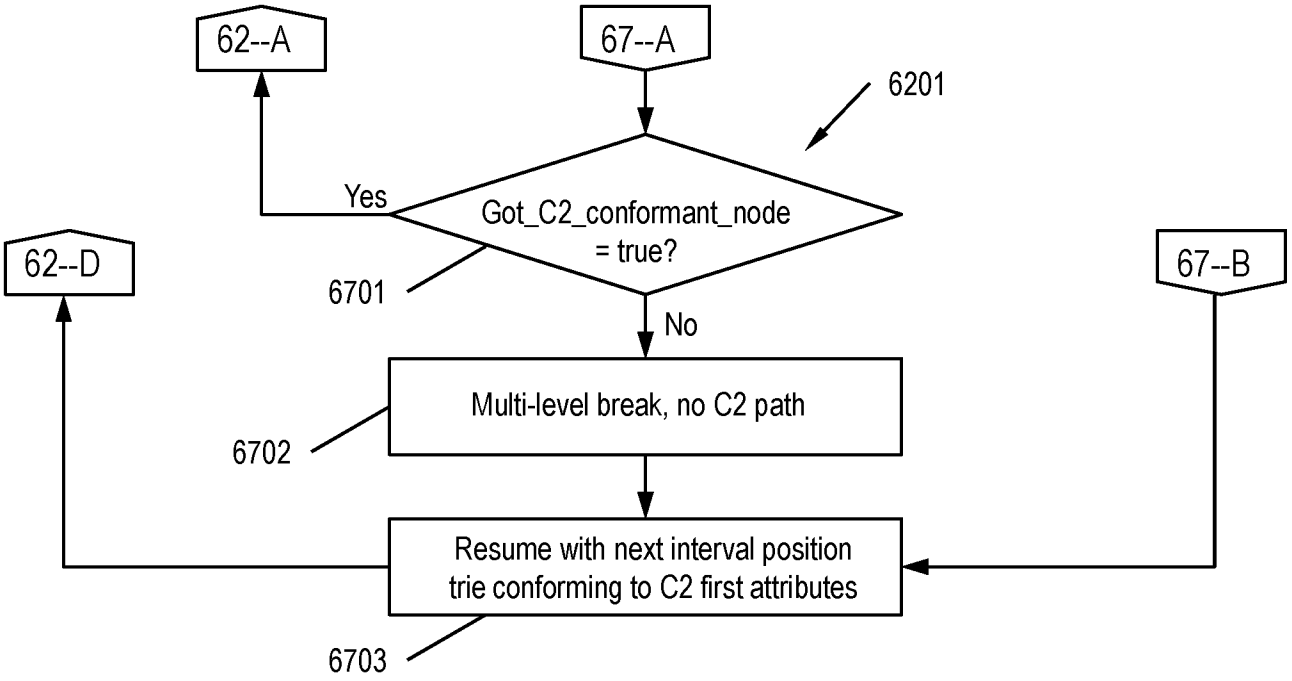
FIG. 67 is the sixth portion of the flow chart of the exemplary process for assembling families of sets with the plural controllers and the plural database elements of FIG. 61.

When the loop at 6205 has completed for each interval position trie conforming to the C3 first attributes, the loop may exit, and the process 6201 may continue at 6703 of FIG. 67.

At 6206 the process 6201 may begin a loop for each level L in the 3 parallel interval position trie 4801*s* of 6203, 6204, and 6205. In this example the last interval position (I-P) trie level is 6.

Figure 66:
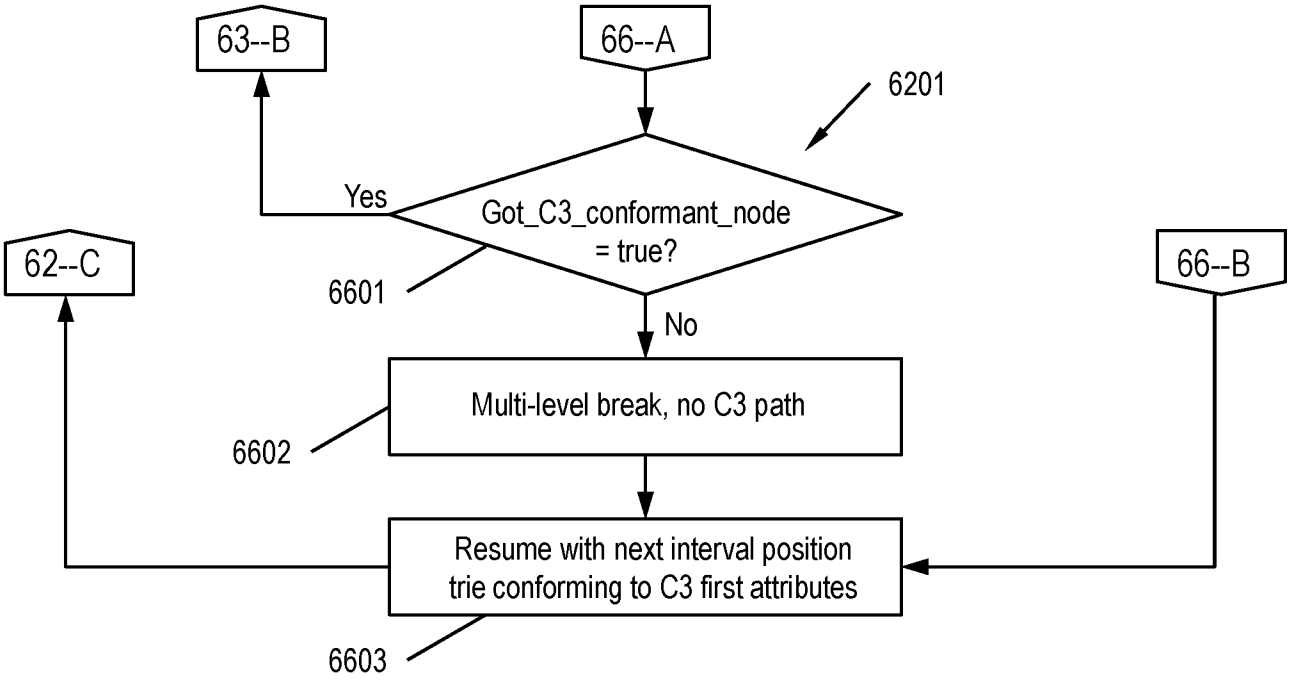
FIG. 66 is the fifth portion of the flow chart of the exemplary process for assembling families of sets with the plural controllers and the plural database elements of FIG. 61.

When the loop at 6206 has completed for each level L in the 3 interval position trie 4801*s*, the loop may exit, and the process 6201 may continue at 6603 of FIG. 66.

At 6207 a flag regarding the presence of a conformant node in the C1 trie of the loop at 6203 may be initialized to false.

Figure 63:
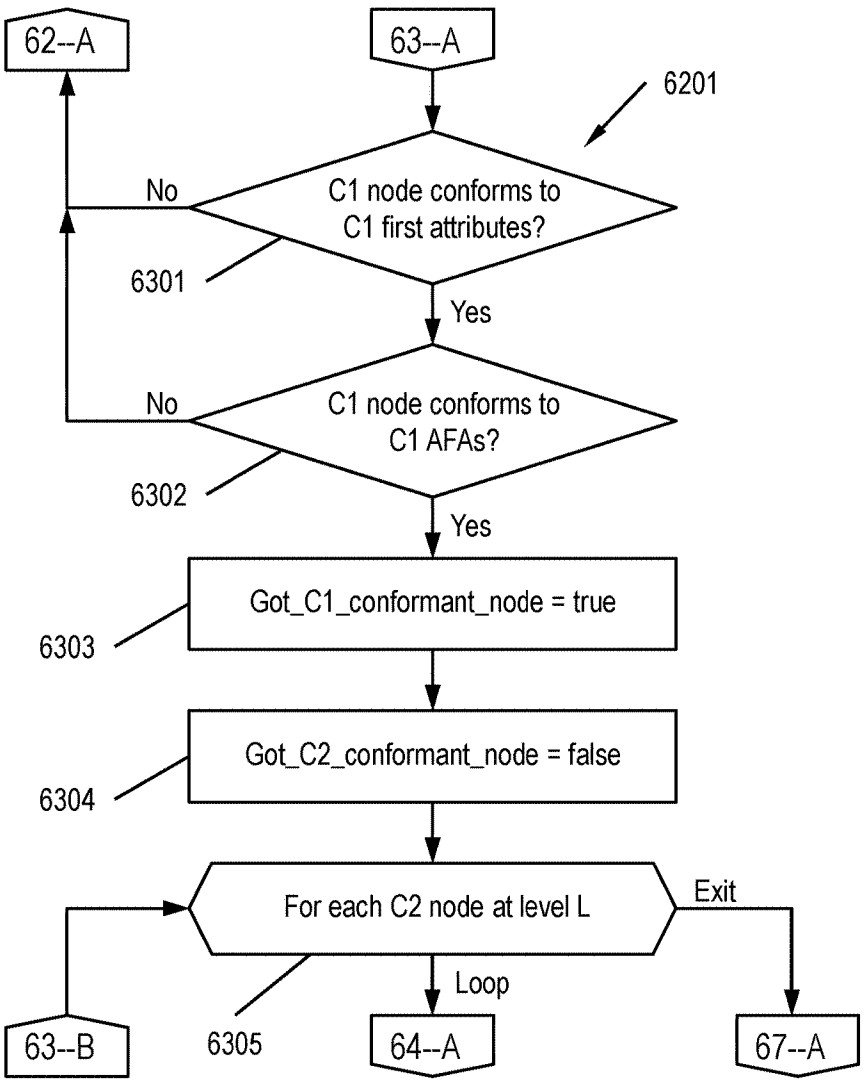
FIG. 63 is the second portion of the flow chart of the exemplary process for assembling families of sets with the plural controllers and the plural database elements of FIG. 61.

At 6208 the process 6201 may begin a loop for each C1 node at level L of the C1 trie, and the process may continue at 6301 of FIG. 63.

When the loop at 6208 has completed for each C1 node at level L, the loop may exit, and the process 6201 may continue at 6801 of FIG. 68.

Referring now to FIG. 63, at 6301 a determination may be made whether the current C1 node conforms to the C1 first attributes. When the current C1 node does not conform to the C1 first attributes, the loop at 6208 of FIG. 62 may continue with the next C1 node at level L.

When the current C1 node conforms to the C1 first attributes, at 6302 a determination may be made whether the current C1 node conforms to the C1 first associations (AFAs). When the current C1 node does not conform to the C1 first associations, the loop at 6208 of FIG. 62 may continue with the next C1 node at level L.

Figure 62:
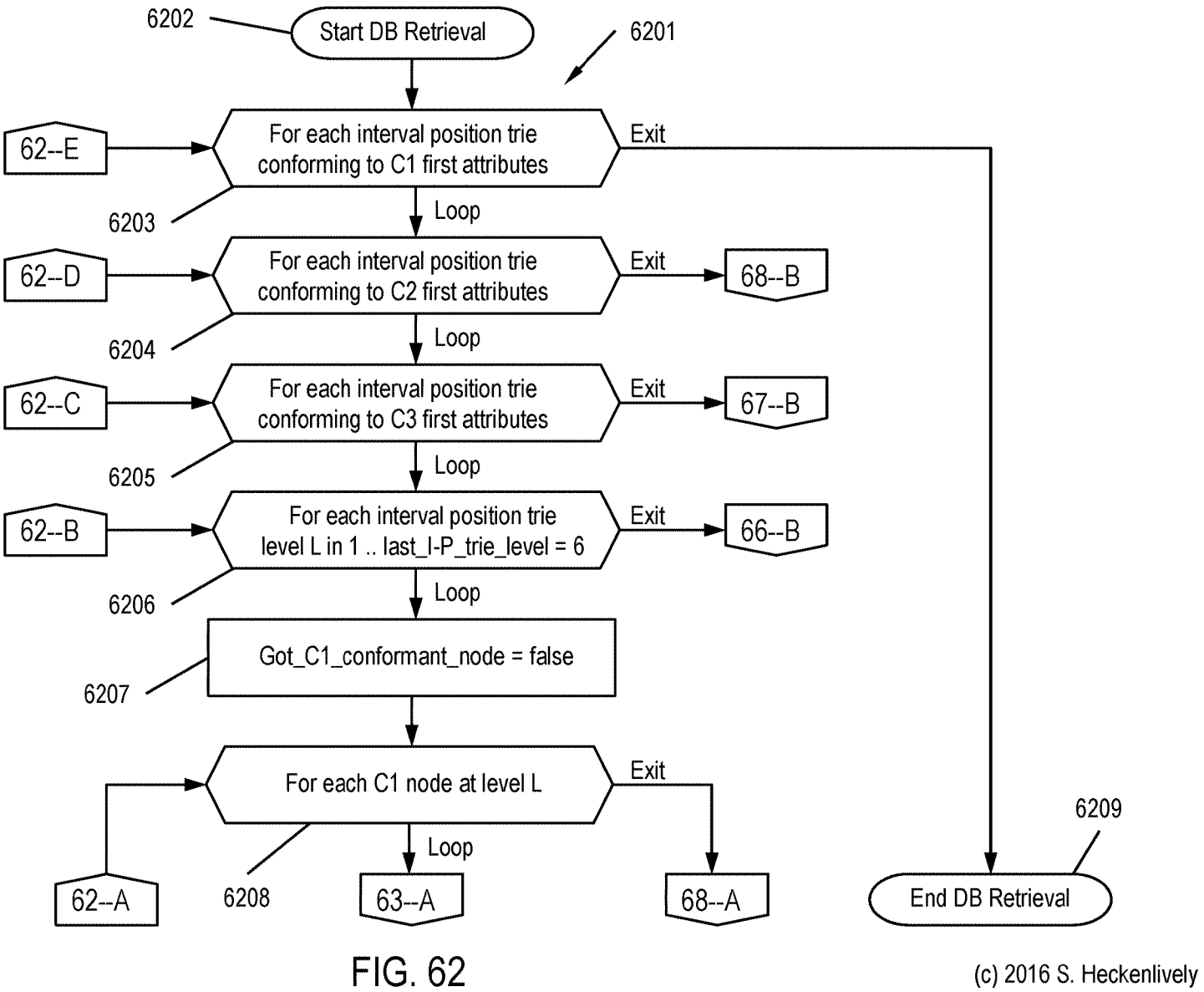
FIG. 62 is the first portion of a flow chart of an exemplary process for assembling families of sets with the plural controllers and the plural database elements of FIG. 61.

When the current C1 node conforms to the C1 first associations, at 6303 the flag regarding the presence of a conformant node in the C1 trie of the loop at 6203 of FIG. 62 may be set to true.

At 6304 a flag regarding the presence of a conformant node in the C2 trie of the loop at 6204 may be initialized to false.

Figure 64:
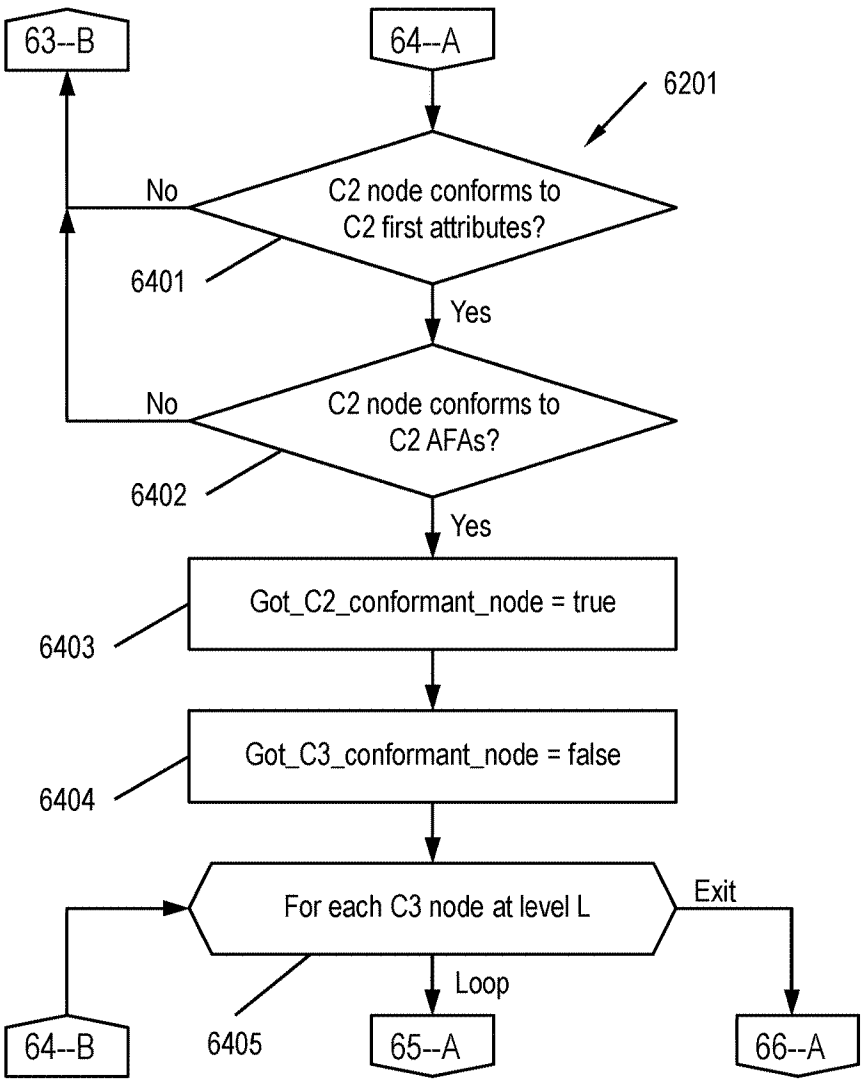
FIG. 64 is the third portion of the flow chart of the exemplary process for assembling families of sets with the plural controllers and the plural database elements of FIG. 61.

At 6305 the process 6201 may begin a loop for each C2 node at level L of the C2 trie, and the process may continue at 6401 of FIG. 64.

When the loop at 6305 has completed for each C2 node at level L, the loop may exit, and the process 6201 may continue at 6701 of FIG. 67.

Referring now to FIG. 64, at 6401 a determination may be made whether the current C2 node conforms to the C2 first attributes. When the current C2 node does not conform to the C2 first attributes, the loop at 6305 of FIG. 63 may continue with the next C2 node at level L.

When the current C2 node conforms to the C2 first attributes, at 6402 a determination may be made whether the current C2 node conforms to the C2 first associations (AFAs). When the current C2 node does not conform to the C2 first associations, the loop at 6305 of FIG. 63 may continue with the next C2 node at level L.

When the current C2 node conforms to the C2 first associations, at 6403 the flag regarding the presence of a conformant node in the C2 trie of the loop at 6204 of FIG. 62 may be set to true.

At 6404 a flag regarding the presence of a conformant node in the C3 trie of the loop at 6205 may be initialized to false.

Figure 65:
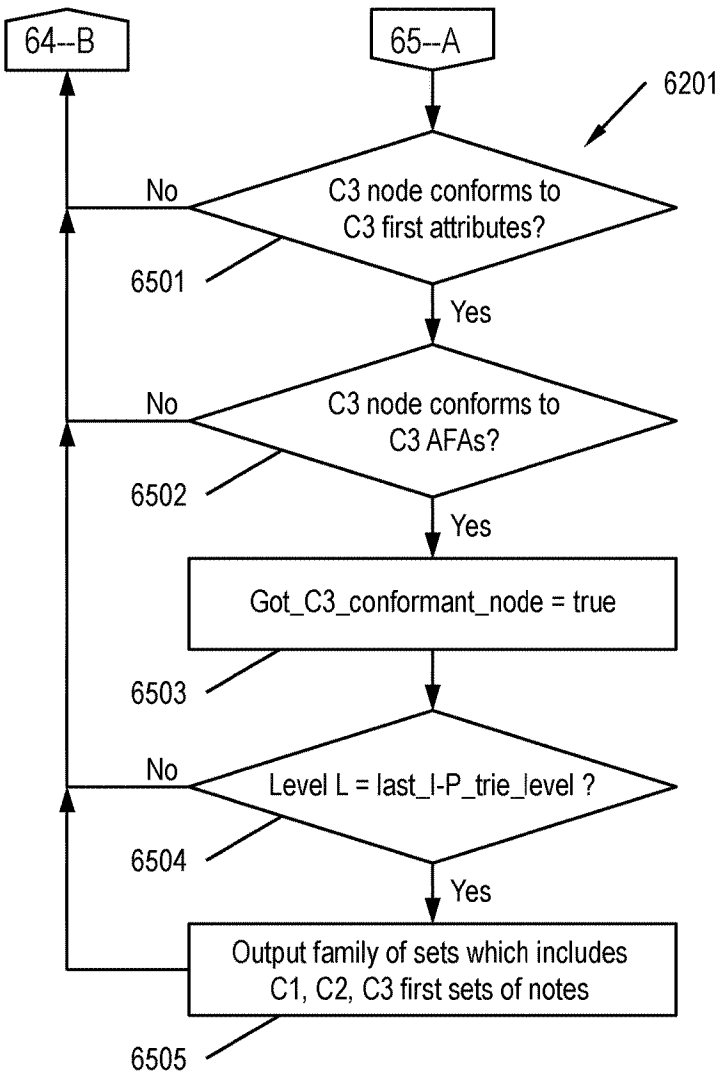
FIG. 65 is the fourth portion of the flow chart of the exemplary process for assembling families of sets with the plural controllers and the plural database elements of FIG. 61.

At 6405 the process 6201 may begin a loop for each C3 node at level L of the C3 trie, and the process may continue at 6501 of FIG. 65.

When the loop at 6405 has completed for each C3 node at level L, the loop may exit, and the process 6201 may continue at 6601 of FIG. 66.

Referring now to FIG. 65, at 6501 a determination may be made whether the current C3 node conforms to the C3 first attributes. When the current C3 node does not conform to the C3 first attributes, the loop at 6405 of FIG. 64 may continue with the next C3 node at level L.

When the current C3 node conforms to the C3 first attributes, at 6502 a determination may be made whether the current C3 node conforms to the C3 first associations (AFAs). When the current C3 node does not conform to the C3 first associations, the loop at 6405 of FIG. 64 may continue with the next C3 node at level L.

When the current C3 node conforms to the C3 first associations, at 6503 the flag regarding the presence of a conformant node in the C3 trie of the loop at 6205 of FIG. 62 may be set to true.

At 6504 a determination may be made whether level L equals the last interval position trie level. When level L does not equal the last interval position trie level, the loop at 6405 of FIG. 64 may continue with the next C3 node at level L. When level L equals the last interval position trie level, at 6505 the family of sets which includes the C1, C2, and C3 music yielding device sets may be output, the process may continue the loop at 6405 of FIG. 64, the loop at 6405 may exit, and the process may continue at 6601 of FIG. 66.

Referring now to FIG. 66, at 6601 a determination may be made whether the flag regarding the presence of a conformant node in the C3 trie is true. When the flag regarding the presence of a conformant node in the C3 trie is true, the process 6201 may continue at the loop at 6305 of FIG. 63. When the flag regarding the presence of a conformant node in the C3 trie is false, at 6602 the process 6201 may perform a multi-level break regarding the absence of a path thru the current C3 trie.

At 6603, the process 6201 may resume with the next interval position trie conforming to the C3 first attributes, and the process may continue with the loop at 6205 of FIG. 62.

Referring now to FIG. 67, at 6701 a determination may be made whether the flag regarding the presence of a conformant node in the C2 trie is true. When the flag regarding the presence of a conformant node in the C2 trie is true, the process 6201 may continue at the loop at 6208 of FIG. 62. When the flag regarding the presence of a conformant node in the C2 trie is false, at 6702 the process 6201 may perform a multi-level break regarding the absence of a path thru the current C2 trie.

At 6703, the process 6201 may resume with the next interval position trie conforming to the C2 first attributes, and the process may continue with the loop at 6204 of FIG. 62.

Referring now to FIG. 68, at 6801 a determination may be made whether the flag regarding the presence of a conformant node in the C1 trie is true. When the flag regarding the presence of a conformant node in the C1 trie is true, the process 6201 may continue at the loop at 6206 of FIG. 62. When the flag regarding the presence of a conformant node in the C1 trie is false, at 6802 the process 6201 may perform a multi-level break regarding the absence of a path thru the current C1 trie.

At 6803, the process 6201 may resume with the next interval position trie conforming to the C1 first attributes, and the process may continue with the loop at 6203 of FIG. 62.

CLOSING COMMENTS

Throughout this description, the embodiments and examples shown should be considered as exemplars, rather than as limitations on the apparatus and procedures disclosed or claimed.

Although the examples presented above involve multiple kinds of sets ordered in time as sequences, the exemplary ordering should not be construed as a limitation on the apparatus and procedures disclosed or claimed Although the examples presented above involve conformance to first attributes, and to first associations, to a predetermined degree of true/false, the degree of true/false should be considered as exemplary, rather than as a limitation on the apparatus and procedures disclosed or claimed.

Although the examples presented above involve specific combinations of method acts or system elements, it should be understood that those acts and those elements may be combined in other ways to accomplish the same objectives.

Regarding flow charts and program design language, additional and fewer steps may be taken, and the steps as shown may be combined or further refined to achieve the methods described herein. Elements, acts, and attributes discussed only in connection with one embodiment are not intended to be excluded from a similar role in other embodiments.

As used herein, whether in the written description or the claims, the term "data" is intended to include digital data, commands, instructions, subroutines, functions, digital signals, analog signals, optical signals and any other data that may be used to communicate the value of one or more parameters.

As used herein, whether in the written description or the claims, "plurality" indicates two or more. As used herein, whether in the written description or the claims, a "set" of items may include one or more of such items. As used herein, whether in the written description or the claims, the terms "comprising", "including", "having", "containing", "involve", and the like are to be understood to be open-ended, i.e., to mean including but not limited to. Only the transitional phrase "consisting of" is a closed or semi-closed transitional phrase with respect to claims.

Use of ordinal terms such as "first", "second", etc., whether in the claims or the written description, to modify a claim element does not, by itself, connote any priority, precedence, or order of one claim element relative to another, nor the temporal order in which acts of a method are performed, but are used merely as labels to distinguish one claim element having a certain name from another element having a same name (but for use of the ordinal term) to distinguish the claim elements.

As used herein, the term "and/or" indicates that the listed items are alternatives, but the alternatives also include any combination of the listed items.

I claim:

1. A music yielding system, comprising:

first circuits and first software to perform actions yielding
a first set of musical notes,
the first set of musical notes conforming to a first attribute of the first set of musical notes,
and setting a first criterion, the first criterion determining as true or false a second conformance of the first set of musical notes to the first attribute; and second circuits and second software to perform actions
receiving an input indication of
the first attribute, and
causing the first criterion to be set to a first conformance evaluating function,
the first conformance evaluating function calculating a second attribute of the first set of musical notes, comparing the second attribute to the first attribute,
and returning the second conformance;

wherein the music is yielded.

2. The music yielding system of claim 1, further comprising:

third circuits and third software to perform actions calculating a correlation within the first set of musical notes, and transmitting an output indication of the correlation; and performing the transmitting in near-synchrony with a time progression of
the first set of musical notes.

3. The music yielding system of claim 2, wherein the correlation comprises:
one or more selected from the group consisting of:
a musical part of the first set of musical notes,
a musical voice of the first set of musical notes,
a note depth in time consisting of:
a time interval between two or more of the musical notes of the first set of musical notes;
the musical notes of the first set of musical notes,
a musical interval of the first set of musical notes,
a note topology consisting of:
a first symbol associated with one respective pitch class of a first note of the first set of musical notes; and
a transition from the first symbol to the first symbol or to a second symbol associated with one respective pitch class of a second note of the first set of musical notes; and
a note direction consisting of:
up or down or same from one third pitch(J−1) to one third pitch(J) of the respective J−1th and Jth musical notes of the first set of musical notes.

4. The music yielding system of claim 1, further comprising:

third circuits and third software to perform actions receiving an input indication of an identity of a musical data source,
receiving an input indication of an identity of a musical data destination, and
transferring a musical data item from the musical data source to the musical data destination.

5. The music yielding system of claim 4, wherein the first attribute comprises:
one or more selected from the group consisting of:
a size of the first set of musical notes, a range of the first set of musical notes, a maximum note distance consisting of:

a count of the number of notes between one first pitch(I−1) and one first pitch(I) of the respective I−1th and Ith musical notes of the first set of musical notes;

a starting note of the first set of musical notes, a note direction consisting of:

up or down or same from one second pitch(I−1) to one second pitch(I) of the respective I−1th and Ith musical notes of the first set of musical notes;

a note topology consisting of:

a first symbol associated with one respective pitch class of a first note of the first set of musical notes; and a transition from the first symbol to the first symbol or to a second symbol associated with one respective pitch class of a second note of the first set of musical notes;

a set of present musical intervals of the first set of musical notes, a set of absent musical intervals of the first set of musical notes, and a third set of musical notes.

6. The music yielding system of claim 4, further comprising:

the second circuits and the second software performing further actions calculating a third attribute of a second set of musical notes, and transmitting a first output indication of the third attribute;

fourth circuits and fourth software to perform actions calculating a correlation within the second set of musical notes, and transmitting a second output indication of the correlation;

performing the transmitting of the first output indication or the second output indication in near-synchrony with a time progression of the second set of musical notes.

7. The music yielding system of claim 6, wherein the musical data item comprises:

one or more selected from the group consisting of:

the first set of musical notes, the second set of musical notes, the first attribute, the third attribute, and the correlation;

wherein the musical data source consists of:

one or more selected from the group consisting of:

the first circuits and first software, the second circuits and second software, the fourth circuits and fourth software, a first process within an environment external to the system, and a first data file within the environment external to the system;

wherein the musical data destination consists of:

one or more selected from the group consisting of:

the first circuits and first software, the second circuits and second software, the fourth circuits and fourth software, a second process within the environment external to the system, and a second data file within the environment external to the system.

8. The music yielding system of claim 1, further comprising:

the first circuits and the first software performing a further action of transmitting an effect of the first attribute upon the first circuits and first software; and the second circuits and the second software performing further actions receiving the effect, transmitting an output indication of the effect, calculating a count of the first set of musical notes, and transmitting an output indication of the count.

9. The music yielding system of claim 1, further comprising:

a first plurality of two or more of the first circuits and first software, a second plurality of two or more of the second circuits and second software, wherein the first circuits and the first software in the first plurality perform further actions assembling a family of two or more of the first sets of musical notes, the family of sets conforming to a first association of the first attribute with the family of sets;

setting a second criterion, the second criterion determining as true or false a fourth conformance of the family of sets to the first association;

wherein the second circuits and the second software in the second plurality perform further actions receiving an input indication of the first association, causing the second criterion to be set to a second conformance evaluating function, the second conformance evaluating function calculating a second association of the family of sets, comparing the second association to the first association, and returning the fourth conformance;

wherein the music is yielded.

10. The music yielding system of claim 7, wherein the correlation comprises:

one or more selected from the group consisting of:

a musical part of the second set of musical notes, a musical voice of the second set of musical notes, a note depth in time consisting of:

a time interval between two or more of the musical notes of the second set of musical notes;

the musical notes of the second set of musical notes, a musical interval of the second set of musical notes, a note topology consisting of:

a first symbol associated with one respective pitch class of a first note of the first set of musical notes; and a transition from the first symbol to the first symbol or to a second symbol associated with one respective pitch class of a second note of the first set of musical notes; and a note direction consisting of:

up or down or same from one third pitch(J−1) to one third pitch(J) of the respective J−1th and Jth musical notes of the second set of musical notes.

11. A method for controlling a music yielding device, the method comprising:

receiving an input indication of a first attribute of a first set of musical notes of the music, and causing a first criterion associated with the music yielding device to be set to a first conformance evaluating function, the first criterion determining as true or false a first conformance of the first set of musical notes to the first attribute, the first conformance evaluating function calculating a second attribute of the first set of musical notes, comparing the second attribute to the first attribute, and returning the first conformance;

wherein the music is yielded.

12. The method for controlling a music yielding device of claim 11, the method further comprising:

calculating a correlation within the first set of musical notes, transmitting an output indication of the correlation, and performing the transmitting in near-synchrony with a time progression of the first set of musical notes.

13. The method for controlling a music yielding device of claim 12, wherein the correlation comprises:

one or more selected from the group consisting of:

a musical part of the first set of musical notes, a musical voice of the first set of musical notes, a note depth in time consisting of:

a time interval between two or more of the musical notes of the first set of musical notes;

the musical notes of the first set of musical notes, a musical interval of the first set of musical notes, a note topology consisting of:

a first symbol associated with one respective pitch class of a first note of the first set of musical notes; and a transition from the first symbol to the first symbol or to a second symbol associated with one respective pitch class of a second note of the first set of musical notes; and a note direction consisting of:

up or down or same from one third pitch(J−1) to one third pitch(J) of the respective J−1th and Jth musical notes of the first set of musical notes.

14. The method for controlling a music yielding device of claim 11, the method further comprising:

receiving an input indication of an identity of a musical data source;

receiving an input indication of an identity of a musical data destination; and transferring a musical data item from the musical data source to the musical data destination.

15. The method for controlling a music yielding device of claim 14, wherein the first attribute comprises:

one or more selected from the group consisting of:

a size of the first set of musical notes, a range of the first set of musical notes, a maximum note distance consisting of:

a count of the number of notes between one first pitch(I−1) and one first pitch(I) of the respective I−1th and Ith musical notes of the first set of musical notes;

a starting note of the first set of musical notes, a note direction consisting of:

up or down or same from one second pitch(I−1) to one second pitch(I) of the respective I−1th and Ith musical notes of the first set of musical notes;

a note topology consisting of:

a first symbol associated with one respective pitch class of a first note of the first set of musical notes; and a transition from the first symbol to the first symbol or to a second symbol associated with one respective pitch class of a second note of the first set of musical notes;

a set of present musical intervals of the first set of musical notes, a set of absent musical intervals of the first set of musical notes, and a third set of musical notes.

16. The method for controlling a music yielding device of claim 14, the method further comprising:

calculating a third attribute of a second set of musical notes, transmitting a first output indication of the third attribute, calculating a correlation within the second set of musical notes, transmitting a second output indication of the correlation, and performing the transmitting of the first output indication or the second output indication in near-synchrony with a time progression of the second set of musical notes.

17. The method for controlling a music yielding device of claim 16, wherein the musical data item comprises:

one or more selected from the group consisting of:

the first set of musical notes, the second set of musical notes, the first attribute, the third attribute, and the correlation;

wherein the musical data source consists of:

one or more selected from the group consisting of:

the music yielding device, a first process within an environment external to the music yielding device, and a first data file within the environment external to the music yielding device;

wherein the musical data destination consists of:

one or more selected from the group consisting of:

the music yielding device, a second process within the environment external to the music yielding device, and a second data file within the environment external to the music yielding device.

18. The method for controlling a music yielding device of claim 11, the method further comprising:

receiving an effect of the first attribute upon the music yielding device, transmitting an output indication of the effect, calculating a count of the first set of musical notes, and transmitting an output indication of the count.

19. The method for controlling a music yielding device of claim 11, the method further comprising:

controlling a plurality of two or more of the music yielding devices;

the plurality of music yielding devices assembling a family of two or more of the first sets of musical notes;

the method receiving an input indication of a first association of the first attribute with the family of sets, causing a second criterion associated with one or more of the music yielding devices in the plurality of devices to be set to a second conformance evaluating function, the second criterion determining as true or false a second conformance of the family of sets to the first association, the second conformance evaluating function calculating a second association of the family of sets, comparing the second association to the first association, and returning the second conformance;

wherein the music is yielded.

20. The method for controlling a music yielding device of claim 17, wherein the correlation comprises:

one or more selected from the group consisting of:

a musical part of the second set of musical notes, a musical voice of the second set of musical notes, a note depth in time consisting of:

a time interval between two or more of the musical notes of the second set of musical notes;

the musical notes of the second set of musical notes, a musical interval of the second set of musical notes, a note topology consisting of:

a first symbol associated with one respective pitch class of a first note of the first set of musical notes; and a transition from the first symbol to the first symbol or to a second symbol associated with one respective pitch class of a second note of the first set of musical notes; and a note direction consisting of:

up or down or same from one third pitch(J−1) to one third pitch(J) of the respective J−1th and Jth musical notes of the second set of musical notes.

21. A computing device for controlling a music yielding device, the computing device comprising:

a non-transitory machine readable storage medium storing instructions that, when executed, cause the computing device to perform actions receiving an input indication of a first attribute of a first set of musical notes of the music;

causing a first criterion associated with the music yielding device to be set to a first conformance evaluating function, the first criterion determining as true or false a first conformance of the first set of musical notes to the first attribute, the first conformance evaluating function calculating a second attribute of the first set of musical notes, comparing the second attribute to the first attribute, and returning the first conformance;

wherein the music is yielded.

22. The computing device for controlling a music yielding device of claim 21, wherein the actions performed further comprise:

receiving an input indication of an identity of a musical data source, receiving an input indication of an identity of a musical data destination, transferring a musical data item from the musical data source to the musical data destination, calculating a third attribute of a second set of musical notes, and transmitting an output indication of the third attribute.

23. The computing device for controlling a music yielding device of claim 22, wherein the first attribute comprises:

one or more selected from the group consisting of:

a size of the first set of musical notes, a range of the first set of musical notes, a maximum note distance consisting of:

a count of the number of notes between one first pitch(I−1) and one first pitch(I) of the respective I−1th and Ith musical notes of the first set of musical notes;

a starting note of the first set of musical notes, a note direction consisting of:

up or down or same from one second pitch(I−1) to one second pitch(I) of the respective I−1th and Ith musical notes of the first set of musical notes;

a note topology consisting of:

a first symbol associated with one respective pitch class of a first note of the first set of musical notes; and a transition from the first symbol to the first symbol or to a second symbol associated with one respective pitch class of a second note of the first set of musical notes;

a set of present musical intervals of the first set of musical notes, a set of absent musical intervals of the first set of musical notes, and a third set of musical notes.

24. The computing device for controlling a music yielding device of claim 22, wherein the musical data item comprises:

one or more selected from the group consisting of:

the first set of musical notes, the second set of musical notes, the first attribute, and the third attribute;

wherein the musical data source consists of:

one or more selected from the group consisting of:

the music yielding device, a first process within an environment external to the music yielding device, and a first data file within the environment external to the music yielding device; and wherein the musical data destination consists of:

one or more selected from the group consisting of:

the music yielding device, a second process within the environment external to the music yielding device, and a second data file within the environment external to the music yielding device.

25. The computing device for controlling a music yielding device of claim 21, wherein the actions performed further comprise:

receiving an effect of the first attribute upon the music yielding device, transmitting an output indication of the effect, calculating a count of the first set of musical notes, and transmitting an output indication of the count.

26. The computing device for controlling a music yielding device of claim 21, the computing device further comprising:

controlling a plurality of two or more of the music yielding devices;

the plurality of music yielding devices assembling a family of two or more of the first sets of musical notes;

the computing device receiving an input indication of a first association of the first attribute with the family of sets, causing a second criterion associated with one or more of the music yielding devices in the plurality of devices to be set to a second conformance evaluating function, the second criterion determining as true or false a second conformance of the family of sets to the first association, the second conformance evaluating function calculating a second association of the family of sets, comparing the second association to the first association, and returning the second conformance;

wherein the music is yielded.

27. The computing device for controlling a music yielding device of claim 21, further comprising:

a processor; a memory; and a storage device.

28. A computing device for analyzing music, the computing device comprising:

a non-transitory machine readable storage medium storing instructions that, when executed, cause the computing device to perform actions calculating a correlation within a set of musical notes, and transmitting an output indication of the correlation;

the transmitting performed in near-synchrony with a time progression of the set of musical notes;

wherein the music is analyzed.

29. The computing device for analyzing music of claim 28, wherein the correlation comprises:

one or more selected from the group consisting of:

a musical part of the set of musical notes, a musical voice of the set of musical notes, a note depth in time consisting of:

a time interval between two or more of the musical notes of the set of musical notes;

the musical notes of the set of musical notes, a musical interval of the set of musical notes, a note topology consisting of:

a first symbol associated with one respective pitch class of a first note of the first set of musical notes; and a transition from the first symbol to the first symbol or to a second symbol associated with one respective pitch class of a second note of the first set of musical notes; and a note direction consisting of:

up or down or same from one pitch(J−1) to one pitch(J) of the respective J−1th and Jth musical notes of the set of musical notes.

30. The computing device for analyzing music of claim 28, further comprising:

a processor; a memory; and a storage device.

* * * * *